US006236385B1

(12) United States Patent
Nomura et al.

(10) Patent No.: US 6,236,385 B1
(45) **Date of Patent: *May 22, 2001**

(54) METHOD OF DRIVING A LIQUID CRYSTAL DISPLAY DEVICE

(75) Inventors: Hiroaki Nomura; Yuzuru Sato; Akira Inoue; Takaaki Tanaka; Kenichi Momose, all of Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/183,602

(22) Filed: Oct. 29, 1998

Related U.S. Application Data

(62) Division of application No. 08/837,506, filed on Apr. 18, 1997, now Pat. No. 5,835,075, which is a division of application No. 08/199,369, filed on Feb. 18, 1994, now Pat. No. 5,684,503.

(30) Foreign Application Priority Data

| | | |
|---|---|---|
| Feb. 25, 1993 | (JP) | 5-37057 |
| May 24, 1993 | (JP) | 5-121706 |
| Aug. 10, 1993 | (JP) | 5-198604 |
| Oct. 21, 1993 | (JP) | 5-263898 |
| Nov. 4, 1993 | (JP) | 5-275736 |
| Dec. 29, 1993 | (JP) | 5-352493 |

(51) Int. Cl.[7] ..... G09G 3/36
(52) U.S. Cl. ..... 345/95; 345/94
(58) Field of Search ..... 345/94, 95, 97, 345/96, 99, 101, 208; 349/33

(56) References Cited

U.S. PATENT DOCUMENTS

| | | | |
|---|---|---|---|
| 4,701,026 | 10/1987 | Yazaki et al. | 350/333 |
| 4,850,676 | 7/1989 | Yazaki et al. | 350/322 |
| 5,488,499 | 1/1996 | Tanaka et al. | 359/102 |
| 5,594,464 * | 1/1997 | Tanaka et al. | 345/94 |

FOREIGN PATENT DOCUMENTS

| | | |
|---|---|---|
| 0197743 | 10/1986 | (EP) . |
| 0285402 | 10/1988 | (EP) . |
| 0300755 | 1/1989 | (EP) . |
| 0379326 | 7/1990 | (EP) . |
| 0479530 | 4/1992 | (EP) . |
| 536975 | 4/1993 | (EP) . |
| 0569029 | 11/1993 | (EP) . |

OTHER PUBLICATIONS

IEEE Transactions on Electron Devices, vol. 36, on.9–I, Sep. 1989 New York, US, pp. 1895–1899, Ferroelectric Liquid–Crystal Video Display, W.J.A.M. Hartmann.

* cited by examiner

*Primary Examiner*—Amare Mengistu
*Assistant Examiner*—Jimmy H. Nguyen

(57) ABSTRACT

A method of driving a liquid crystal that has a memory capability, wherein a reset voltage is initially applied to the liquid crystal during a reset period, to bring about a Freéd-ericksz transition in the liquid crystal. During a subsequent selection period, a selection voltage that is selected on the basis of a critical value that brings about one of two metastable states in the liquid crystal is applied to the liquid crystal, and, during a non-selection period that follows the selection period, a non-selection voltage that is less than or equal to a threshold value that maintains two metastable states is applied to the liquid crystal. A delay period is provided between the reset period and the selection period, in order to gain effective timing for applying the selection voltage to the liquid crystal after the application of the reset voltage has been turned off. This shortens the length of the selection period, and hence the write time.

8 Claims, 45 Drawing Sheets

Yn

Yn+1

Yn+2

Xm

Yn-Xm

T1
T2
T3

Yn

Yn+1

Yn+2

Xm
t/2
t/2
T3

Yn-Xm
t/2
t/2
T3

FRAME K
FRAME (K+1)
T1 T2 T3 T4
SELECT
RESET
DE-LAY
NON-SELECT
V8-
V7-
V6-
V5-
Yn
V4-
V3-
V2-
V1-
RESET
DELAY
NON-SELECT
SELECT

V8-
V7-
V6-
V5-
Yn+1
V4-
V3-
V2-
V1-

OFF
V7-
V6-
V5-
ON
Xm
ON
V4-
V3-
V2-
OFF

V8-V2
V8-V5
Yn-Xm
V1-V4
V1-V7

Yn

Yn+1

Xm

Yn-Xm

Yn

Yn+1

Xm

Yn-Xm

Yn

Xm

Yn - Xm

FIG.37A
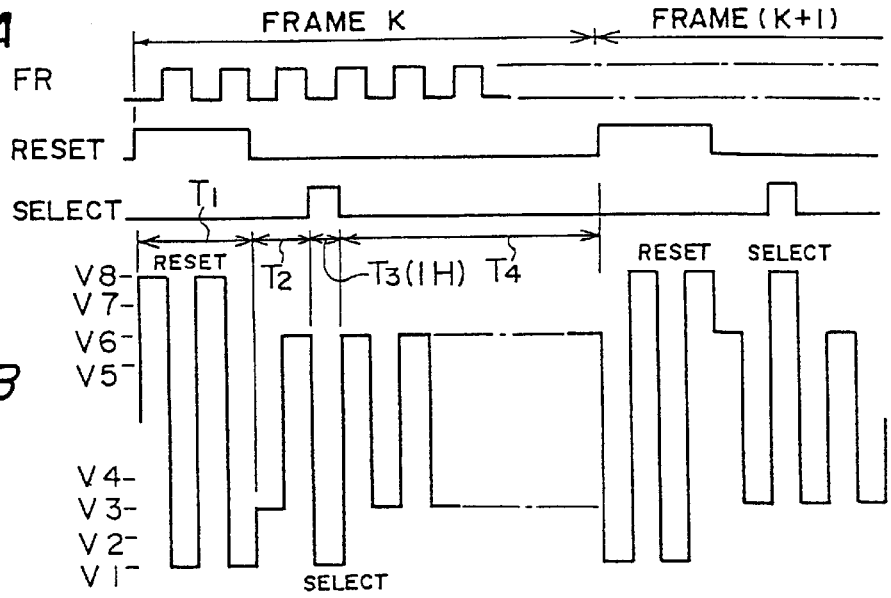
FIG.37B
Yn
FIG.37C
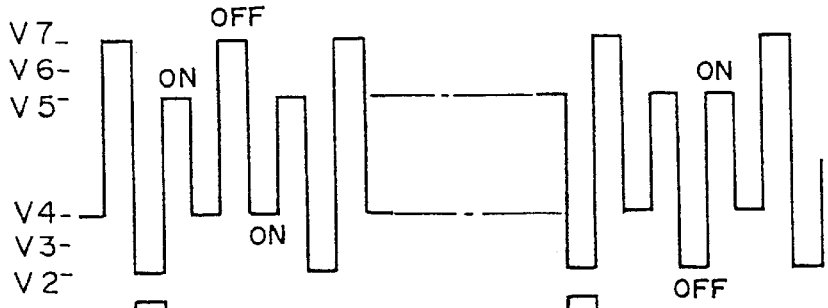
Xm
FIG.37D
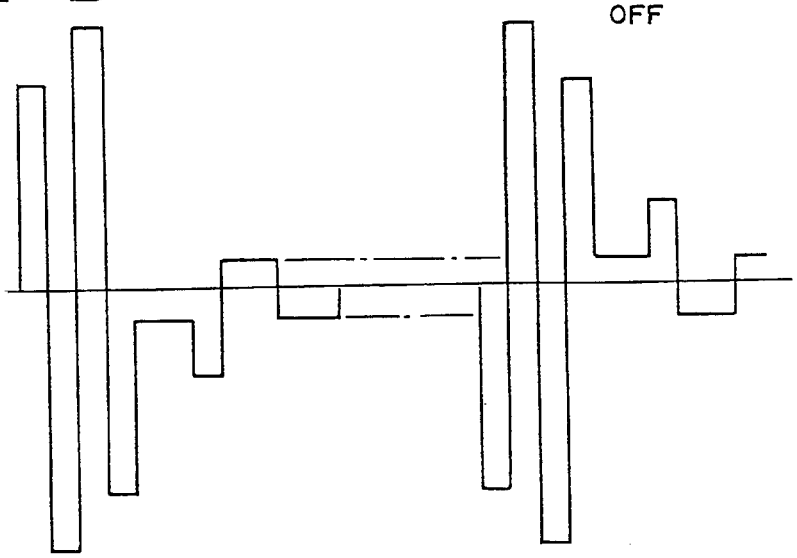
Yn-Xm

METHOD OF DRIVING A LIQUID CRYSTAL DISPLAY DEVICE

This is a Divisional of prior application Ser. No. 08/837,506 filed on Apr. 18, 1997, now U.S. Pat. No. 5,835,075 which is a divisional of Ser. No. 08/199,369 filed on Feb. 18, 1994 which is now U.S. Pat. No. 5,684,503, the contents of which are incorporated herein by reference.

BACKGROUND OF THE INVENTION

1. Field of the Invention

The present invention relates to a method of driving a liquid crystal display device that uses a chiral nematic liquid crystal having two metastable states. More specifically, it relates to a drive method that improves the speed of writing. The present invention also relates to a drive method that can compensate the drive voltage to cope with irregularities in the threshold value of the liquid crystal that are specific to each liquid crystal panel, and provide temperature compensation of the drive voltage. The present invention further relates to a drive method that ameliorates the imbalance between the voltages of two different drive waveforms and makes it possible to turn the drive circuitry into an Integrated Circuit chip (IC).

2. Related Art

The driving of a liquid crystal that has bistability, using a chiral nematic liquid crystal medium, has already been disclosed in Japanese Laid-Open Publication 1-51818, which includes descriptions of initial orientation conditions, two metastable states, and a method of switching between these two metastable states.

However, the drive method described in Japanese Laid-Open Publication 1-51818 has many implicit problems when it comes to practical implementation. For example, the above mentioned publication discloses two methods for switching between metastable states.

The first method obtains the two metastable states as follows: a 360° twist orientation state is obtained by using a toggle switch to suddenly turn off the voltage (60 Hz, 15 V peak-to-peak) applied to the liquid crystal; and a 0° uniform orientation state is obtained by using a variable-voltage device to allow the voltage applied to the liquid crystal to slowly fall over approximately 1 second.

The second method is as follows: if a high frequency of 1500 kHz is applied directly to the liquid crystal after a low-frequency field is turned off, a 360° twist orientation state is enabled. If the 1500-kHz high-frequency field is applied after a delay of approximately ¼ second after the same low-frequency field has been turned off, a 0° uniform orientation state is achieved.

The first method is completely impracticable; it can never progress beyond simple verification in the laboratory. When the present inventors came to experiment with the latter method, they discovered that, if a high-frequency field is applied after a delay of approximately ¼ second after the low-frequency field has been turned off, the same 360° twist orientation state is achieved, and it was thus impossible to switch between the two metastable states.

Further, Japanese Laid-Open Publication 1-51818 states nothing about a matrix display which is currently most appropriate for practical use and has high quality as a display device, and disclosed nothing about a drive method for such a device.

In U.S. patent application Ser. Nos. 08/059,226 and 08/093,290, the inventors of the present invention disclosed a method of controlling the backflow generated in liquid crystal cells to ameliorate the above described fault. However, these disclosures did not have as their objective, shortening the time required to write each line. Therefore, the time required for each embodiment of the above-mentioned disclosures to write one line of a matrix display is 400 μs, so that writing of 400 or more lines would necessitate a total of at least 160 ms (6.25 Hz). This is impracticable because it would result in flickering of the display.

In general, irregularities in the drive characteristics that are induced during the process of fabricating a liquid crystal display panel include differences in drive characteristics that depend on position within any one display panel and differences in drive characteristics between different display panels caused by differences between manufacturing lots. Therefore, to ensure that a whole liquid crystal display screen can be used with its display quality always optimized, it is necessary to provide subtle control of the drive voltage to match each panel. In addition, even if the optimal adjustment has been achieved by some method, new changes in the drive conditions are likely to be caused by variations in the surrounding temperature, so it is essential to provide further adjustment to match temperature variations.

Differences in the threshold value of the drive voltage within a single panel are shown in FIG. 49. Since the drive voltage varies in this manner in response to small differences in orientation state or variations in cell gap, an optimal adjustment of the drive voltage must be done for each panel to accommodate its worst area. Variations in drive voltage with respect to temperature variations that are assumed likely to occur for a matrix drive are shown in FIG. 18. The gradient of the curve with respect to temperature is low at 0.02 V/C, but, if a voltage change ratio of 0.56%/°C. is considered based on a drive voltage of 25° C., this becomes fairly large at 19.6% over an actual temperature range of 5 to 40° C. This looks promising for compensation to the optimal display in practical use.

When it comes to driving a liquid crystal having a memory capability, a reset pulse of a comparatively large absolute value must be applied to the liquid crystal in order to cause a Freédericksz transition in the liquid crystal molecules. This causes a large imbalance in the voltage ratio between the scan and data signals during matrix drive. This imbalance is expected to lead to large problems in the configuration of specific drive circuits, or the turning of such circuits into ICs.

SUMMARY OF THE INVENTION

It is an object of the present invention is to provide a highly practicable method of driving a liquid crystal that shortens the write time and prevents flickering of the display when it is used to drive a chiral nematic liquid crystal having a memory capability.

Another object of the present invention is to shorten the time required to write one line of data and thus provide a method of driving a liquid crystal with a high duty ratio such that it can be applied to a large-screen liquid crystal panel.

A further object of the present invention is to provide a method of driving a liquid crystal that can compensate for fabrication-induced irregularities in the threshold value of the liquid crystal within the liquid crystal panel, or for variations in drive voltage caused by ambient temperature.

A still further object of the present invention is to provide a method of driving a liquid crystal that can reduce the imbalance between the voltages of the scan and data signals, simplify the configuration of the drive circuitry, and make the drive circuitry suitable for incorporation in ICs, even when a reset voltage of a comparatively large absolute value is applied to the liquid crystal.

Briefly, the method of the present invention relates to a method of driving a liquid crystal display device that uses a chiral nematic liquid crystal medium wherein liquid crystal molecules interposed between substrates have a predetermined angle of twist in an initial state, and wherein the chiral nematic liquid crystal medium has two metastable states that differ from the initial state as relaxation states after a voltage that brings about a Freédericksz transition is applied to the liquid crystal while it is in the initial state. This method is characterized in comprising the following four steps (a–d), which are to be read with FIGS. 2A–2B:

a) during a reset period T1, applying to the liquid crystal a reset voltage 30 greater than or equal to the threshold value that brings about the Freédericksz transition;

b) during a selection period T3 after reset period T1, applying to the liquid crystal a selection voltage 32 that is selected on the basis of a critical value that brings about either of two metastable states;

c) during a non-selection period T4 following selection period T3, applying to the liquid crystal a non-selection voltage 33 less than or equal to a threshold value that maintains the two metastable states; and d) during a delay period T2 between reset period T1 and selection period T3, applying to the liquid crystal a delay voltage 31 less than or equal to non-selection voltage 33.

With this drive method, the length of selection period T3 is shortened by the addition of delay period T2; in other words, it can shorten the write time. In particular, the length of the delay period may be set such that the selection voltage is applied to the liquid crystal at a time in the vicinity of a transition point to the two metastable states, after backflow has occurred and the liquid crystal molecules at the approximate center between the substrates have relaxed into one of the metastable states from a homeotropic orientation state, directly after the application of the reset voltage has ended. The orientation state of the liquid crystal is determined to be either of two metastable states by the appropriate application of a trigger after backflow has occurred in the liquid crystal.

When the method of the present invention is applied to driving a matrix liquid crystal device, a difference signal Yn-Xm (which expresses the difference between a row electrode signal Yn and a column electrode signal Xm) is made to include, within one frame period, a selection period T3 that sets each row electrode in sequence, a subsequent non-selection period T4, a reset period T1 that is set before selection period T3, and a delay period T2 that is set between reset period T1 and selection period T3, as shown in FIGS. 8A–8D. In this case, row electrode signal Yn is at a reset potential Vr during reset period T1, at a selection potential (e.g., ±2 Vb) during selection period T3, and at a non-selection potential (e.g., 0 V) during non-selection period T4. Column electrode signal Xm is set to the data potential of either an ON selection potential or an OFF selection potential (e.g., ±Vb) in synchronization with selection period T3.

The present invention can also be applied to a method in which selection period T3 after delay period T2 is handled as a first selection period, and a pair of periods comprising an interval period T5 when a non-selection voltage 34 is applied to the liquid crystal and a second selection period T6 when selection voltage 32 is applied to the liquid crystal, is provided either once or a plurality of times between this first selection period T3 and non-selection period T4, as shown in FIG. 9A or FIG. 9B.

The liquid crystal having a memory capability that is the target of the present invention utilizes a cumulative pulse response effect within an extremely short period, such as 1 to 2 ms after the reset voltage has been turned off. Therefore, even if the selection pulse is divided into a plurality of pulses, display is enabled in the same manner as if there were only one pulse. It should be noted that this divided selection pulse drive can also be applied to a drive method in which no delay period T2 is set within the period T of one frame, as shown in FIG. 13.

If the unit time corresponding to each of the first and second selection periods T3 and T6 is set to 1 H, setting the interval period to (1 H)×m (where m is an integer) will ensure that there are no problems even with a matrix drive.

Similarly, the delay period may be set to (1 H/2)×n (where n is an integer) for an alternating drive wherein the polarity of the voltage applied to the liquid crystal is inverted at each pulse, from consideration of the fact that the pulse width is 1 H/2.

In addition, the duty ratio of a period _t_ of the selection potential with respect to selection period T3 of row electrode signal Yn and/or the duty ratio of a period t of the data potential with respect to selection period T3 of column electrode signal Xm can be set to less than 100%, as shown in FIGS. 14, 16, 17, and 19.

Changing the duty ratio of the total pulse width t of the selection pulse(s) with respect to selection period T3 can provide the same effect, so long as the RMS voltage does not change within selection period T3. If the peak voltage value of the selection pulse is increased by reducing the duty ratio, drive voltage accuracy of the circuitry can be made easier to achieve. Similarly, if the duty ratio of the pulse is varied with the drive voltage kept constant, it is clear that the display effect can be varied by causing variations in the RMS value. In other words, by changing the duty ratio, the method of the present invention can compensate for subtle differences in drive voltage attributed to irregularities in the threshold value of the liquid crystal within the display panel, such as those shown in FIG. 49. The threshold value of the liquid crystal is also affected by temperature, so that varying the duty ratio can also enable temperature compensation.

At least one of the row electrode signals supplied to a plurality of the row electrodes respectively can be set such that the duty ratio of the period of the selection potential with respect to the selection period has a different value from that of the other row electrode signals. This can compensate for differences in drive voltage attributed to irregularities in the threshold value of the liquid crystal at the top and bottom of the liquid crystal panel.

At least one of the column electrode signals supplied to a plurality of the column electrodes could be set such that the duty ratio of the data potential period with respect to the selection period has a different value from that of the other column electrode signals. This can compensate for differences in drive voltage attributed to irregularities in the threshold value of the liquid crystal at the left and right sides of the liquid crystal panel.

A column electrode signal could be adjusted such that the duty ratio of the period of the data potential with respect to the selection period corresponding to one pixel on one of the column electrodes that is supplied with one of the column electrode signals is set to be different from that of the selection periods corresponding to the other pixels on the one column electrode. This can compensate for differences in drive voltage attributed to irregularities in the threshold value of the liquid crystal at the top and bottom of each column of the liquid crystal panel.

The above described changing of the duty ratio of the selection pulse width with respect to the selection period is not necessarily limited to application to a drive waveform that specifies delay period T2 within a frame period. For example, it is also effective for changing the duty ratio of the above described drive waveform shown in FIG. 3 that does not specify delay period T2.

The present invention can also compensate for irregularities in the threshold value of the liquid crystal or changes in the threshold value of the liquid crystal dependent on ambient temperature, by changing a parameter relating to a state in which the selection voltage is imposed that can change the threshold value of the liquid crystal.

The delay period can be varied either manually or automatically as this parameter. In other words, the delay time could be set to be long when the threshold value of the liquid crystal is high, but short when the threshold value of the liquid crystal is low. Similarly, when temperature compensation is required, the delay time could be set to be short when the detected ambient temperature is high, but long when the ambient temperature is low, so that the threshold value of the liquid crystal can be maintained within a constant range, regardless of the ambient temperature.

The selection voltage can be varied either manually or automatically as this parameter. In other words, the absolute value of the selection voltage could be set to be large when the threshold value of the liquid crystal is high, but small when the threshold value of the liquid crystal is low. Similarly, when temperature compensation is required, the absolute value of the selection voltage could be set to be small when the detected ambient temperature is high, but large when the ambient temperature is low, so that the threshold value of the liquid crystal can be maintained within a constant range, regardless of the ambient temperature.

The length of selection period dependent on the drive frequency can be varied either manually or automatically as this parameter. In other words, the drive frequency can be set to be low and thus the selection period long when the threshold value of the liquid crystal is high, and the drive frequency can be set to be high and thus the selection period short when the threshold value of the liquid crystal is low. Similarly, when temperature compensation is required, the drive frequency can be set to be high when the detected ambient temperature is high, but low when the ambient temperature is low, so that the threshold value of the liquid crystal can be maintained within a constant range, regardless of the ambient temperature.

The duty ratio with respect to the selection period of the period during which the selection voltage is applied to the liquid crystal can be varied either manually or automatically as this parameter. In other words, the duty ratio could be set to be high when the threshold value of the liquid crystal is high, but low when the threshold value of the liquid crystal is low. Similarly, when temperature compensation is required, the duty ratio could be set to be low when the detected ambient temperature is high, but high when the ambient temperature is low, so that the threshold value of the liquid crystal can be maintained within a constant range, regardless of the ambient temperature.

In any of the above cases, a working temperature region could be divided into a plurality of temperature ranges, a parameter could be preset to have a different value within each of these temperature ranges, and temperature compensation could be provided by selecting a setting for the predetermined parameter in the temperature range that the ambient temperature belongs to.

The above described drive method that involves a parameter is also effective for the drive waveform shown in FIG. 3, which does not specify delay period T2 within one frame period.

Since it is necessary to apply a reset voltage of a comparatively large absolute value to the liquid crystal during reset period T1, the present invention can also provide a seven-level drive method.

This seven-level drive method enables the drive of a liquid crystal using seven levels of potential: two types of potential (e.g., ±Vb) are set as data potentials of column electrode signal Xm (as shown in FIGS. 8A–8D) for applying an ON or OFF selection voltage to the liquid crystal, two types of potential (e.g., ±Vr) are set as data potentials for row electrode signal Yn for applying either a positive or negative reset voltage to the liquid crystal during reset period T1, two types of potential (e.g., ±2 Vb) are set as selection potentials for applying either a positive or negative selection voltage to the liquid crystal during selection period T3, and a potential intermediate between the two types of selection potential (e.g., 0 V) is set as a non-selection potential during the delay period and the non-selection period.

The present invention can be applied to a drive method that comprises at least eight levels.

An eight-level drive method enables the drive of a liquid crystal using at least eight levels of potential: four types of potential are set as data potentials of the column electrode signal for applying positive or negative ON selection voltages and positive and negative OFF selection voltages to the liquid crystal, two types of potential are set as reset potentials of the row electrode signal for applying positive and negative reset voltages to the liquid crystal during the reset period, two types of potential are set as selection potentials for applying positive and negative selection voltages to the liquid crystal during the selection period, two types of data potential are set as non-selection potentials for imparting bias potentials to the above four types of the data potential during the delay period and the non-selection period, and either two types of the selection potential or two potentials among four types of data potential set to be the same as two types of the reset potential.

These eight levels of potential are divided into four levels in a first, low-voltage group (V1, V2, V3, and V4, where V1<V2<V3<V4) and four levels in a second, high-voltage group (V5, V6, V7, and V8, where V4<V5<V6<V7<V8).

When the data potential of the column electrode signal is in the first group, the reset potential is selected from amongst the second group; when the data potential of the column electrode signal is in the second group, the reset potential is selected from amongst the first group.

In each of the periods other than the reset period, when the data potential of the column electrode signal is in the first group, one potential could be selected from the same first group; when the data potential of the column electrode signal is in the second group, one potential could be selected from the same second group.

This ensures that a reset voltage of a comparatively large absolute value of over 20 V and a non-selection voltage in the vicinity of 1 V can be applied to the liquid crystal, without having to generate a large voltage difference between the voltage of the row electrode signal and the voltage of the column electrode signal. This makes it easier to configure the drive circuitry, and is particularly favorable for the fabrication of an IC.

In this case, if the potential difference between potential V4 of the first group and potential V5 of the second group is large, the absolute value of the reset voltage applied to the liquid crystal during the reset period can also be set to be large.

In a kth frame (where k is an integer), the ON selection potential of column electrode signal Xm is set to V5 of the second group and the OFF selection potential is set to V7, as shown in FIG. 32. The reset potential of row electrode signal Yn is set to V1, the selection potential to V8, and the non-selection potential to V6.

In the subsequent (k+1)th frame, the ON selection potential of column electrode signal Xm is set to V4 of the first group and the OFF selection potential to V2. The reset potential of row electrode signal Yn is set to V8, the selection potential to V1, and the non-selection potential to V3, thus enabling an alternating drive for the liquid crystal in which the polarity is inverted every frame.

Alternatively, in the kth frame (where k is an integer), the ON selection potential of column electrode signal Xm is set to V8 of the second group and the OFF selection potential to V6, as shown in FIG. 33. The reset potential of row electrode signal Yn is set to V1, the selection potential to V5, and the non-selection potential to V7.

In the subsequent (k+1)th frame, the ON selection potential of column electrode signal Xm is set to V1 of the first group and the OFF selection potential to V3. The reset potential of row electrode signal Yn is set to V8, the selection potential to V4, and the non-selection potential to V2, thus enabling an alternating drive for the liquid crystal in which the polarity is inverted every frame.

As a further alternative, the ON selection potential of column electrode signal Xm within one frame period T is set by alternating pulses between V4 and V5, and the OFF selection potential of column electrode signal Xm is set by alternating pulses between V2 and V7, as shown in FIG. 34. In a sequence corresponding thereto, the reset potential of row electrode signal Yn is set by alternating pulses between V8 and V1, the selection potential by alternating pulses between V1 and V8, and the non-selection potential by alternating pulses between V3 and V6.

This enables an alternating drive for the liquid crystal in which the polarity of the voltage applied to the liquid crystal is inverted every pulse.

As a yet further alternative, the ON selection potential of column electrode signal Xm within one frame period T is set by alternating pulses between V1 and V8, and the OFF selection potential of column electrode signal Xm is set by alternating pulses between V3 and V6, as shown in FIG. 35. In a sequence corresponding thereto, the reset potential of row electrode signal Yn is set by alternating pulses between V8 and V1, the selection potential by alternating pulses between V4 and V5, and the non-selection potential by alternating pulses between V2 and V7. This enables an alternating drive for the liquid crystal in which the polarity of the voltage applied to the liquid crystal is inverted at each pulse.

In the drive methods of FIGS. 32 and 34, if the relationships V4–V3=V3–V2=V7–V6=V6–V5 are set, approximately equal non-selection voltages can be applied to non-selection period T4.

In the drive methods of FIGS. 33 and 35, if the relationships V3–V2=V2–V1=V8–V7=V7–V6 are set, approximately equal non-selection voltages can be applied to the liquid crystal in non-selection period T4.

In the drive methods of FIGS. 34–35, if a unit time equivalent to selection period T3 is termed 1 H, the pulse width of a signal FR that causes the row and column electrode signals to alternate is also 1 H, and the phase of signal FR can be set to be offset by (1 H/2) with respect with the selection period of row electrode signal Yn. A drive method where this is applied to the drive method of FIG. 34 is shown in FIG. 36. In this case, the numbers of inversions of the drive potentials of the row and column electrode signals are half those of FIG. 34, but the number of inversions of the voltage applied to the liquid crystal can be guaranteed to be more.

Further, in the drive methods of FIGS. 34 and 35, the polarity of the voltage applied to the liquid crystal is inverted at each unit time equivalent to selection period T3 (1 H) so that, if the polarity at the beginning of the kth frame (where k is an integer) is positive, the polarity at the beginning of the (k+1)th frame is made negative; if the polarity at the beginning of the kth frame is negative, the polarity at the beginning of the (k+1)th frame is made positive. This enables an alternating drive for the liquid crystal in which polarity inversions every 1 H and every frame are combined. A drive method where this is applied to the drive method of FIG. 34 is shown in FIG. 37.

When each of the drive methods of FIGS. 32–37 is implemented, it is best from the circuit design point of view to have the voltages in the first group and the voltages in the second group set to be symmetrical in the positive and negative directions with respect to a center of the ground-level potential.

The above described seven-level and eight-level drive methods are not necessarily limited to application to a drive waveform that specifies delay period T2 within one frame period T; they are also effective for the drive waveform shown in FIG. 3, which does not specify delay period T2.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 14B is applied to a liquid crystal.

FIGS. 37A–37D show drive waveforms in accordance with the eight-level drive method relating to a twenty-first embodiment of the present invention.

DETAILED DESCRIPTION OF THE INVENTION

Configuration of Liquid Crystal Cell

Figure 1:
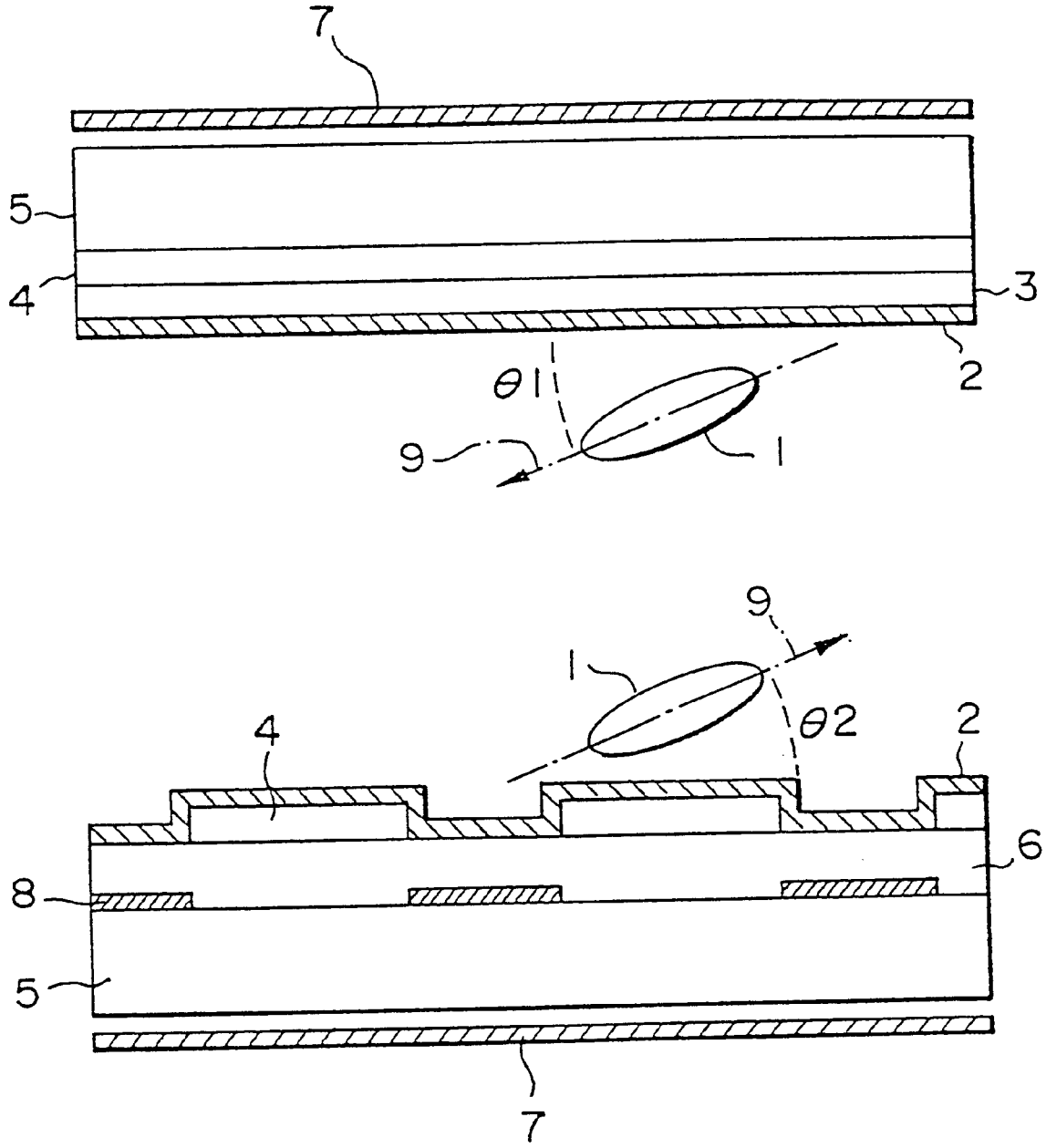
FIG. 1 is an abbreviated cross-sectional view of a liquid crystal cell used by embodiments of the liquid crystal display device in accordance with the present invention.

The liquid crystal medium used in each of the embodiments described below is formed by adding a chiral dopant (e.g., such as that available from E. Merck Corp. as product No. S811) to a nematic liquid crystal (e.g., such as that available from E. Merck Corp. as product No. ZLI3329), with the helical pitch of the liquid crystal being adjusted to 3 to 4 $\mu$m. As shown in FIG. 1, a pattern of transparent electrodes 4 is formed of indium tin oxide (ITO) on upper and lower glass substrates 5, and a polyimide orientation film 2 (of, e.g., product SP-740 from Toray Corp.) is painted over each pattern. Each polyimide orientation film 2 is then subjected to rubbing in directions that differ from each other by a predetermined angle $\Phi$ (in these embodiments, $\Phi$=180°). Spacers are inserted between upper and lower glass substrates 5 to ensure that the substrate gap is kept uniform at, e.g., a substrate gap (cell gap) of 2 $\mu$m or less. Thus, the ratio of the thickness of the liquid crystal layer to the twist pitch is 0.5±0.2.

When the liquid crystal medium is inserted into this cell, pretilt angles θ1 and θ2 of liquid crystal molecules 1 are small, and the initial orientation is a 180° twist state. This liquid crystal cell is sandwiched between two polarizing plates 7 that have different directions of polarization, as shown in FIG. 1, to form a display panel. Reference numeral 3 denotes an isolation layer, 6 denotes a planarizing layer, 8 denotes a masking layer between pixels, and 9 denotes a direction vector of liquid crystal molecules 1.

First Embodiment

Figure 2A:
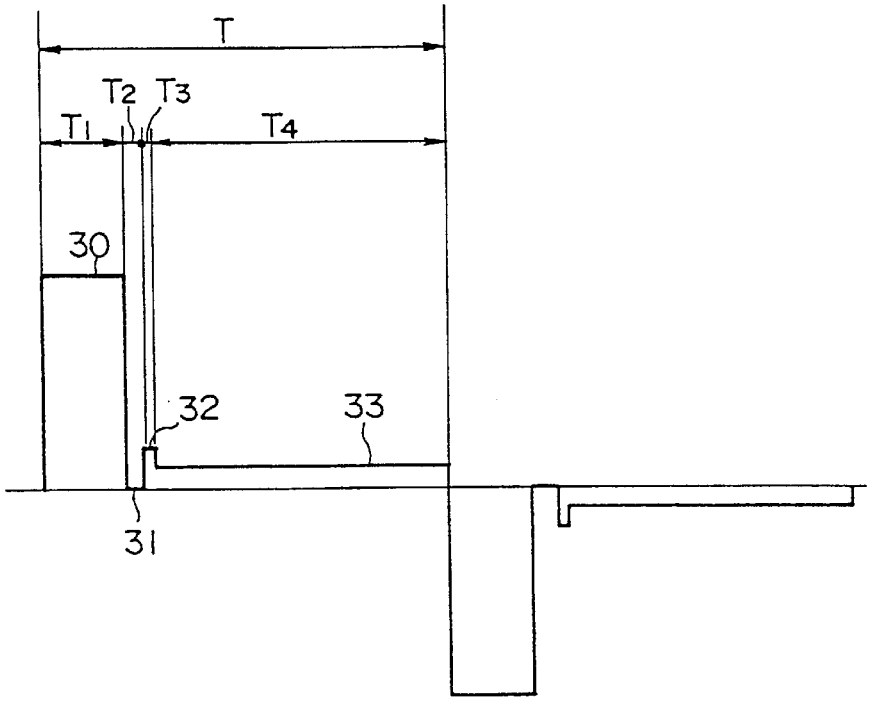
FIGS. 2A and 2B each show a drive waveform of a first embodiment, used in experiments relating to the present invention.
Figure 2B:
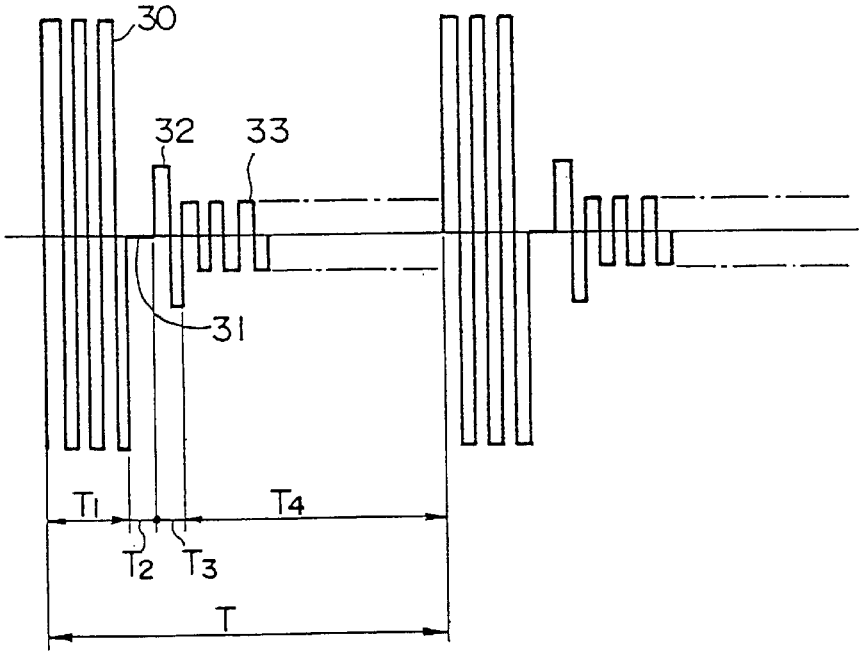

Two types of drive waveform relating to a first embodiment of the present invention, for driving the display panel shown of FIG. 1, are shown in FIGS. 2A and 2B. Each drive waveform in these figures includes a reset period T1, a delay period T2, a selection period T3, and a non-selection period T4 within one frame period T. FIG. 2A shows an alternating drive waveform in which the polarity of the voltage that causes the liquid crystal cell to be charged is inverted once every frame period T. FIG. 2B shows an alternating drive waveform in which the polarity of the voltage that causes the liquid crystal cell to be charged is inverted once every pulse of pulse width (T3)/2. In each of these figures, a reset voltage (reset pulse) 30 that is greater than or equal to the threshold value that brings about a Freédericksz transition in nematic liquid crystal is applied during reset period T1. In this embodiment, the peak value of reset voltage 30 is set to ±30 V. The reset period T2 is provided to delay the timing at which a selection voltage (selection pulse) 32 is applied to the liquid crystal cell during selection period T3, after reset voltage 30 has been applied to the liquid crystal cell. In this embodiment, a voltage which is the same as non-selection voltage 33, e.g., is applied to the liquid crystal cell during delay period T2 as a delay voltage 31. Selection voltage 32 applied to the liquid crystal cell in selection period T3 is selected with reference to a critical value that causes either of two metastable states in the nematic liquid crystal, such as a 360° twist orientation state and a 0° uniform orientation state. With the chiral nematic liquid crystal used in the first embodiment, if the peak value of selection voltage 32 is between zero and ±1 V, a 360° twist orientation state is obtained. On the other hand, if a voltage of 2 V or more is applied to the liquid crystal cell as selection voltage 32, a 0° uniform orientation state is obtained. During non-selection period T4, a non-selection voltage 33 of an absolute value smaller than selection voltage 32 is applied to the liquid crystal cell so that the liquid crystal can be maintained in the state selected in selection period T3.

Figure 3:
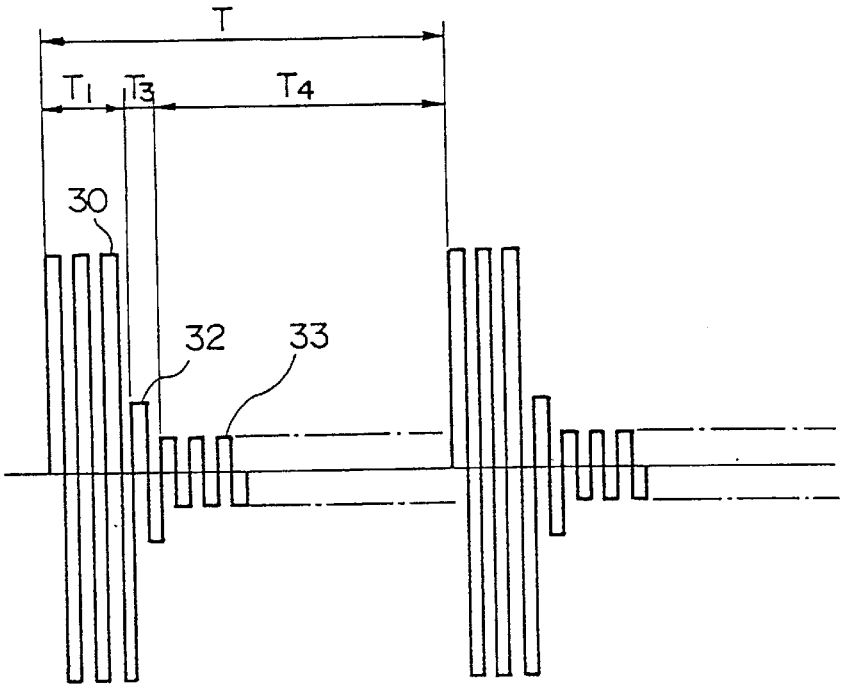
FIG. 3 shows a drive waveform in which there is no delay period.

A drive waveform is shown in FIG. 3 as a comparative example. The drive waveform shown in FIG. 3 is that disclosed previously by the applicants of the present invention in U.S. patent application Ser. Nos. 08/059,226 and 08/093,290. The drive method of FIG. 3 is similar to those of FIGS. 2A and 2B in that a reset period T1, a selection period T3, and a non-selection period T4 are provided within one frame period, but differs therefrom in that delay period T2 is not provided. In other words, the drive method of the first embodiment shown in FIGS. 2A and 2B differs greatly from the drive method of FIG. 3 in that selection voltage 32 is applied to the liquid crystal cell after delay period T2 has elapsed after the application of reset voltage 30.

Experimental results based on the drive method of either FIG. 2A or FIG. 2B are summarized in Table 2. For comparison, results based on the drive method of FIG. 3 are listed in Table 1. The display referenced in both tables was a transparent display with a backlight, wherein the ON state corresponded to a 0° uniform orientation state that passes light through and the OFF state corresponded to a 360° twist orientation state that shuts light out.

In Tables 1 and 2, the duty ratio is the ratio of (selection period T3)/(frame period T), the pulse width is that of the selection pulse, and the delay time is the length of delay period T2. In the drive method of FIG. 2A, the pulse width is equal to T3, whereas in the drive methods of FIGS. 2B and 3, the pulse width is equal to (T3)/2. In each of FIGS. 2A, 2B, and 3, the write time for one line matches selection period T3. In each of Tables 1 and 2, the ON voltage is the value of selection voltage 32 applied to the liquid crystal cell that causes the 0° uniform orientation state in the liquid crystal cell. The OFF voltage is the value of selection voltage 32 applied to the liquid crystal cell that causes the 360° twist orientation state.

TABLE 1

| Waveform | Duty Ratio | Pulse Width $T_3/2$ (μs) | Delay Time (μs) | ON Voltage (V) | OFF Voltage (V) | ON/OFF Capability |
|---|---|---|---|---|---|---|
| FIG. 3 | 1/60 | 200 | 0 | 2 | 0 | — |
| | 1/120 | 100 | 0 | 2 | 0 | — |
| | 1/240 | 50 | 0 | 3 | 0 | x |

TABLE 2

| Waveform | Duty Ratio | Pulse Width (μs) | Delay Time (μs) | ON Voltage (V) | OFF Voltage (V) | ON/OFF Capability |
|---|---|---|---|---|---|---|
| FIG. 2A | 1/240 | 100 (= $T_3$) | 0 | 3 | 0 | x |
| | | | 100 | 3 | 0 | — |
| | | | 200 | 3 | 0 | — |
| FIG. 2B | 1/240 | 50 (= $T_3/2$) | 0 | 3 | 0 | x |
| | | | 50 | 3 | 0 | — |
| | | | 100 | 3 | 0 | — |
| | | | 200 | 3 | 0 | — |
| FIG. 2A | 1/480 | 50 (= $T_3$) | 0 | 3 | 0 | x |
| | | | 50 | 3 | 0 | x |
| | | | 100 | 3 | 0 | x |
| | | | 200 | 3 | 0 | x |
| | | | 0 | 5 | 0 | x |
| | | | 50 | 5 | 0 | — |
| | | | 100 | 5 | 0 | — |
| | | | 150 | 5 | 0 | — |
| FIG. 2B | 1/480 | 25 (= $T_3/2$) | 0 | 5 | 0 | x |
| | | | 50 | 5 | 0 | — |
| | | | 100 | 5 | 0 | — |
| | | | 250 | 5 | 0 | — |

As can be seen from a comparison of Tables 1 and 2, if a delay time is inserted after the application of reset voltage 30 and then selection voltage 32 is applied to the liquid crystal cell, the liquid crystal can be switched on and off even when selection voltage 32 of a pulse width that cannot provide switching of the display with the drive method of FIG. 3 is applied to the liquid crystal. For example, with the conditions shown in Table 1 of a duty ratio of 1/240, a pulse width of 50 μs, ON/OFF voltages of 3 V/0 V, and a delay time of 0, it is not possible to switch the display on and off. However, as shown in Table 2, if a delay time of at least 50 μs is inserted before the same selection voltage 32 is applied to the liquid crystal cell, it becomes possible to switch the display on and off. In other words, this means that the write required to write one line with a matrix type of display can be improved such that the 200 μs of the prior art method is halved to 100 μs. If the ON voltage is raised from 3 V to 5 V with a delay time of at least 50 μs, it has been verified that the time period required to write one line can be further shortened to 50 μs, even in response to a pulse of pulse width 25 μs.

Figure 4:
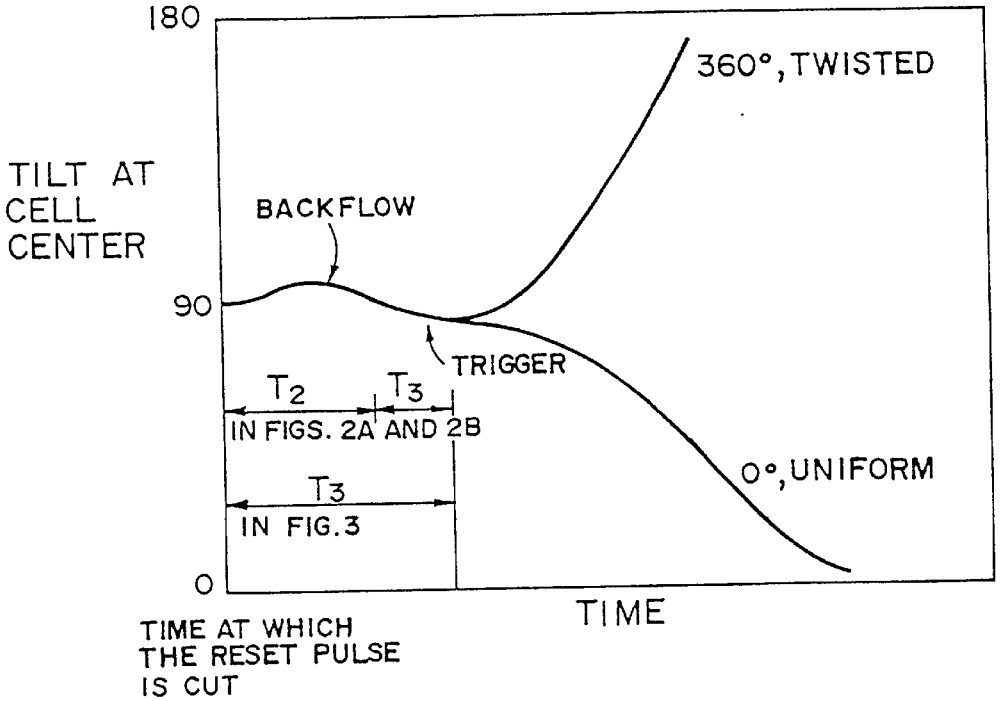
FIG. 4 is a graph illustrating the behavior of molecules of a bistable liquid crystal used by embodiments of the present invention.

The results of dynamic simulation of the behavior of a bistable liquid crystal used with the present invention, and the relationship between delay period T2 and selection period T3 are shown in FIG. 4. In this graph, time is plotted along the X-axis, and the tilt of molecules at the center of the liquid crystal cell is plotted along the Y-axis, with a start point being the time at which the reset pulse is cut. As can be seen from this figure, after the liquid crystal molecules are in a vertically standing state (homeotropic orientation state), they fall slightly backward (backflow), then return and are divided into those that proceed to a tilt of 0° and those that move on through a further 180°. The former is a transition to a 0° uniform orientation state and the latter corresponds to a transition to a 360° twist orientation state where a twist is added to the change in tilt. It is clear from this figure that the behavior of the liquid crystal immediately after the reset pulse 30 is cut and up through the same backflow process is exactly the same regardless of whether the eventual transition is to the 0° uniform orientation state or the 360° twist orientation state. In other words, it's a trigger (the arrow in FIG. 4) after the backflow that determines whether the orientation state of the liquid crystal is 0° or 360°.

With the drive waveform of FIG. 3, which was disclosed in the two U.S. patent applications mentioned above, selection period T3 is set immediately after reset period T1 has expired, as shown in FIG. 4. With the drive method shown in FIG. 3, the liquid crystal can be turned on and off so long as this selection period T3 is extended as far as the timing at which this trigger ought to be imposed, after backflow has occurred in the liquid crystal. In fact, Table 1 shows that if the length of selection period T3 is set to either 400 μs or 200 μs, it is possible to switch the liquid crystal on and off, but if the length of selection period T3 is set to 100 μs, it is no longer possible to switch the liquid crystal on and off.

In contrast, by inserting delay period T2 between reset period T1 and selection period T3, and adjusting the length of delay period T2, the drive method of FIGS. 2A and 2B which concerns the drive method of the first embodiment makes it possible to apply selection voltage 32 to the liquid crystal at the timing at which this trigger ought to be imposed after backflow has ended, without having to adjust the length of selection period T3. That is why it becomes possible to switch the liquid crystal on and off with this embodiment, even when the length of selection period T3 is greatly reduced to 50 μs, as shown in Table 2.

Second Embodiment

Figure 5:
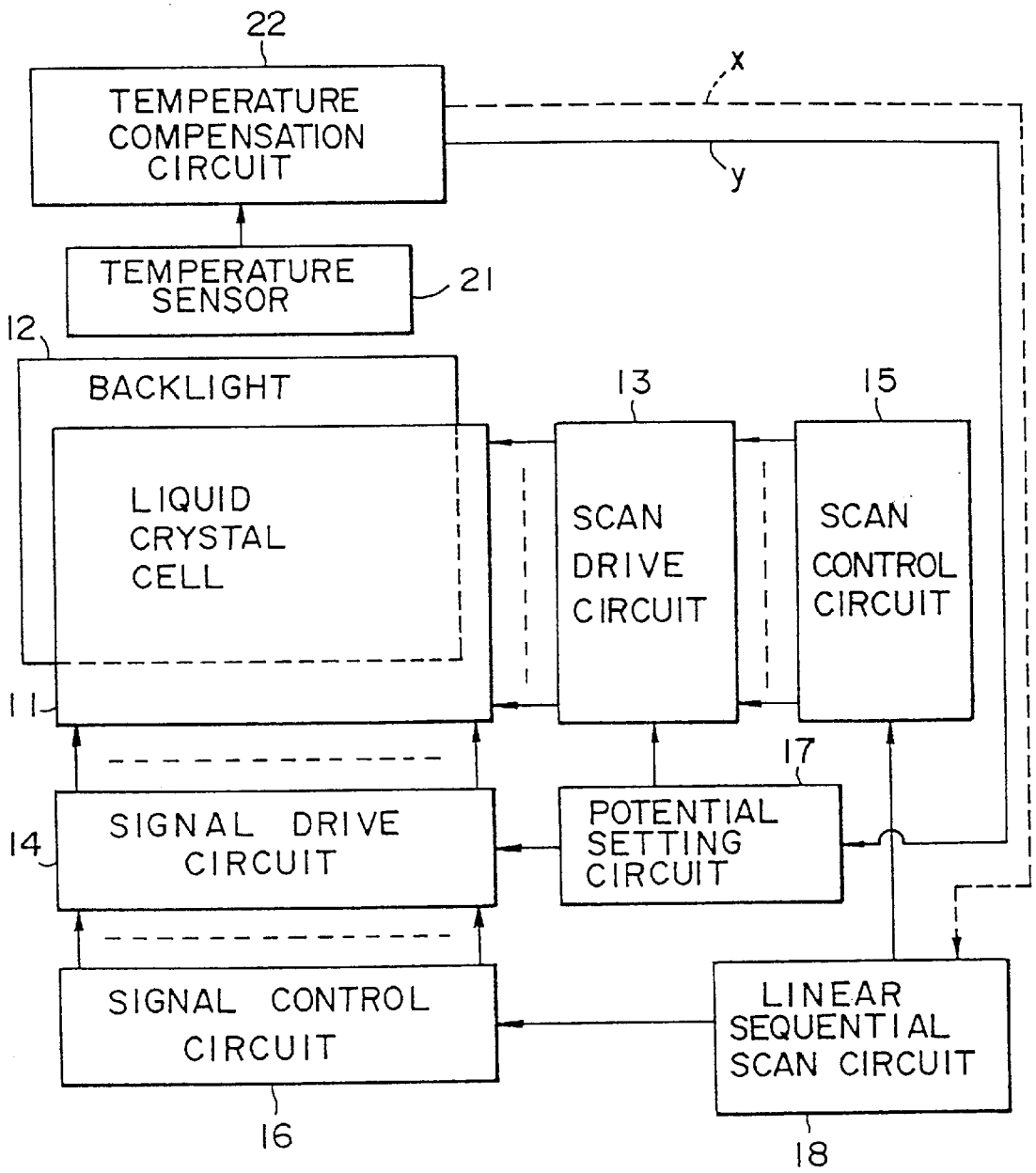
FIG. 5 is a block diagram of the entire liquid crystal drive circuitry.

A simple matrix type of liquid crystal display panel shown in FIG. 5 was fabricated using the liquid crystal cell shown in FIG. 1. This liquid crystal display panel is of a transparent type with a backlight 12 positioned at a back surface of a liquid crystal cell 11. A scan drive circuit 13 is connected to scan electrodes (row electrodes) of the liquid crystal cell 11, and this scan drive circuit 13 is controlled by a scan control circuit 15. Similarly, signal electrodes (column electrodes) are connected to a signal drive circuit 14 of liquid crystal cell 11, and signal drive circuit 14 is controlled by a signal control circuit 16. A predetermined applied voltage from a potential setting circuit 17 is supplied to scan drive circuit 13 and signal drive circuit 14. A reference clock signal and a predetermined timing signal are supplied to scan control circuit 15 and signal control circuit 16 from a line sequential scan circuit 18.

Figure 6:
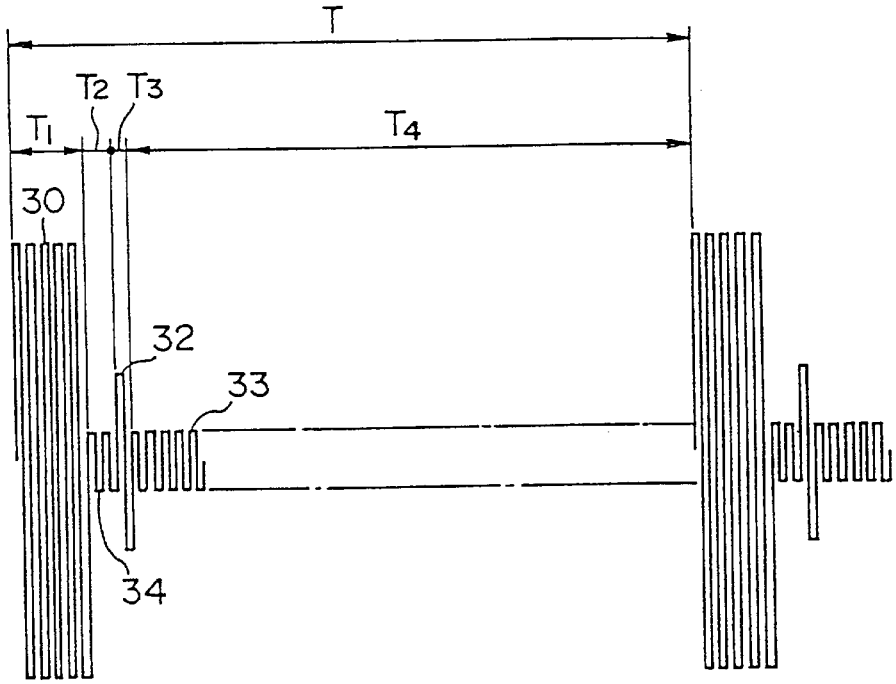
FIG. 6 shows a matrix drive waveform relating to a second embodiment that, applies the present invention.

The drive waveform used to drive the simple matrix type of liquid crystal display panel of FIG. 5 is shown in FIG. 6. A bias voltage 34 is the same as non-selection voltage 33 during delay period T2 after reset voltage 30, and is inevitably applied when the pixels of other rows are selected. In the drive waveform shown in FIG. 6, the length of selection period T3 matches one horizontal scanning period (1 H). The length of delay period T2 is set to be (1 H/2)×n (where n is an integer), from consideration of the fact that the drive alternates once every pulse of pulse width 1 H/2.

Figure 7:
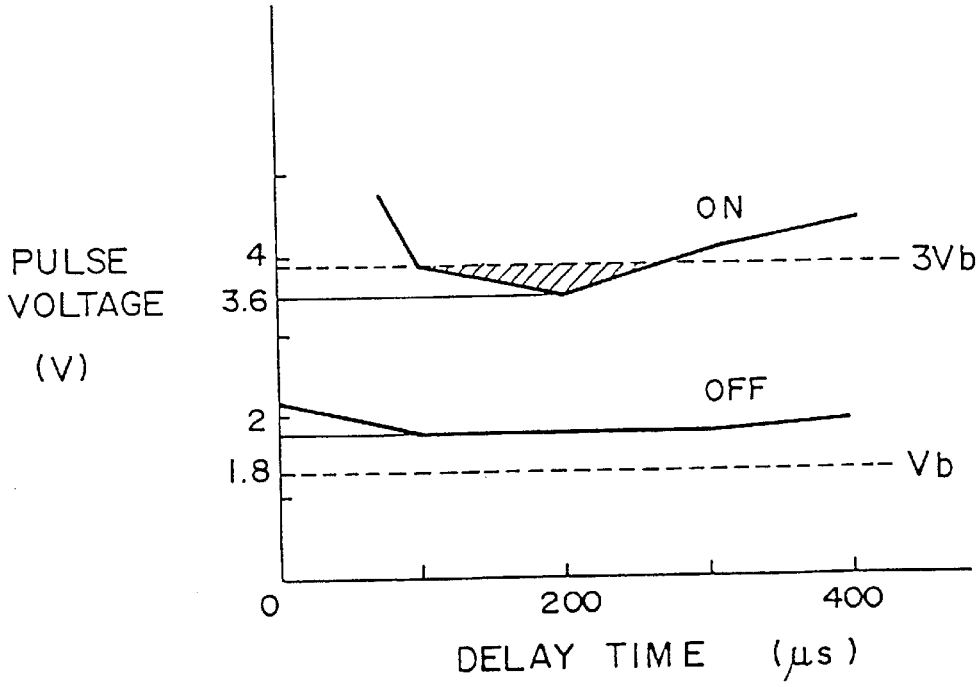
FIG. 7 shows pulse voltage characteristics of the matrix drive waveform of FIG. 6.
Figure 8A:
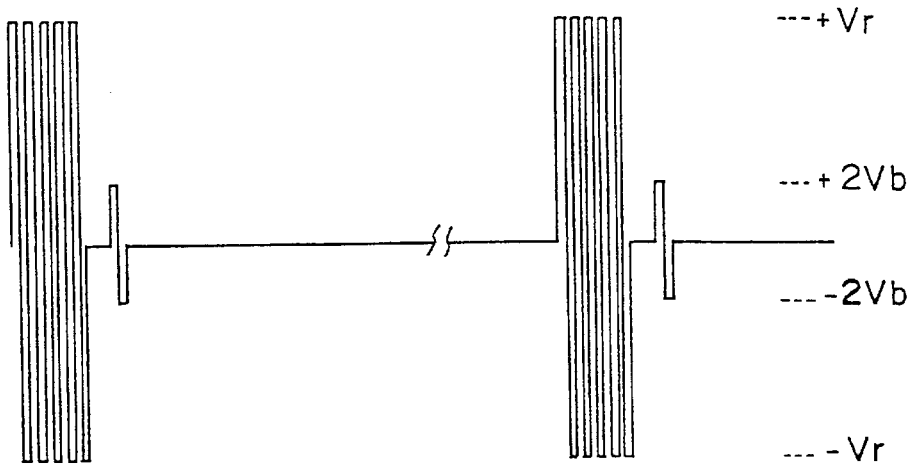
FIGS. 8A to 8D show matrix drive waveforms of row and column electrode signals and a difference signal therebetween, illustrating drive waveforms used in the second embodiment of the present invention.
Figure 8B:
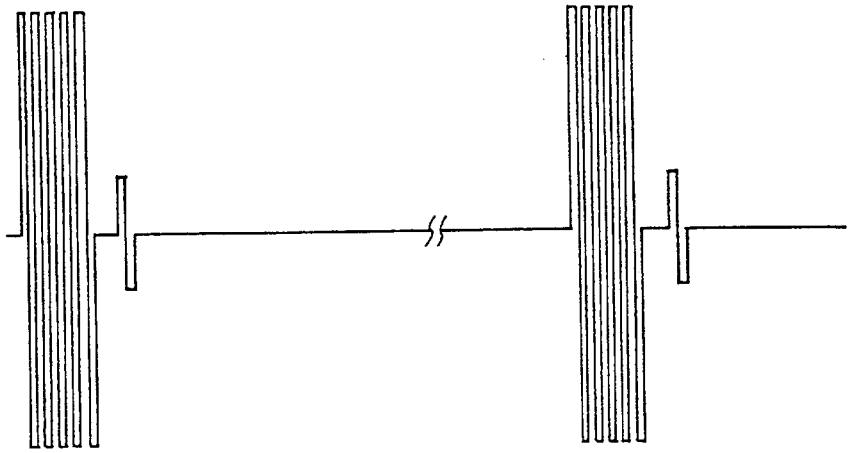
Figure 8C:
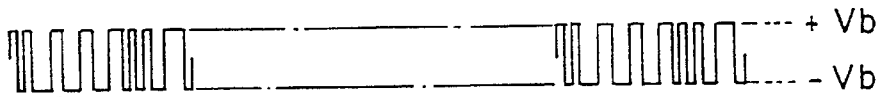
Figure 8D:
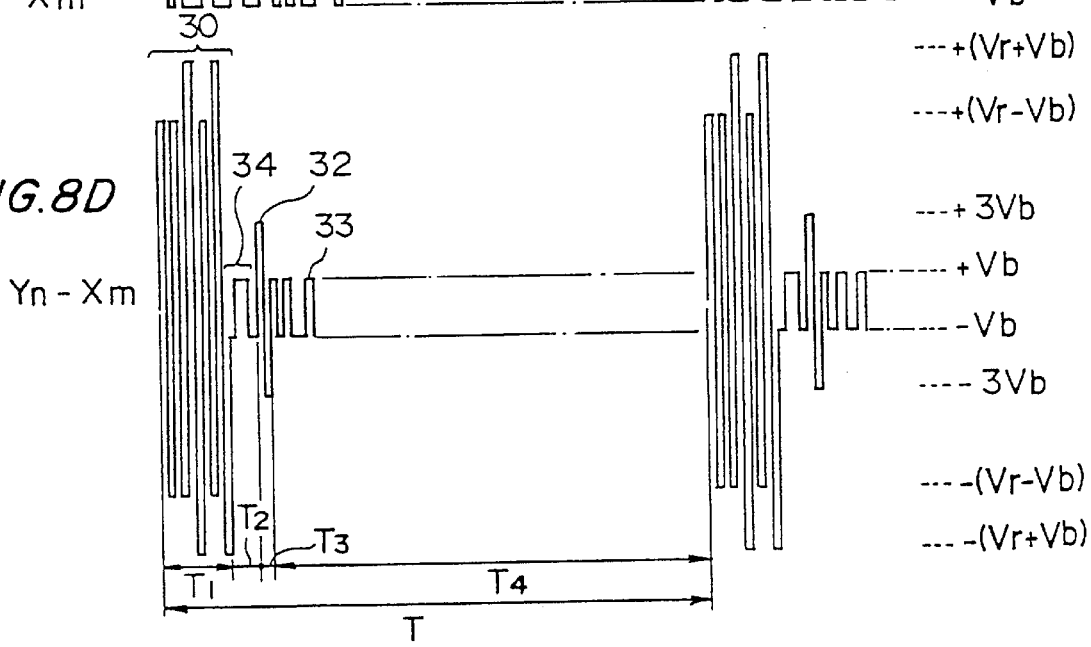

A graph used to obtain the selection voltage range that enables a 0° uniform orientation state and a 360° twist orientation state, using the drive waveform of FIG. 6, is shown in FIG. 7. Delay time is plotted along the X-axis and the voltage of pulses applied to the liquid crystal is plotted along the Y-axis. With a reset voltage of 30 V and a hold time of 1 ms, a bias voltage of 1.3 V, and a pulse width of the selection pulse of 50 μs, which means that the write time for one line is 50×2=100 μs. A liquid crystal cell of the same construction as that of the first embodiment was used, with the ratio of cell gap d to pitch p being 0.6. It can be seen from this graph that a 360° twist orientation state (display is off) can be resisted up to a peak selection voltage of 1.8 V, and that switching of a 0° uniform orientation state (display is on) is achieved by a minimum selection voltage of 3.6 V, when the delay time is 200 μs. As a result, the drive waveform after reset is configured in accordance with a ⅓ bias method, and, if the bias voltage and the OFF voltage during selection are each at Vb=1.3 V and the ON voltage during selection is 3 Vb=3.9 V, drive of a simple matrix of 200 to 240 rows is obtained with a write speed of 100 μs/line. When the drive waveform in accordance with the ⅓ bias method is configured, the delay time can be chosen to be where the ON voltage shown by the solid line in FIG. 7 lies below the ON selection voltage 3 Vb shown by a broken line in FIG. 7 (hatched area in FIG. 7).

The drive waveforms of each row, column, and pixel of the matrix in accordance with the ⅓ bias method are shown in FIGS. 8A–8D. In these figures, Yn and Yn+1 indicate scan signals (row electrode signals) for driving the nth and (n+1)th row electrodes. These scan signals Yn and Yn+1 are set to the reset potential at the peak value ±Vr during reset period T1, to 0 V during delay period T2, to the selection potential at the peak value ±2 Vb during selection period T3, and to the non-selection potential of 0 V during non-selection period T4. Xm indicates the waveform of the data signal supplied to the column electrode of the mth column. The peak value of this data signal is 35 Vb. If the data signal is of the opposite phase to the waveform during selection period T3 of the above described scan signal, the liquid crystal cell is driven on; if it is of the same phase, the liquid crystal cell is driven off. The difference signal Yn-Xm indicates the drive waveform applied to the liquid crystal of the pixel at the intersection between the nth row electrode and the mth column electrode. This difference signal Yn-Xm is at reset voltage 30, which has a maximum peak value of ±(Vr+Vb), during reset period T1, and at bias voltage 34, which has a maximum peak value of ±Vb, during delay period T2. As shown in FIG. 8, this signal is set to a selection voltage 32 for driving the liquid crystal at a peak value of ±3 Vb during selection period T3, then to non-selection voltage 33 at a peak value of ±Vb during non-selection period T4.

By combining the drive waveform of this second embodiment with a divided matrix or multiplexed matrix (refer to p. 406 of the Liquid Crystal Device Handbook, published by the Nikkan Kogyo Shimbun, Ltd.), a 640×480 VGA-compatible display can be implemented.

As described above, by applying a delay pulse after the reset pulse, the first and second embodiments have made it possible to achieve a faster write of 50 μs/line, which is of several times the prior art speed. This means they can be applied to the much sought after matrix displays of 640×400 and 640×480, without having to seek the help of active elements. The basic characteristics of the liquid crystal display device to which the present invention is directed must exceed those of supertwisted nematic (STN): such as a memory capability of several seconds; a contrast ratio in excess of 100; an angle of view from above of 60°, from below of 80°, and to each side of 80°; and a high speed optical response of 8 ms or less. Therefore, in addition to enabling a simple matrix drive, it can contribute immensely to the implementation of an inexpensive, high-quality display device. Although the above description dealt with a transparent type of liquid crystal cell, this method shows promise for a reflective display, provided it can make use of the characteristic of a contrast ratio of 100 or more. Similarly, if it can achieve an optical response of less than 1 ms, the problem of flickering can be avoided, so that the liquid crystal can make use of its memory capability to implement a high-definition display of 1000 lines or more and a write time of 0.1 second or less.

Third Embodiment

Figure 9A:
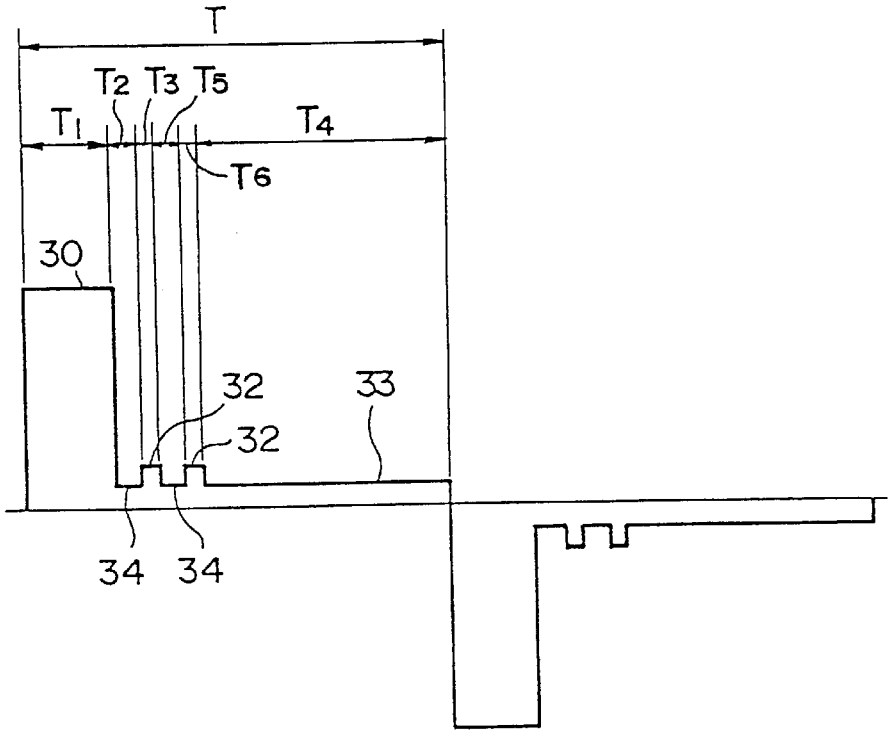
FIGS. 9A–9B show drive waveforms used in a third embodiment.
Figure 9B:
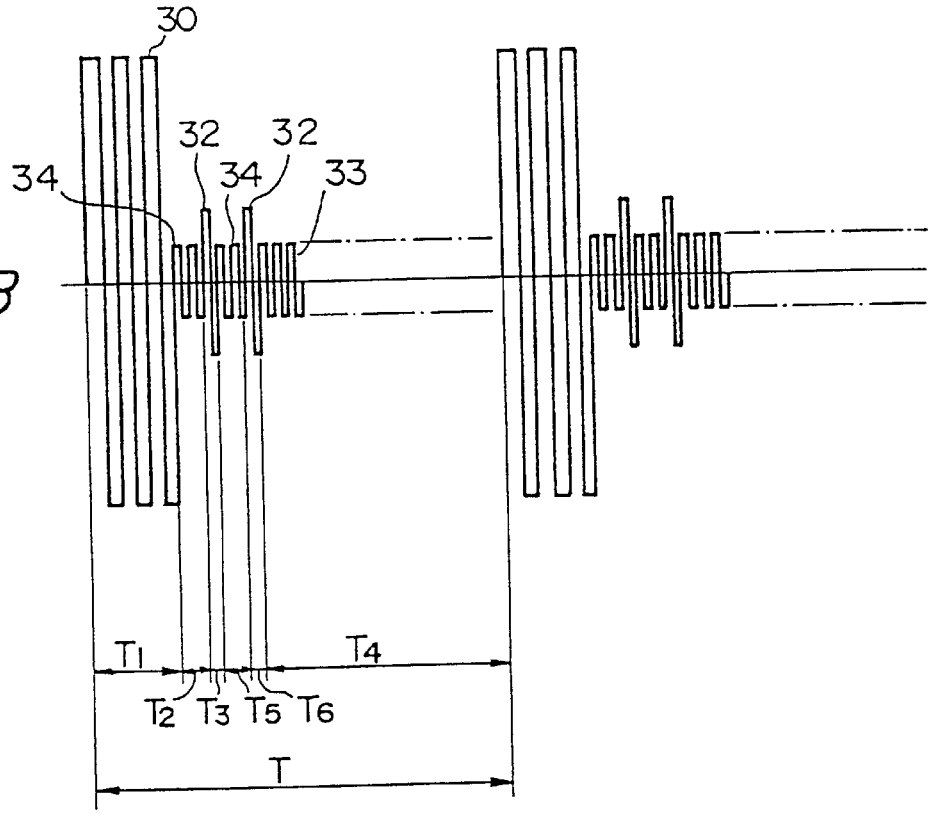
Figure 10A:
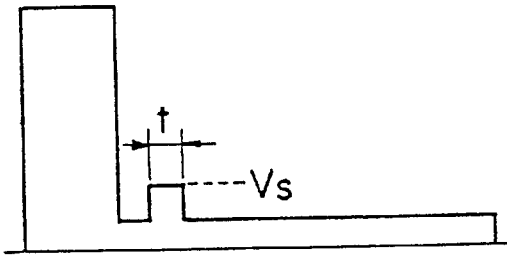
FIGS. 10A–10E show drive waveforms wherein root-mean-squared (RMS) values after the reset pulse turns off are the same.
Figure 10D:
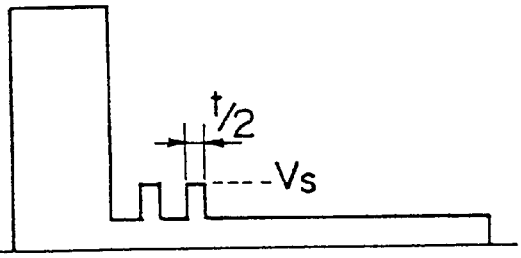
Figure 10B:
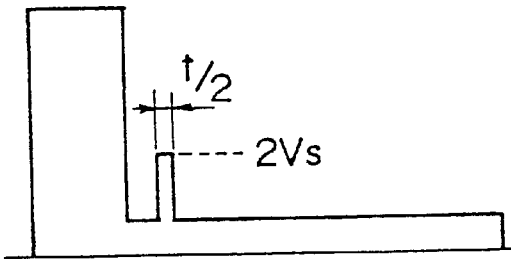
Figure 10E:
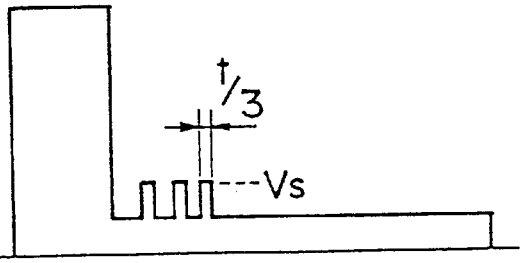
Figure 10C:
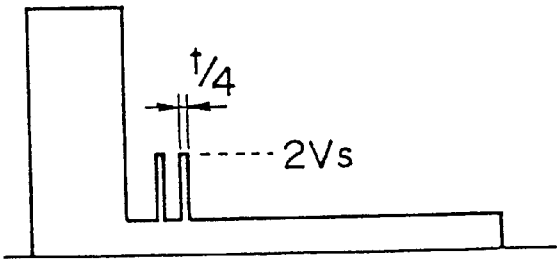
Figure 11A:
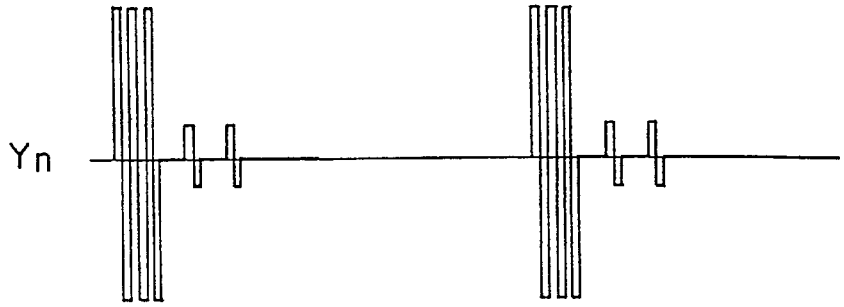
FIGS. 11A–11E show matrix drive waveforms relating to a fourth embodiment that applies the present invention.
Figure 11B:
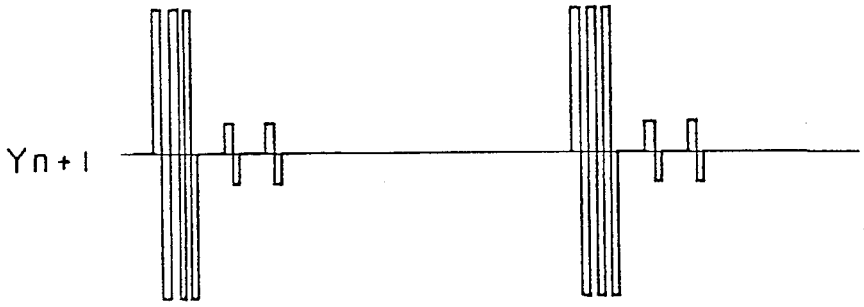
Figure 11C:
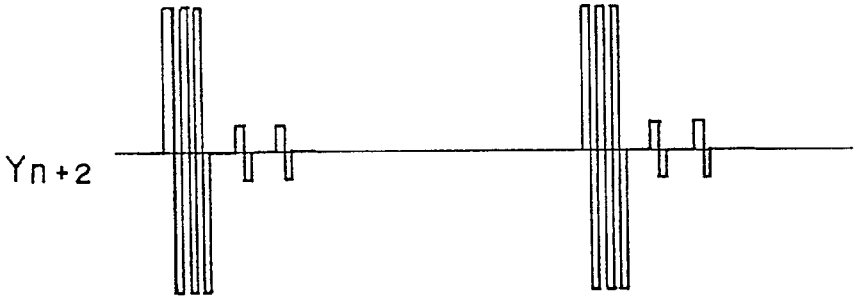
Figure 11D:
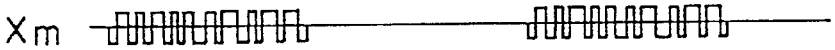
Figure 11E:
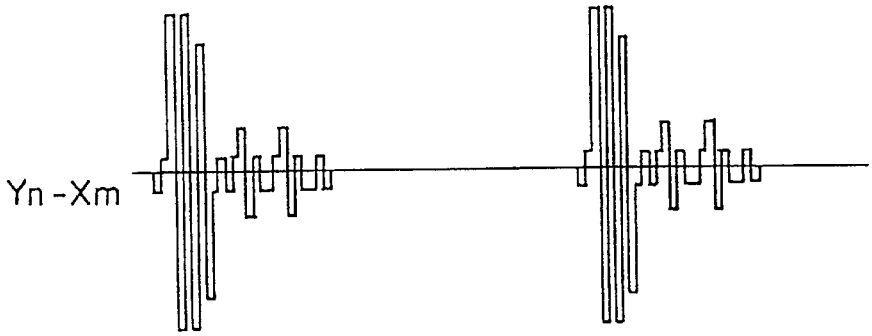

FIGS. 9A–9B show two types of drive waveform relating to a third embodiment used in the drive of the liquid crystal display panel shown in FIG. 1. Each of FIGS. 9A and 9B illustrates an alternating drive method that inverts the polarity of a voltage that causes the liquid crystal cell to be charged, in the same manner as in the above described FIGS. 2A and 2B, either every frame or every line. The drive waveform shown in either FIG. 9A or FIG. 9B differs from the equivalent drive waveform relating to the first embodiment of FIG. 2A or FIG. 2B, when selection period T3 after delay period T2 is defined as a first selection period, in that an interval period T5 and a second selection period T6 are provided between this first selection period T3 and non-selection period T4. If interval period T5 and second selection period T6 are considered to be a pair of periods, this pair of periods can be provided once as shown in the drive waveform of FIG. 9A or FIG. 9B, but the present invention is not limited thereto; this pair of periods could be provided a plurality of times.

In FIG. 9A or FIG. 9B, first and second selection periods T3 and T6 are each set to be of the same length and selection voltage 32 is applied to the liquid crystal cell in each period T3 and T6. From considerations of matrix drive, the same bias voltage 34 at that applied during delay period T2 is applied to the liquid crystal cell during interval period T5.

Results obtained by applying the waveform of FIG. 9A or FIG. 9B are described below. Common conditions were: a reset voltage of ±25 V, a reset time of 1 ms, a delay time of 200 μs, and a bias voltage of ±1.2 V. With these conditions, if two pulses with a pulse width of 150 μs or three pulses with a pulse width of 100 μs were applied, with the ON selection voltage being ±2.4 V, the 0° uniform orientation state was obtained. For an ON selection voltage of ±2.4 V, this is exactly the same as the application of one pulse with a pulse width of 300 μs (as in the drive method of either FIG. 2A or FIG. 2B). The gap between the two pulses (interval period T5) had been expanded to its maximum of 450 μs. Next, when the ON selection voltage was changed to ±3.6 V, two pulses each with a pulse width of 50 μs were found to provide the 0° uniform orientation state. In this case too, with an ON selection voltage of ±3.6 V, this is exactly the same as the application of one pulse with a pulse width of 100 μs (as in the drive method of either FIG. 2A or FIG. 2B). In this case, the gap between the two pulses had been expanded to its maximum of 250 μs.

It is clear from the above that this liquid crystal display has a response effect to cumulative pulses during an extremely short period, so that the selection pulse can be applied to the liquid crystal within 1 ms to 2 ms after the rest pulse has been turned off as a plurality of selection pulses of short pulse width. If this is explained using FIG. 4, the lengths of the first and second selection periods T3 and T6, delay period T2, and interval period T5 could be adjusted in such a manner that final selection period T6 within one frame period is set at a trigger timing after backflow has occurred in the liquid crystal, as shown in FIG. 4. If this is within the 1 to 2 ms period after the reset pulse has been turned off, it is clear that the pulses can be divided into any number of pulses, so long as the total pulse width does not change. During the period in which the cumulative pulse response effect occurs, if the peak voltage of the selection pulses applied to the liquid crystal is set to 2.4 V or 3.6 V, RMS voltages from the reset pulse onward in the former case is 1.67 V and in the latter is 1.88 V. Therefore, it is clear that the RMS voltage can be kept substantially constant if the number of selection pulses and the peak value of the pulse voltage have been changed.

This will now be explained with reference to FIGS. 10A to 10E. In each of FIGS. 10A to 10E, the area calculated from (pulse width×peak voltage) of the selection pulse (or, if there are a plurality of selection pulse, the total area thereof) is made to be the same. Therefore, it is clear that the drive of any of FIGS. 10A to 10E ensures that the RMS voltage applied to the liquid crystal is constant, so long as the above described cumulative pulse response effect occurs. If FIGS. 10A to 10E are compared from the viewpoint of write speed, the drives of FIGS. 10A, 10D, and 10E each provide the same speed, but the drives of FIGS. 10B and 10C can each achieve twice the write speed, enabling higher duty ratios.

Fourth Embodiment

A drive waveform of a fourth embodiment of the present invention which applies the drive method of the third embodiment to the pulse inversion type of alternating drive of matrix display shown in FIG. 5 is shown in FIGS. 11A to 11E. In these figures, Yn, Yn+1, Yn+2 indicate the scan signals supplied to the nth, (n+1)th, and (n+2)th row electrodes, respectively. Each scan signal is provided with a reset period T1, a delay period T2, a first selection period T3, an interval period T5, a second selection period T6, and a non-selection period T4 within one frame period. The lengths of the first and second selection periods T3 and T6 are the same at one horizontal scan period (1 H). The length of interval period T5 is set to be 1 H×m (where m is an integer); in FIG. 11 it is set to be 2 H.

Figure 12:
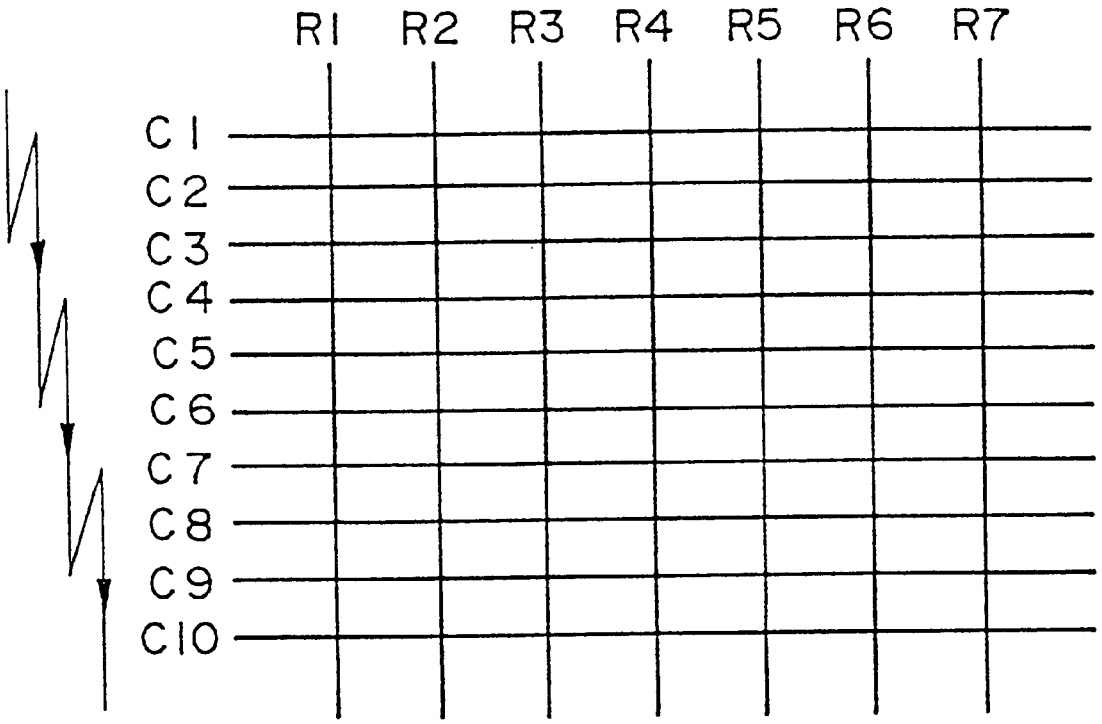
FIG. 12 is a diagram illustrating the scanning sequence of row electrodes when the drive waveforms of FIG. 11 are used.

As can be seen from the matrix display shown in FIG. 12, the row selection in the drive of this embodiment proceeds in the following zigzag sequence of rows: C1, C2, C3, C1, C2, C3, C4, C5, C6, C4, C5, C6 . . . The column data signal (Xm) transfers data at a timing of twice every line, and the voltage of the difference signal Yn-Xm between the row and columns signals is applied to the liquid crystal.

This method has been used to implement a simple matrix drive display with a duty ratio of 1/240 under the following conditions: a reset voltage of the scan signal of ±25 V, a reset period of 1 ms, a delay period of 200+100 μs, a selection voltage of ±2.4 V, a selection period of 50 μs (twice), and a data voltage of the data signal of ±1.2 V. The frame frequency was 42 Hz and no flickering was generating. By combining the above described drive method with a divided matrix or multiplexed matrix drive (refer to p. 406 of the Liquid Crystal Device Handbook, published by Nikkan Kogyo Shimbun, Ltd.), it is possible to provide a 640×480 VGA-compatible display.

As described above, by applying a selection pulse to the liquid crystal at least twice after a reset pulse, the third and fourth embodiments not only make it possible to shorten the write time of a simple matrix drive, they also implement a flickerless, high duty ratio, simple matrix drive. At the same time, these embodiments are linked to a reduction in power consumption by a lowering of the drive voltage.

Figure 13:
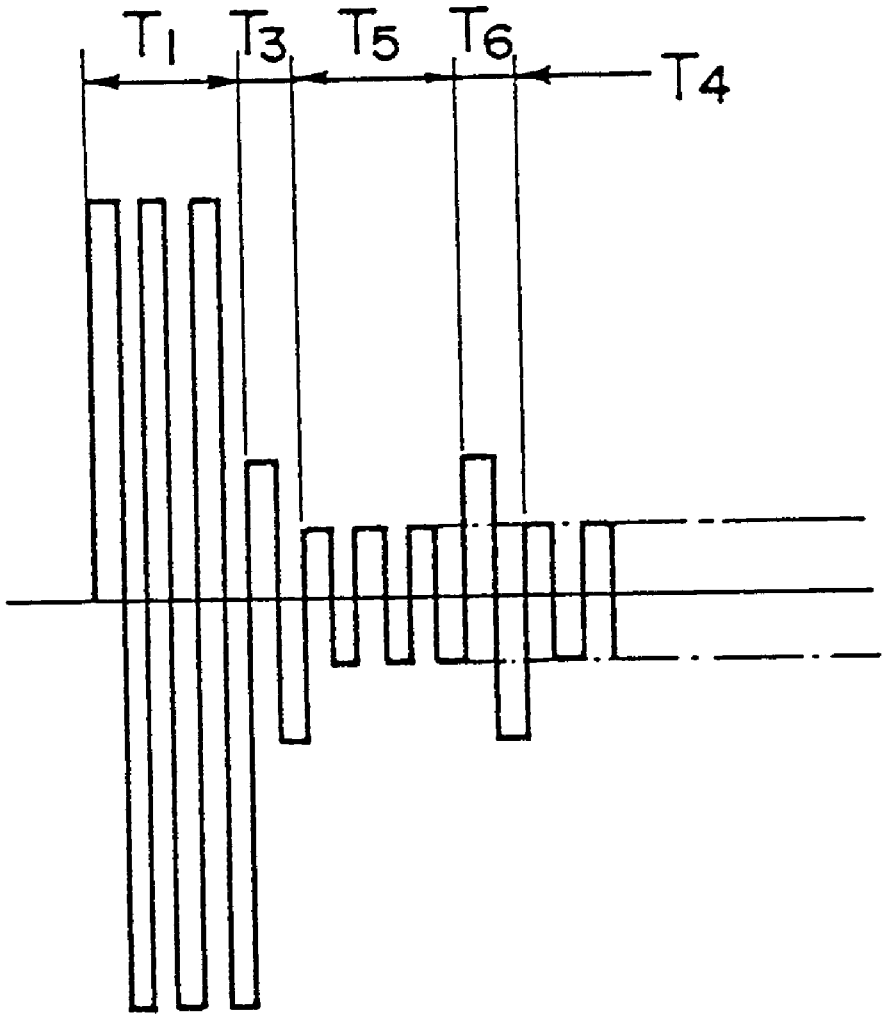
FIG. 13 shows the matrix drive waveform when the fourth embodiment is applied to the drive waveform of FIG. 3.

Note that cumulative pulse response effect when a selection pulse is applied a plurality of times to the liquid crystal is not necessarily limited to a case in which delay period T2 is set after reset period T1, as specified by the above described third and fourth embodiments. The first selection period T3 could be set immediately after reset period T1, and a pair of periods comprising interval period T5 and second selection period T6 can be provided once or a plurality of times between the first selection period T3 and non-selection period T4, as shown in FIG. 13. In this case, the lengths of the first and second selection periods T3 and T6, and that of interval period T5 could be adjusted in such a manner that final selection period T6 within one frame period T is set at a trigger timing after backflow has occurred in the liquid crystal, as shown in FIG. 4.

Fifth Embodiment

Figure 14A:
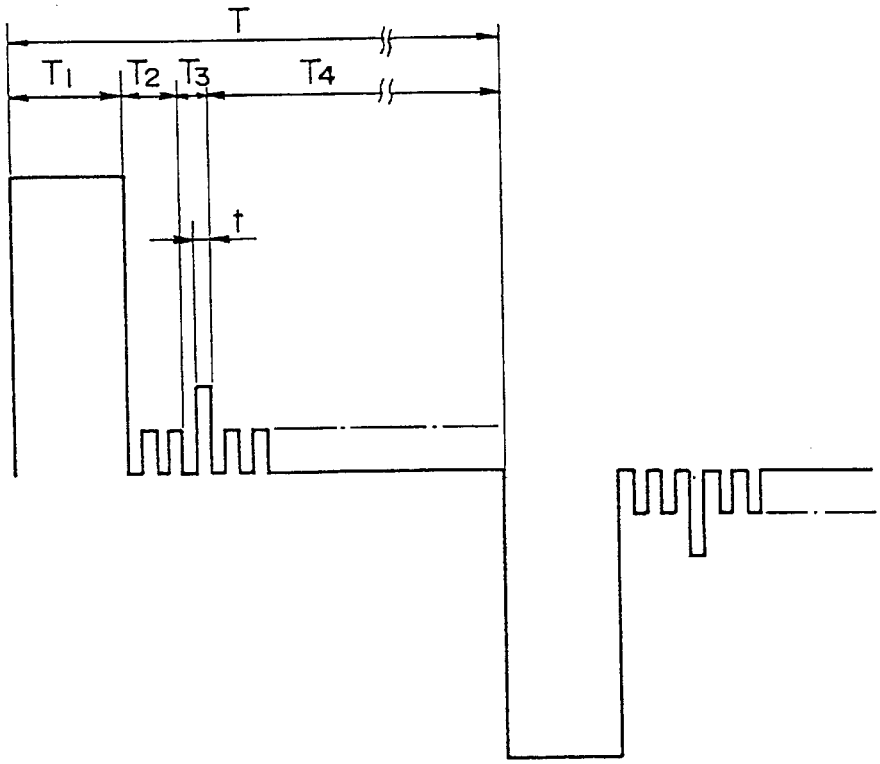
FIGS. 14A–14B each show a drive waveform used in a fifth embodiment of the present invention.
Figure 14B:
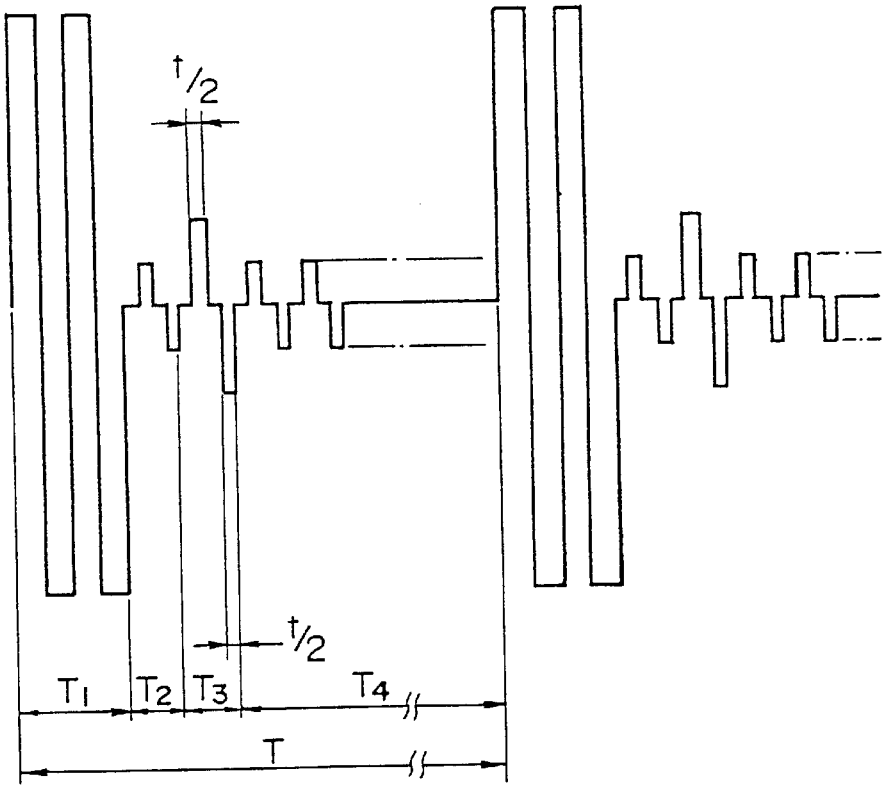

FIGS. 14A–14B show two types of drive waveform relating to a fifth embodiment used in the drive of the liquid crystal display panel shown in FIG. 1. FIG. 14A shows a drive waveform in which the voltage applied to the liquid crystal undergoes a polarity inversion every frame; FIG. 14B shows one in which the polarity of the voltage applied to the liquid crystal is inverted at each pulse. The drive waveform of each of these figures is similar to those of the first embodiment in that each frame T includes reset period T1, delay period T2, selection period T3, and non-selection period T4, but differs therefrom in that the duty ratio of the application period t (in FIG. 14B, t=2×t/2) of the ON or OFF selection voltages with respect to selection period T3 is set to be less than 100%.

Figure 15:
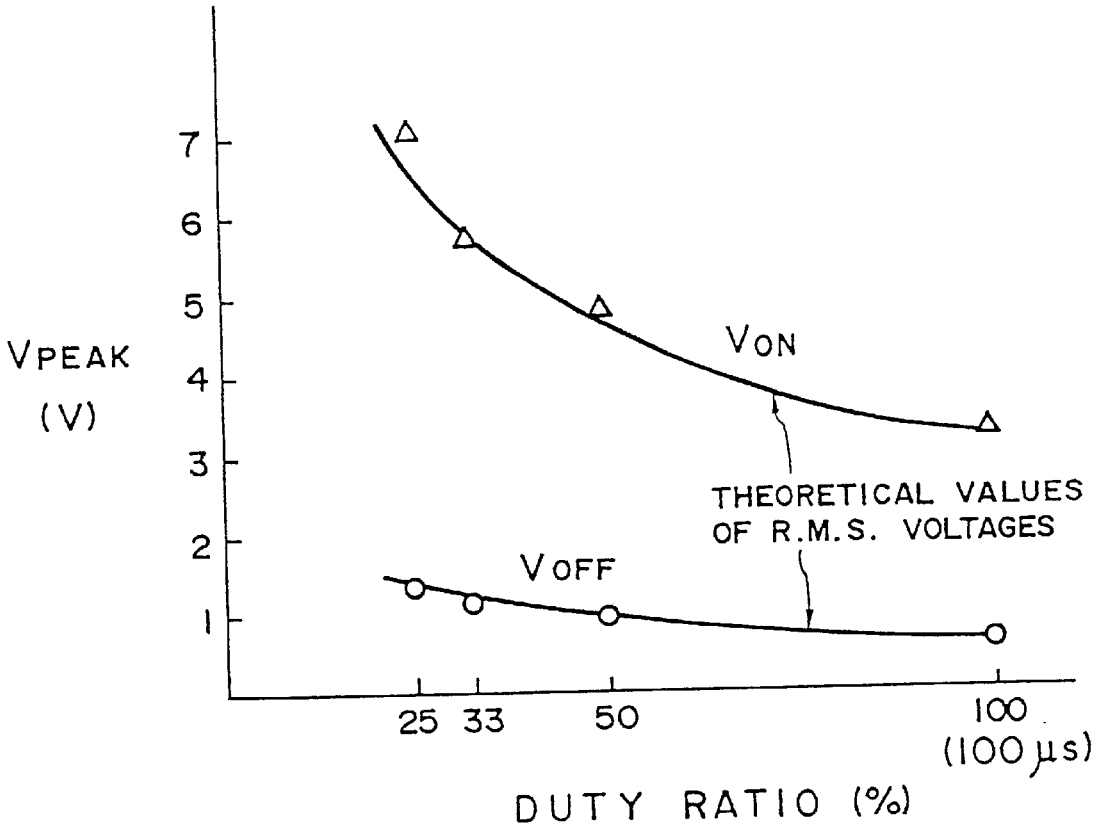
FIG. 15 shows the drive voltage characteristics that occur when the waveform of FIG. 14A
Figure 16A:
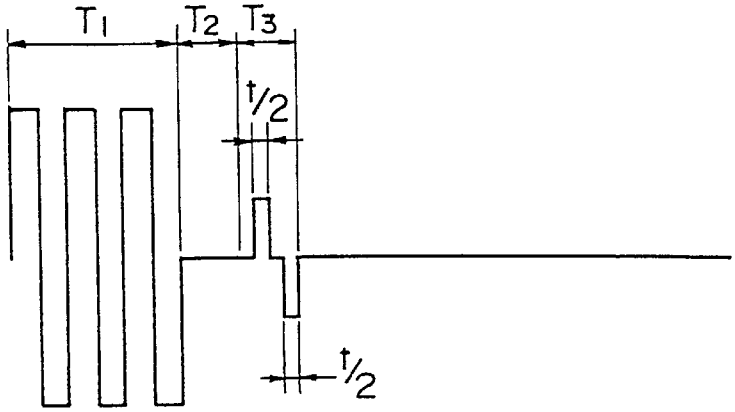
FIGS. 16A–16E show matrix drive waveforms relating to a sixth embodiment of the present invention.
Figure 16B:
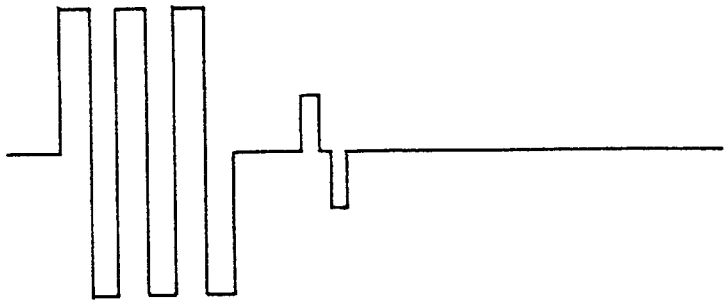
Figure 16C:
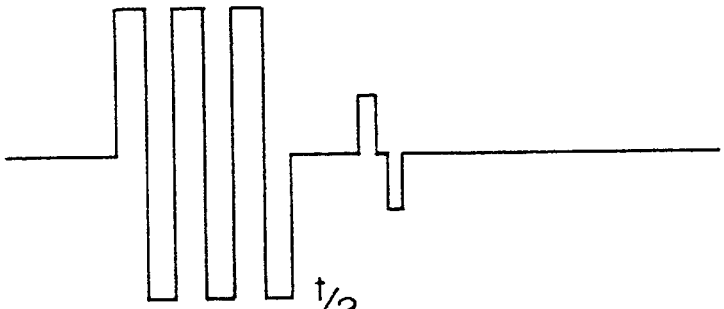
Figure 16D:
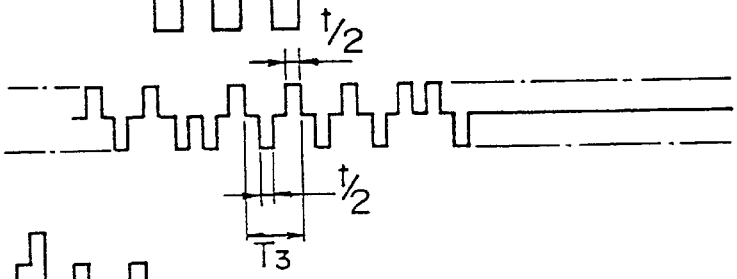
Figure 16E:
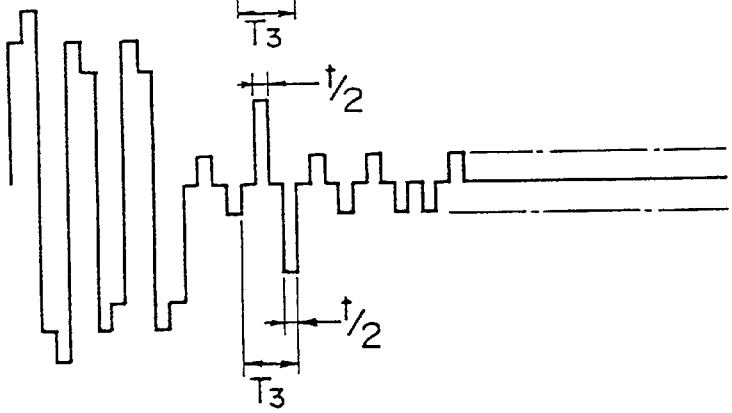
Figure 17A:
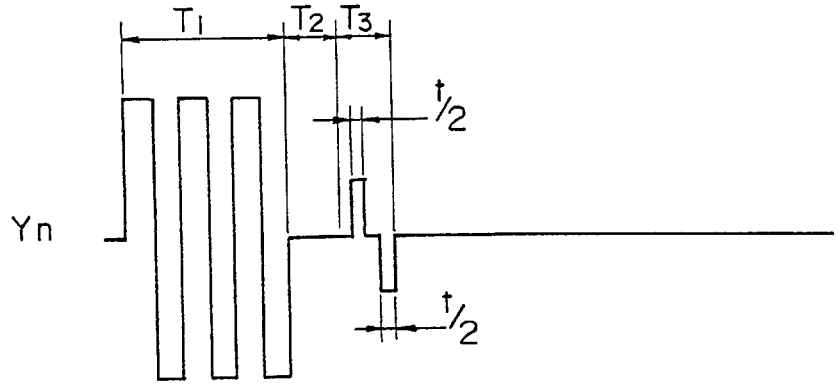
FIGS. 17A–17E show matrix drive waveforms relating to a seventh embodiment of the present invention.
Figure 17B:
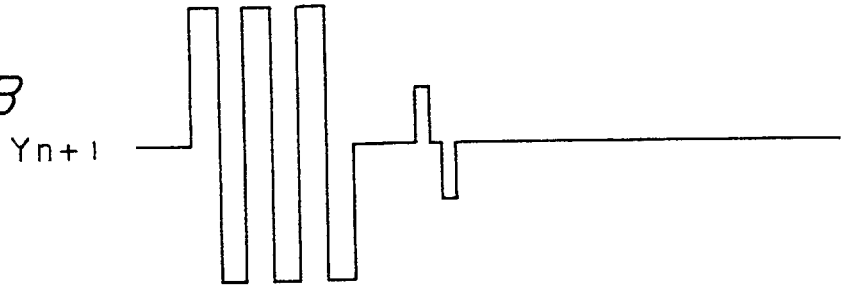
Figure 17C:
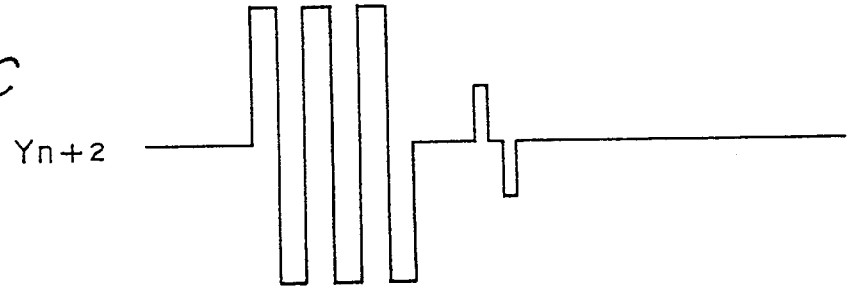
Figure 17D:
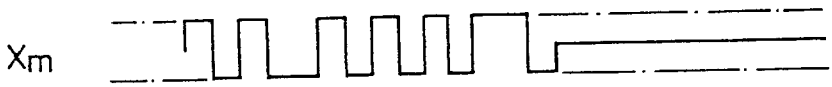
Figure 17E:
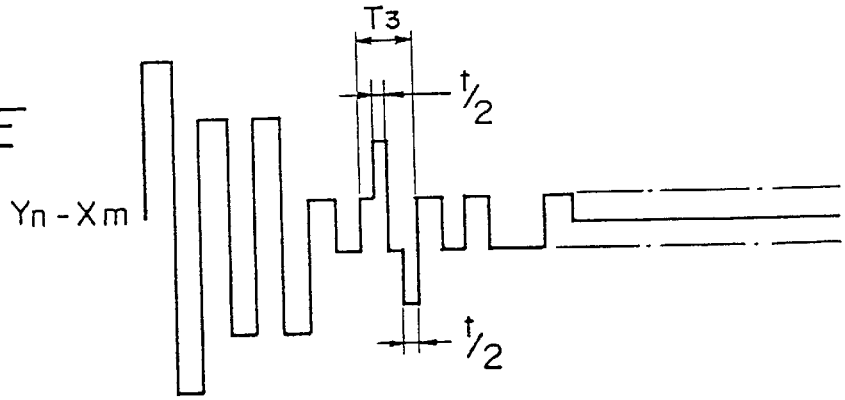

Results of applying the waveform of either FIG. 14A or FIG. 14B are shown in FIG. 15. Drive conditions in this case were a reset voltage of 20 V, a reset time of 1 ms, and a delay time of 150 to 200 μs. In this graph, the duty ratio of application pulse width t with respect to selection period T3 is plotted along the X-axis. Peak voltage when the application pulse is on (0° uniform orientation state) or off (360° twist orientation state) is plotted along the Y-axis. As the pulse duty ratio of the applied voltage is reduced from 50% to 33% and then to 25%, the peak voltage rises by root two, root three, and two. Therefore, this embodiment has the characteristic that the RMS value calculated within selection period T3 is always uniform. The ratio of the ON voltage to the OFF voltage is one characteristic that does not change, no matter how the duty ratio changes. The ratio is approximately five for the liquid crystal used for the measurement of FIG. 15.

Figure 49:
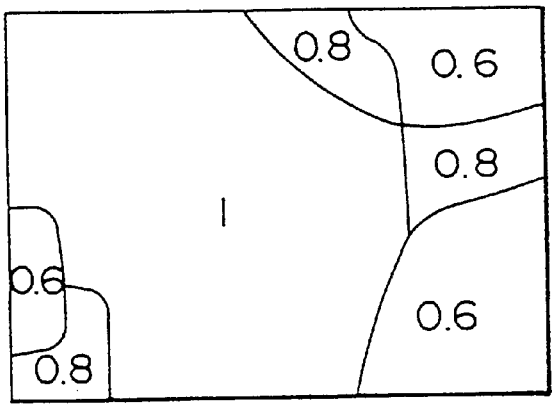
FIG. 49 shows a typical distribution of threshold value of the liquid crystal within a liquid crystal panel.

It is clear from the above that with the present liquid crystal display device drive, the same display effect can be obtained if the RMS voltage within selection period T3 alone remains unchanged, even if the duty ratio of the total pulse width t of the selection pulse(s) with respect to selection period T3 is varied. It is also clear that reducing the duty ratio in this manner increases the peak voltage value of the selection pulse, which can be used to achieve the objective of an easier drive voltage accuracy of the circuitry. In addition, it is clear that if the duty ratio of the pulse is varied with the drive voltage kept constant, the display effect can be changed by achieving changes in the RMS value. In other words, varying the duty ratio can compensate for subtle differences in drive voltage attributed to irregularities in the threshold value of the liquid crystal within the display panel, as shown in FIG. 49. In addition, since the threshold value of the liquid crystal is also affected by variations in temperature, this embodiment can also provide temperature compensation by varying the duty ratio appropriately.

Sixth Embodiment

FIGS. 16A to 16E show matrix drive waveforms relating to a sixth embodiment that applies the drive waveform of FIG. 14B to the alternating drive of a matrix display. In these figures, Yn, Yn+1, Yn+2 indicate the scan signals supplied to the nth, (n+1)th, and (n+2)th row electrodes, respectively. The duty ratio of the total application period t (=2×t/2) of the ON or OFF selection voltages with respect to selection period T3 of each scan signal is set to less than 100%. Xm indicates the data signal supplied to the mth column electrode. The duty ratio of the total period t of the data potential of this data signal Xm with respect to selection period T3 is set to less than 100%, in the same manner as with the scan signal. The difference signal Yn-Xm between the scan and data signals is applied to the liquid crystal. With the difference signal Yn-Xm too, the duty ratio of the application period t of the ON or OFF selection voltages with respect to selection period T3 is set to be less than 100%. Therefore, both the selection voltage and the bias voltage are applied to the liquid crystal as intermittent pulses of duty ratio less than 100%.

The inventors of the present invention have used this method to implement a simple matrix drive display using a ⅕ bias method of duty ratio 1/240 under the following conditions: a reset voltage of ±25 V, a reset period of 1 ms, a delay period of 200 μs, a selection period of 100 μs, a pulse selection time of 25 μs×2 (duty ratio 50%), a selection voltage of ±4 V, and a data voltage of ±1 V. The frame frequency was 42 Hz and no flickering was generated. By combining the above described drive method with a divided matrix or multiplexed matrix drive (refer to p. 406 of the Liquid Crystal Device Handbook, Nikkan Kogyo Shimbun, Ltd.), it is possible to provide a 640×480 VGA-compatible display.

Seventh Embodiment

FIGS. 17A–17E show another practical example of application to a matrix display of the present invention. In these figures, scan signals Yn, Yn+1, and Yn+2 each have the same waveforms as the corresponding waveforms in FIG. 16. Data signal Xm shown in FIG. 17 differs from the corresponding one of FIG. 16 in that the duty ratio of the pulse width of the data potential with respect to selection period T3 is set to 100%. The voltage of difference signal Yn-Xm is applied to the liquid crystal, but, with this difference signal Yn-Xm, the duty ratio of the application period t of the ON or OFF selection voltages with respect to selection period T3 is set to less than 100%. However, in this embodiment, the bias voltage is applied to the liquid crystal without interruptions, and the selection pulse has a pulse duty ratio of less than 100%.

Figure 18:
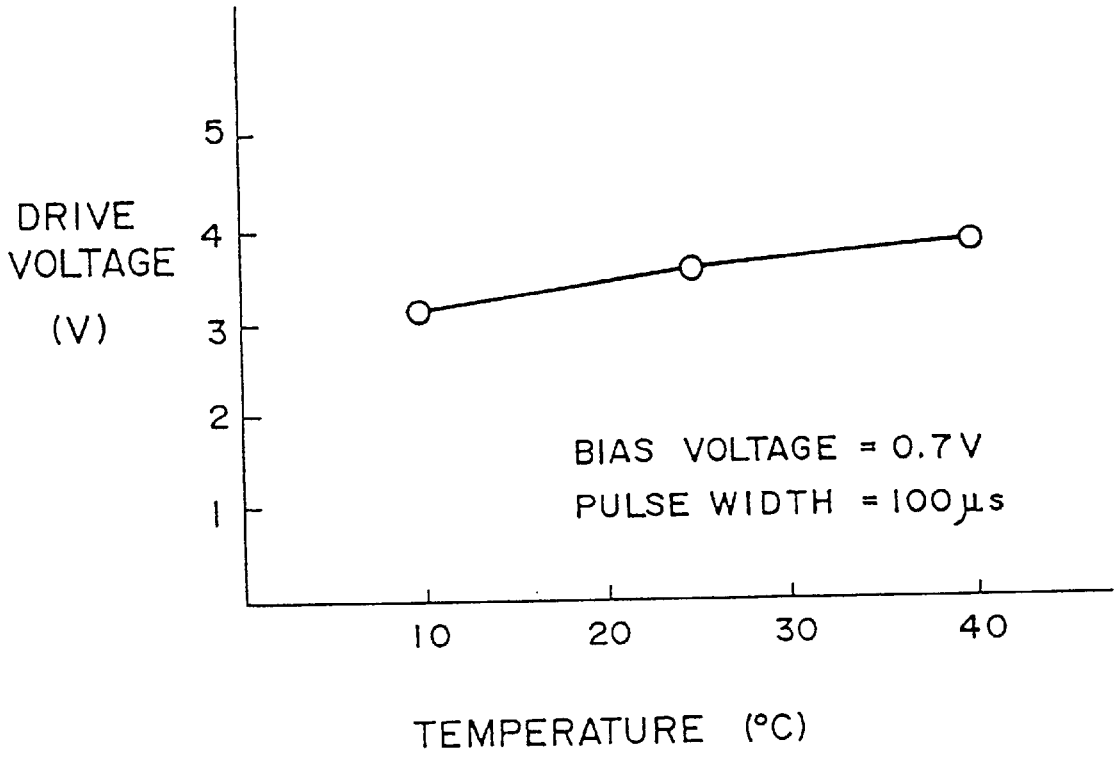
FIG. 18 shows the temperature variation characteristics of the drive voltage that occur when the drive waveforms of FIG. 17 are used.
Figures 19A, 19B, 19C, 19D, 19E:
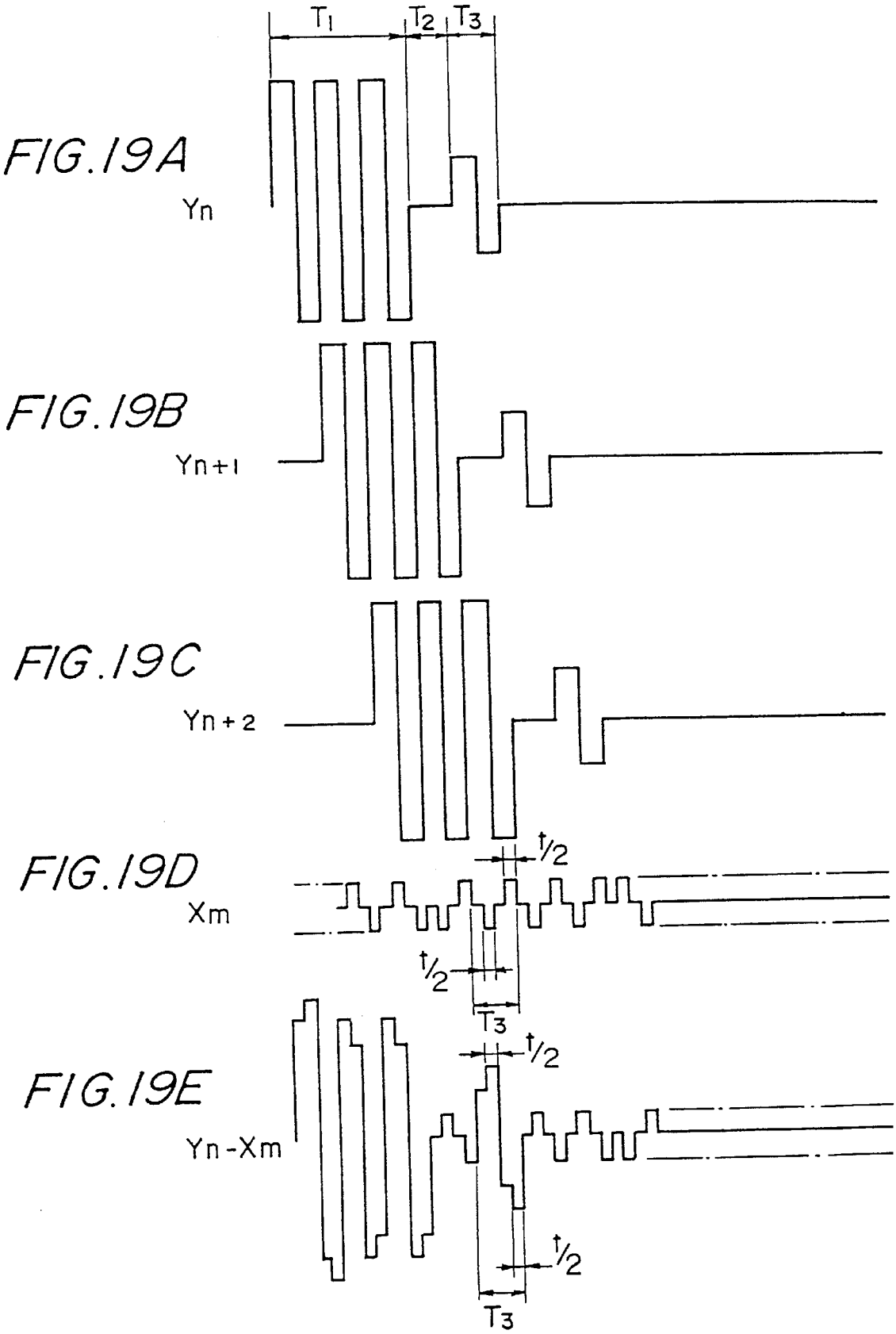
FIGS. 19A–19E show matrix drive waveforms relating to an eighth embodiment of the present invention.

This method has been used to implement a simple matrix drive display using a ⅕ bias method of duty ratio 1/240 under the following conditions at an ambient temperature of 40° C.: a reset voltage of ±25 V, a reset period of 1 ms, a delay period of a 200 μs, a selection period of 100 μs, a pulse selection time of 50 μs×2 (duty ratio 100%), a selection voltage of ±4 V, and a data voltage of ±1 V. In this case too, the frame frequency was 42 Hz and no flickering was generated. It was then verified that, if the duty ratio of the pulse width of the selection pulse with respect to selection period T3 was varied from 100% to approximately 74%, the RMS voltage changed from 5 V to 4.3 V, enabling temperature compensation from 40 to 5° C., as shown in FIG. 18.

Eighth Embodiment

A further example of the application of the present invention to a matrix display is shown in FIGS. 19A to 19E. With each of the scan signals Yn, Yn+1, and Yn+2 shown in these figures, the duty ratio of the pulse width of the ON selection potential or OFF selection potential with respect to selection period T3 is set to 100%. In contrast, the duty ratio of the pulse width t of the data potential of the data signal Xm with respect to selection period T3 is set to less than 100%. The resultant difference signal Yn-Xm is applied to the liquid crystal, and, in this difference signal Yn-Xm too, the duty ratio of the application period t of the ON or OFF selection voltages with respect to selection period T3 is set to less than 100%. It is difficult to say that this method has much effect, because the ratio of ON/OFF voltages applied to the liquid crystal is small, but if a 1/2 bias method is used, it is effective since the ON and OFF waveforms are the same as those of the third embodiment and the bias voltage is applied intermittently.

Ninth Embodiment

Figure 20:
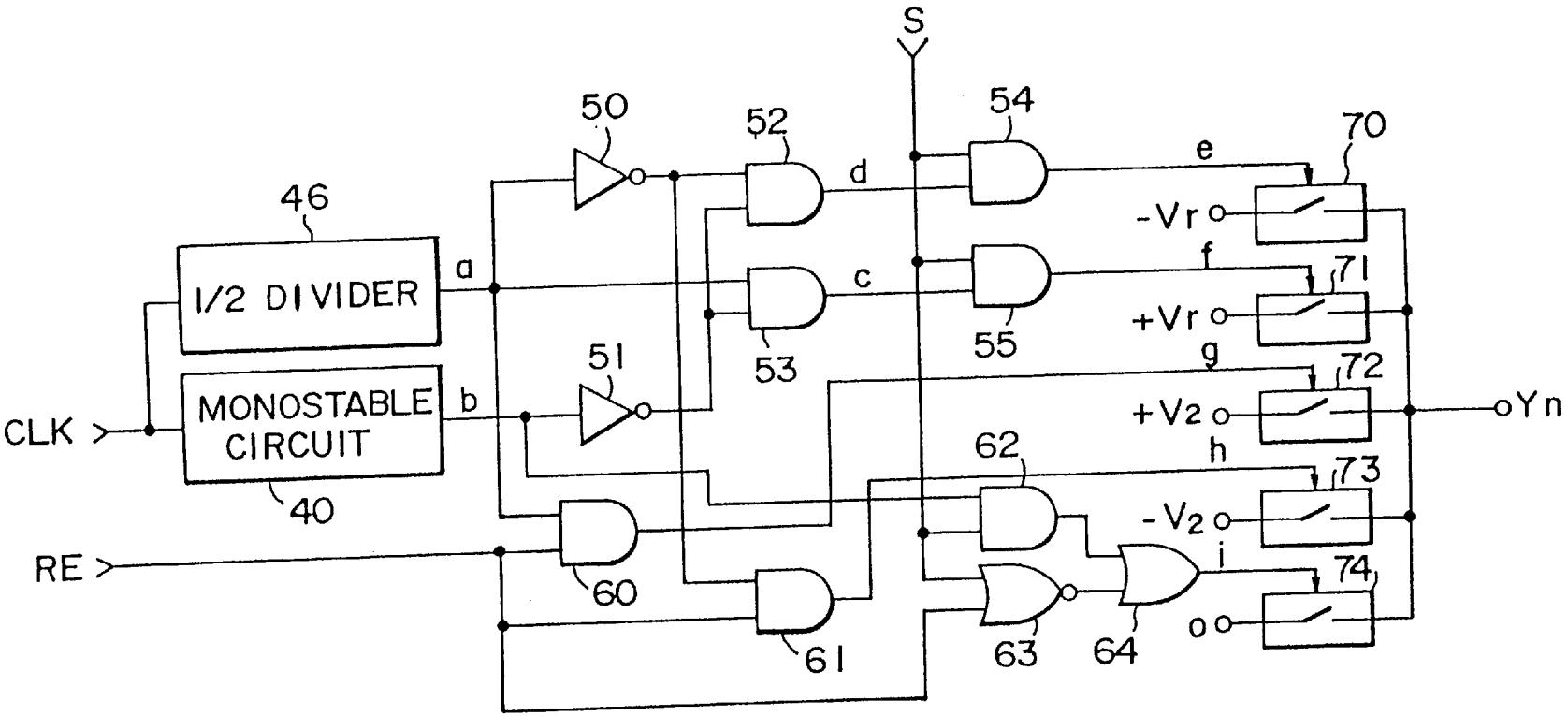
FIG. 20 is a block diagram of the drive circuitry of a ninth embodiment of the present invention that can vary the duty ratio of the selection pulse width with respect to the selection period.
Figure 21:
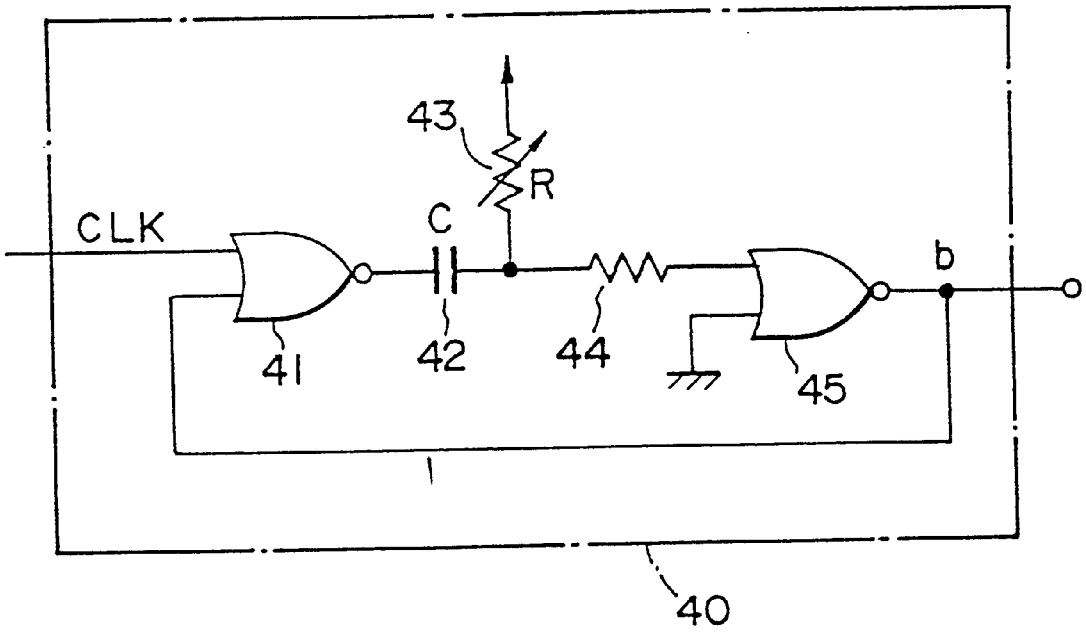
FIG. 21 is a detail of the monostable circuit of FIG. 20.
Figure 22:
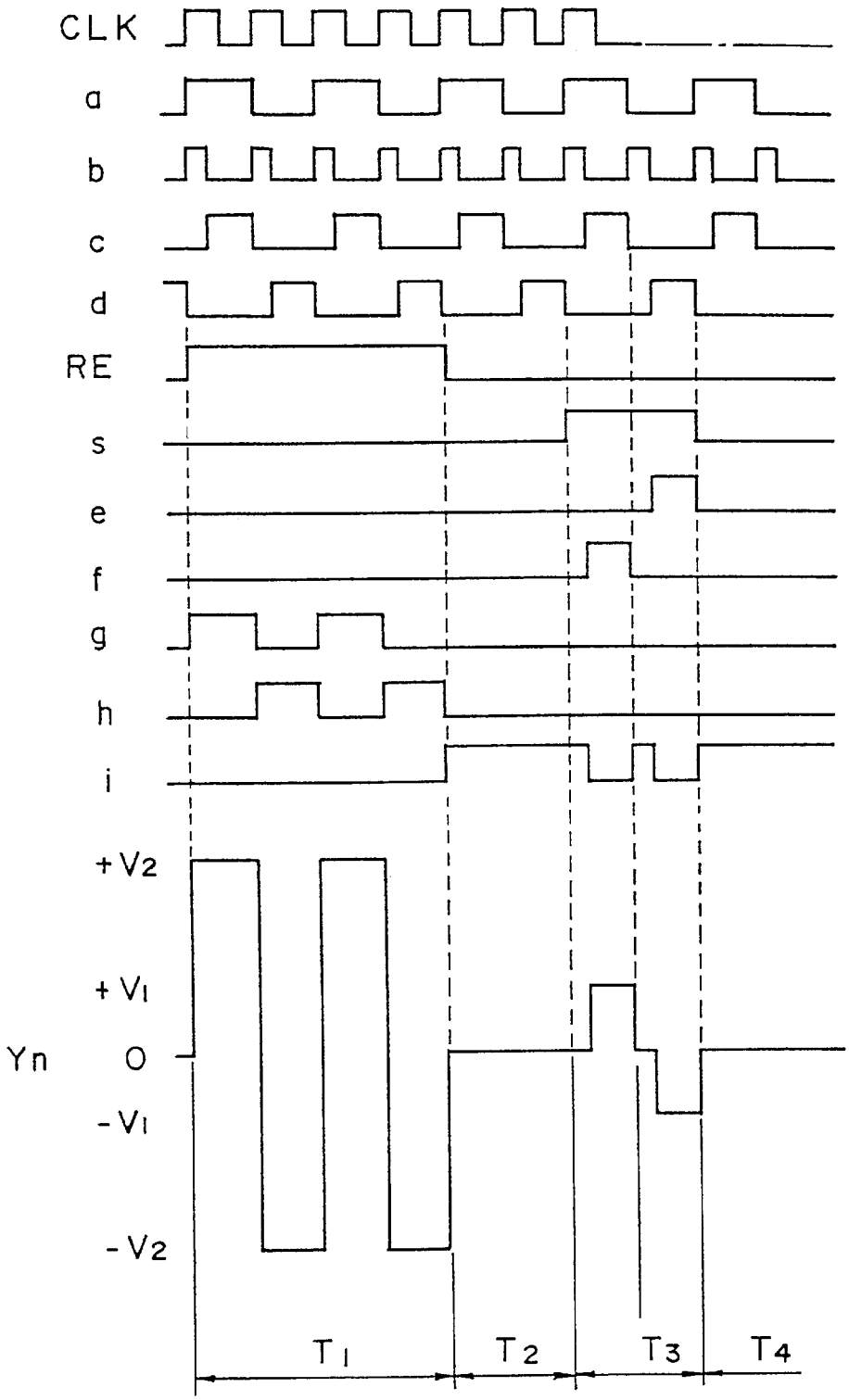
FIG. 22 is a timing chart of the drive circuitry of FIG. 20.

A circuit that can vary the duty ratio of the pulse width of the selection pulse with respect to selection period T3, and its operation, is described with reference to FIGS. 20–22. FIG. 20 shows a circuit that outputs a scan signal Yn having the various potentials shown in FIG. 22, based on a clock signal CLK, a reset signal RE, and a select signal S. FIG. 22 shows scan signal Yn has potentials of ±V2 during reset period T1, potentials of ±V1 as selection pulses during selection period T3, and a potential of 0 V in all other periods. To shape scan signal Yn waveform, the scan signal drive circuitry shown in FIG. 20 has a first analog switch 70 that switches over to a potential of −V1, a second analog switch 71 that switches over to a potential of +V1, a third analog switch 72 that switches over to a potential of +V2, a fourth analog switch 73 that switches over to a potential of −V2, and a fifth analog switch 74 that switches over to a potential of 0 V. A monostable circuit 40, a ½ divider 46, and various logic gates 50–55 and 60–64 are used to drive these analog switches 70–74 in a switching manner.

Monostable circuit 40 receives as inputs the reference clock CLK and generates a signal _b_ that is high for a period of time proportional to a time constant CR of its circuitry. Monostable circuit 40 has, as shown in FIG. 21, a first NOR circuit 41, a capacitor 42, a variable resistor 43, a resistor 44, and a second NOR circuit 45. The time constant of monostable circuit 40 is determined by the capacitance C of capacitor 42 and the resistance R of variable resistor 43, so that it is possible to vary the duty ratio of the pulse width of the selection pulse with respect with selection period T3 of scan signal Yn by varying the resistance R of variable resistor 43, as described below.

The ½ divider 46 receives as inputs the reference clock CLK and generates a signal _a_ of half the frequency of the reference clock CLK, or rather of twice the period thereof.

A first AND circuit 52 receives as inputs signals that are the above described signals _a_ and _b_ after being inverted by first and second inverters 50, 51, and generates a signal $_{13}$ d_ shown in FIG. 22. A third AND circuit 54 receives as inputs the signal $_{13}$ d_ and the select signal S, and generates a signal $_{13}$ e_ that switches over first analog switch 70. Signal $_{13}$ e_ is high throughout a period corresponding to the pulse width of the selection pulse when it has negative polarity within selection period T3 of scan signal Yn, as shown in FIG. 22.

A second AND circuit 53 receives as inputs the signal $_{13}$ a_ and a signal that is the signal $_{13}$ b_ after being inverted by second inverter 51, and generates a signal $_{13}$ c_ shown in FIG. 22. A fourth AND circuit 55 receives as inputs the signal $_{13}$ c_ and select signal S, and generates a signal _f_ for switching second analog switch 71. Signal $_{13}$ f_ is high throughout a period corresponding to the pulse width of the selection pulse when it has positive polarity within selection period T3 of scan signal Yn, as shown in FIG. 22.

Signals $_{13}$ e_ and $_{13}$ f_ used to drive first and second analog switches 70, 71 determine the duty ratio of the pulse width of the selection pulse with respect to selection period T3 of scan signal Yn. The pulse width of each of these signals $_{13}$ e_ and $_{13}$ f_ is determined based on the signal $_{13}$ b_ from monostable circuit 40, and thus it is clear that, by varying the time constant CR of monostable circuit 40, the duty ratio of the pulse width of the selection pulse with respect to selection period T3 of scan signal Yn can be varied.

Signals $_{13}$ g_ to _i_ that drive third to fifth analog switches 72 to 74 to switch the potential of the scan signal outside of the selection pulse are now described. Signal $_{13}$ g_ that is used to switch over third analog switch 72 is generated by a fifth AND circuit 60 that receives as inputs the signal $_{13}$ a_ and reset signal RE. Signal $_{13}$ g_ is high throughout periods corresponding to periods during which the reset potential has positive polarity at +V2 within reset period T1 of scan signal Yn, as shown in FIG. 22.

Signal $_{13}$ h_ that is used to switch over fourth analog switch 73 is generated by a sixth AND circuit 61 that receives as inputs reset signal RE and a signal that is the signal _a_ after being inverted by first inverter 50. Signal _h_ is high, throughout periods corresponding to periods during which the reset potential has, negative polarity at −V2 within reset period T1 of scan signal Yn, as shown in FIG. 22. Signal _i_ that is used to switch fifth analog switch 74 is generated by sixth AND circuit 61, a seventh AND circuit 62, a third NOR circuit 63, and an OR circuit 64, based on signal $_{13}$ b_, reset signal RE, and select signal S. Signal _i_ is high throughout periods corresponding to periods of scan signal Yn during which the selection pulse is not output within delay period T2, non-selection period T4, and selection period T3, as shown in FIG. 22.

Tenth Embodiment

The tenth embodiment of the present invention differs in that the varying of the duty ratio is done in a digital manner from the ninth embodiment in which the duty ratio is changed in a continuous manner by varying the resistance R. A block diagram of a circuit that outputs signals t1 and t2 used for determining the pulse width of positive and negative selection pulses within selection period T3 of scan signal Yn is shown in FIG. 23, and a timing chart of this circuit is shown in FIG. 24.

Figure 23:
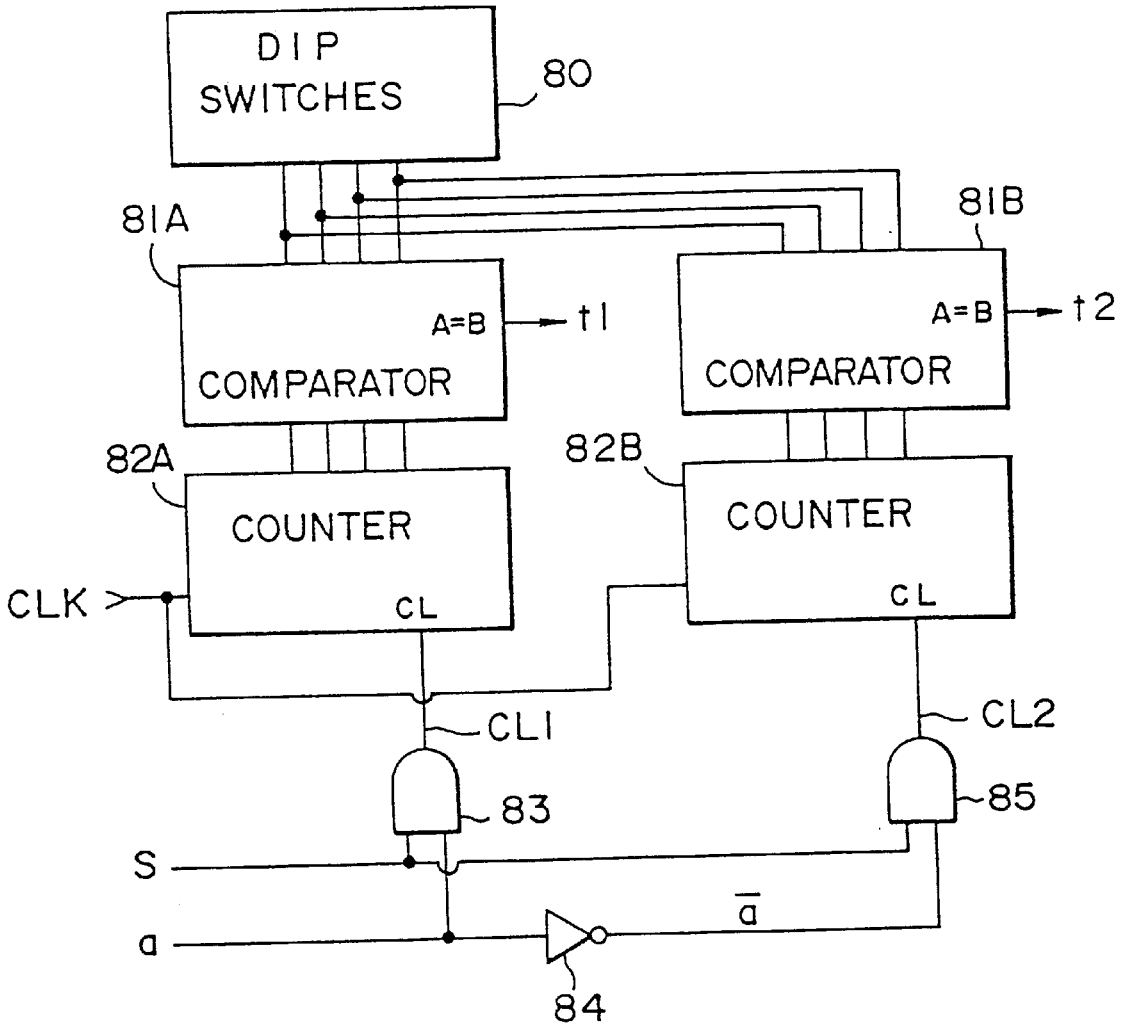
FIG. 23 is a block diagram of the drive circuitry of a tenth embodiment of the present invention that can vary the duty ratio of the selection pulse width with respect to the selection period.

In FIG. 23, DIP switches 80, first and second magnitude comparators 81A, 81B, and first and second counters 82A, 82B are provided as the circuitry that generates signals t1 and t2. The pulse width that makes signals t1 and t2 high is set, e.g., by binary DIP switches 80. DIP switches 80 are connected to first and second magnitude comparators 81A, 81B which could, be 4-bit comparators. First and second counters 82A, 82B count reference clock CLK, as shown in FIG. 24. When a setting A set by DIP switches 80 matches a count B from first and second counters 82A, 82B, each of first and second magnitude comparators 81A, 81B changes the state of an A=B pin thereof to high. Signals CL1 and CL2 shown in FIG. 24 are input to clear pins CL of first and second counters 82A, 82B. Signal CL1 is output from an AND circuit 83 that receives as inputs select signal S and signal _a_. Signal CL2 is output by an AND circuit 85 that receives as inputs select signal S and a signal that is the signal $_{13}$ a_ after being inverted by an inverter 84. Thus, first and second counters 82A, 82B are designed to be cleared by signals CL1 and CL2 going high.

Figure 24:
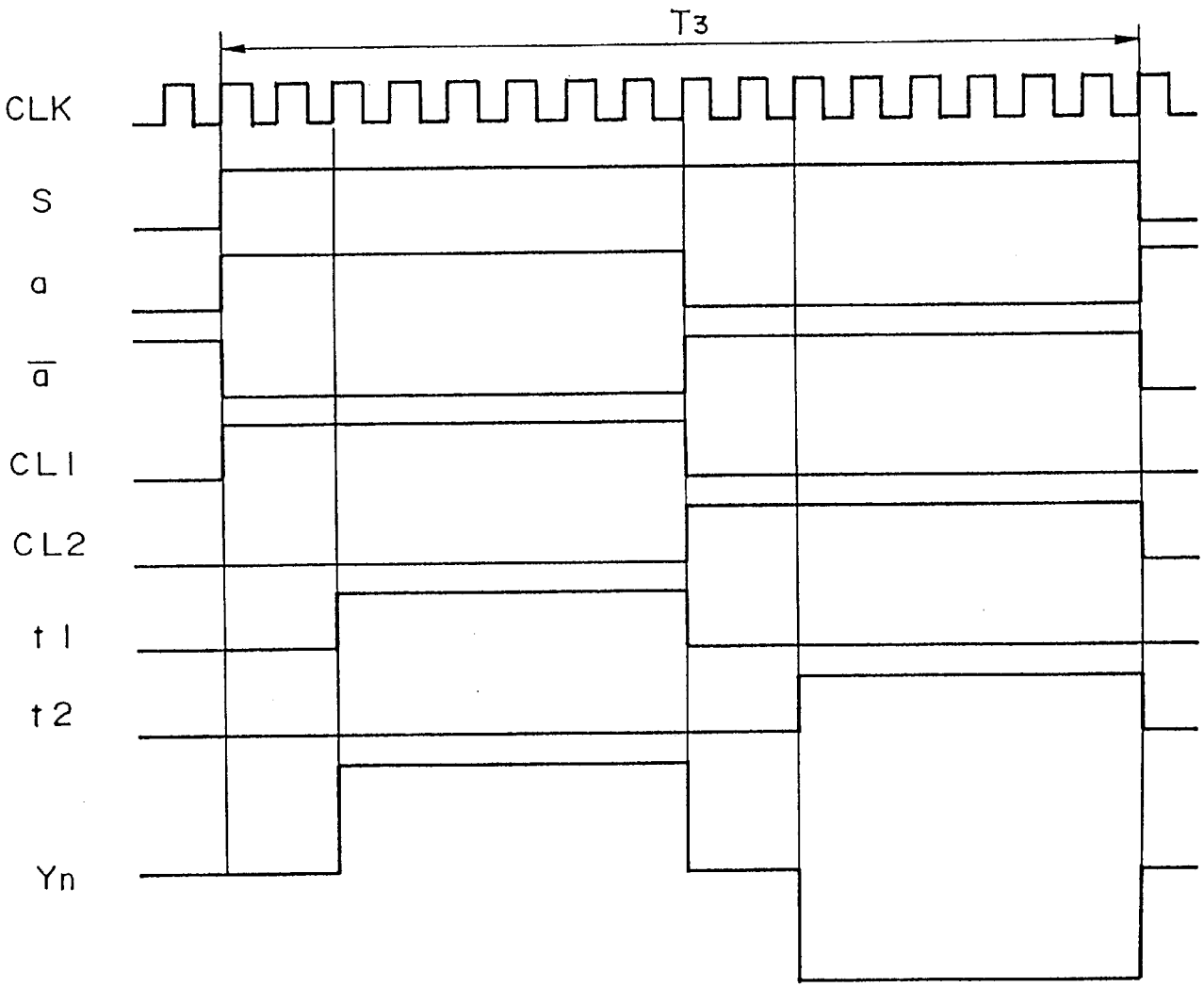
FIG. 24 is a timing chart of the drive circuitry of FIG. 23.

Signals t1 and t2 output from the A=B pins of comparators 81A, 81B are each high throughout a period corresponding to the pulse width of the selection pulse during selection period T3 of scan signal Yn, as shown in FIG. 24. Therefore, by using DIP switches 80 to change the period during which signals t1 and t2 are high, it is possible to change the duty ratio of the pulse width of the selection pulse with respect to selection period T3 of scan signal Yn in a stepwise manner set by the reference clock CLK input within selection period T3. As shown in FIG. 24, the setting A of DIP switches 80 is 2 and the reference clock CLK is input 8 times during one half period of the selection period (T3/2). Therefore, the duty ratio of the pulse width of the selection pulse with respect to selection period T3 of scan signal Yn is 100×(8−2)/8=75%. With embodiment ten configured in this manner, the duty ratio is reduced by making the setting of DIP switches 80 large, and, conversely, the duty ratio is increased by making this setting small.

Eleventh Embodiment

Figure 25:
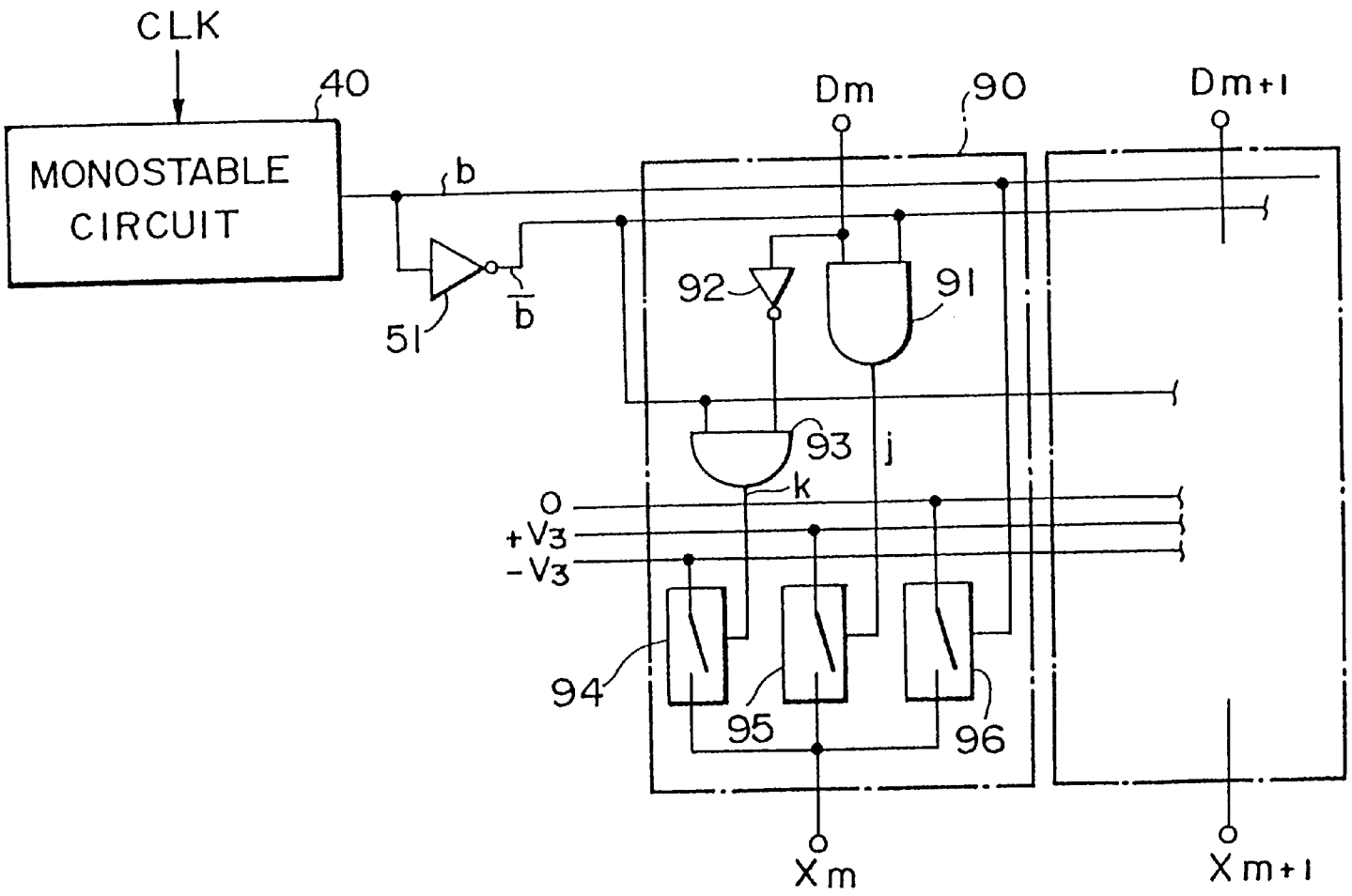
FIG. 25 is a block diagram of the drive circuitry of a eleventh embodiment of the present invention that can vary the duty ratio of the data potential period with respect to the selection period.
Figure 26:
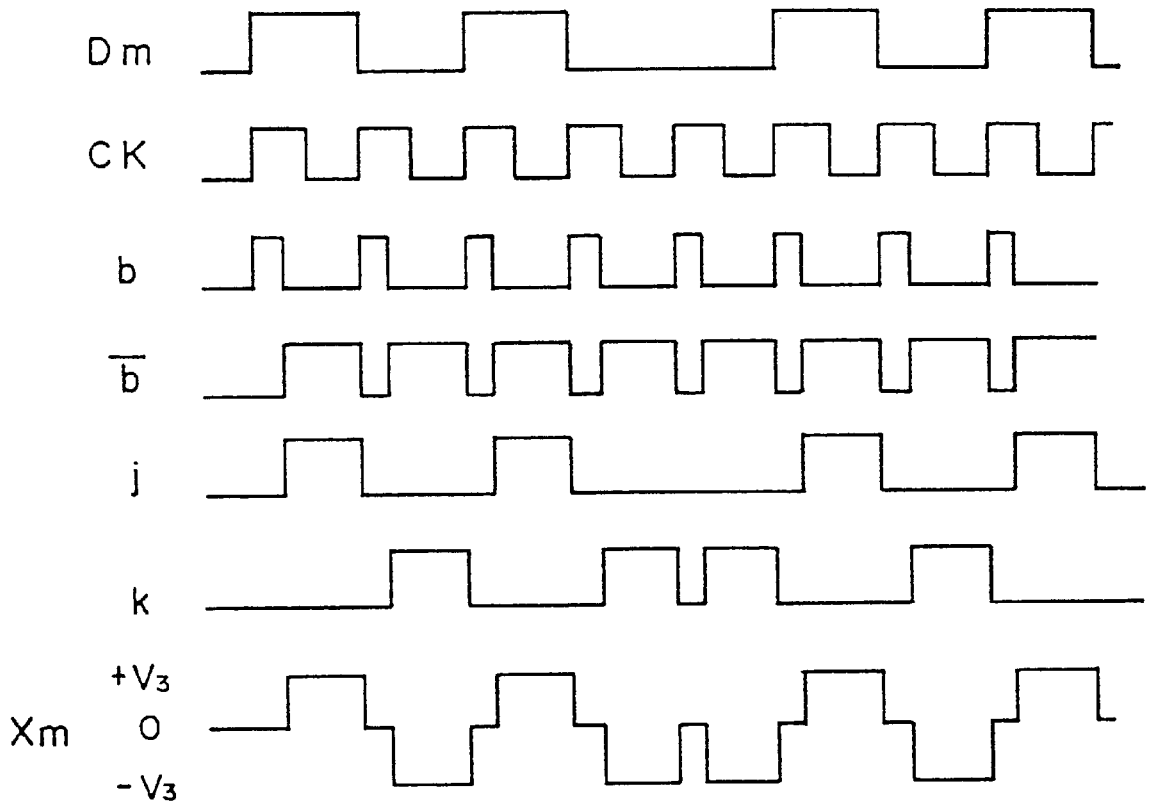
FIG. 26 is a timing chart of the drive circuitry of FIG. 25.

An eleventh embodiment of the present invention is designed to vary the duty ratio of the period of the ON potential or OFF potential with respect to selection period T3 of the data signal Xm. A data signal drive circuit 90 for outputting the data signal Xm supplied to the column electrode of the mth column is shown in FIG. 25, and a timing chart of this circuit is shown in FIG. 26. This data signal drive circuit 90 has a sixth analog switch 94 for outputting a potential −V3 as the data signal Xm, a seventh analog switch 95 for outputting a potential V3, and an eighth analog switch 96 for outputting a potential 0.

Analog switches 94–96 are provided with logic gates 91–93 for providing switching drive. An eighth AND circuit 91 is provided for switching seventh analog switch 95. Eighth AND circuit 91 receives data Dm for the mth column and a signal that is the signal $_{13}$ b_ from monostable circuit 40 of FIG. 20, after it has been inverted by the second inverter 51. As shown in FIG. 26, an output signal _j_ of eighth AND circuit 91 is high throughout a period corresponding to the width of a pulse that has a potential of +V3, during selection period T3 corresponding to one horizontal scanning period of the data signal Xm. A ninth AND circuit 93 is provided for switching first analog switch 94. Ninth AND circuit 93 receives a signal that is the data Dm after being inverted by a third inverter 92 and the signal that is the signal _b_ after it has been inverted by second inverter 51, and generates a signal _k_. Signal _k_ is high throughout a period corresponding to the width of a pulse that has a potential of −V3, during selection period T3 of the data signal XmII, as shown in FIG. 26. Eighth analog switch 96 is switched by signal _b_ from monostable circuit 40. In this way, the duty ratio of the data potential with respect to the selection period of the data signal Xm can be varied based the time constant CR of monostable circuit 40. The means of varying the duty ratio of the data potential period with respect to the selection period of data signal Xm could be done in a digital manner, in the same way as in embodiment ten.

Twelfth Embodiment

Figure 27:
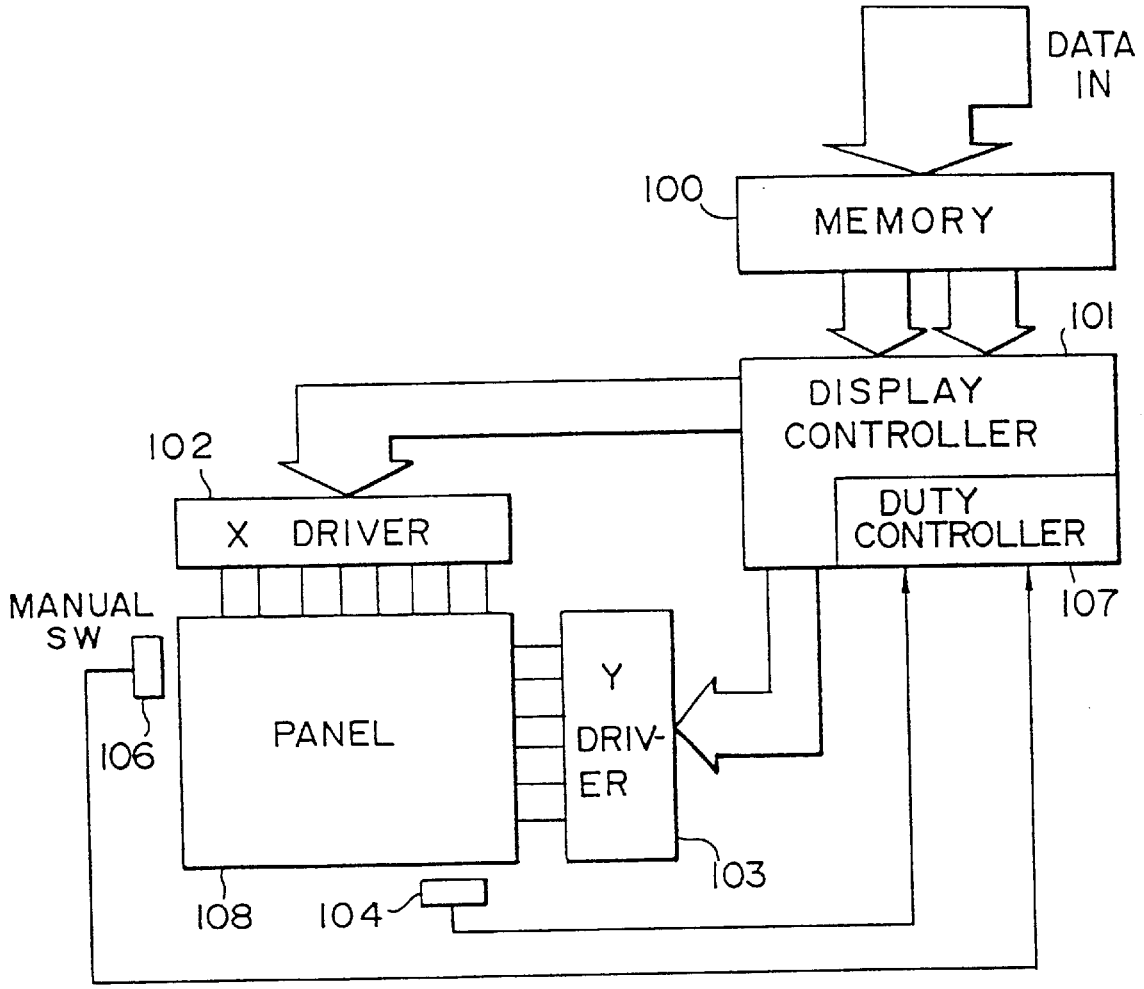
FIG. 27 is a block diagram of the matrix drive circuitry of a twelfth embodiment of the present invention that provides either manual or automatic temperature compensation of the drive voltage.

FIG. 27 shows a block diagram of a matrix liquid crystal display device that can vary the duty ratio of the selection pulse width with respect to selection period T3. The data necessary for the display is stored temporarily in a memory 100, then is transferred through a display controller 101 to an X driver 102 and a Y driver 103. Within display controller 101 is a duty ratio controller 107 that causes a change in the pulse width duty ratio of X driver 102 or Y driver 103 in accordance with a signal from a temperature sensor 104 or a manual switch 106, so that the duty ratio of the pulses from the X driver or Y driver are determined either automatically or manually by this setting. This setting could be the continuous variation of the ninth and eleventh embodiments or the stepwise variation of the tenth embodiment. As a result, the pulse train applied to liquid crystal panel 108 can be adjusted in correspondence with the ambient temperature, and is a waveform optimized for ease of viewing.

The addition of duty ratio controller 107 to display controller 101 enables either continuous or stepwise variation of the pulses applied to the liquid crystal during selection period T3, so that the RMS voltages of the pulse applied to the liquid crystal can be varied thereby. This of course means that irregularities in drive voltage between individual liquid crystal panels are absorbed, and changes in drive voltage due to variations in ambient temperature can be adjusted for without changing the power supply voltage. If the configuration is such that the user of the liquid crystal display panel can apply direct adjustment by an external operating switch, the display can be adjusted to the user's own optimal state. If it is found during circuit fabrication that the difference between the reset voltage and the data voltage is large and thus it is difficult to provide an accurate power supply voltage, this problem can be solved by lowering the pulse duty ratio and raising the peak value. With a color display, the pulse duty ratio could be adjusted for each of the RGB drive voltages, even if there are differences in cell gap or threshold value due to difference in RGB filter thickness.

At least one of the scan signals (row electrode signals) supplied to a plurality of row electrodes can be set such that the duty ratio of the period of the selection potential with respect to the selection period has a different value from that of the other row electrode signals. For example, varying the above described duty ratio for the row electrodes at the upper and lower parts of the liquid crystal panel can compensate for irregularities in the threshold value of the liquid crystal at the upper and lower parts of the liquid crystal panel. Similarly, at least one of the data signals (column electrode signals) supplied to a plurality of column electrodes can be set such that the duty ratio of the data potential period with respect to the selection period has a different value from that of the other column electrode signals. For example, varying the above described duty ratio for the column electrodes at the left and right of the liquid crystal panel can compensate for irregularities in the threshold value of the liquid crystal at the left and right sides of the liquid crystal panel. Alternatively, an individual column electrode signal supplied to the column electrode of one column could be observed, and the column electrode signal could be adjusted such that the duty ratio of the period of the data potential with respect to the selection period corresponding to one pixel on one of the column electrodes that is supplied with one of the column electrode signals is set to be different from that of the selection periods corresponding to the other pixels on that column electrode. This can compensate for differences in drive voltage at the top and bottom of the liquid crystal screen attributed to irregularities in the threshold value at each pixel.

The above described drive method that modifies the duty ratio can be applied, in the same way to a drive method in which no delay period is provided, such as that shown in FIG. 3 or FIG. 13.

Notes on Other Parameters That Affect the Threshold Value of the Liquid Crystal

Embodiments nine through twelve compensated for irregularities in the threshold value of the liquid crystal medium making up the liquid crystal panel or irregularities in the threshold value caused by ambient temperature by varying the duty ratio of the period of the selection pulse with respect to the selection period, but any of the several parameters described below can be varied to change the threshold value of the liquid crystal. The pulse height of the selection pulse could be varied to suit the threshold value of the liquid crystal. Further examples of parameters that could be used to vary the threshold value of the liquid crystal are the width of the selection pulse and the length of delay period T2 that sets the timing for applying the selection pulse.

Figure 28:
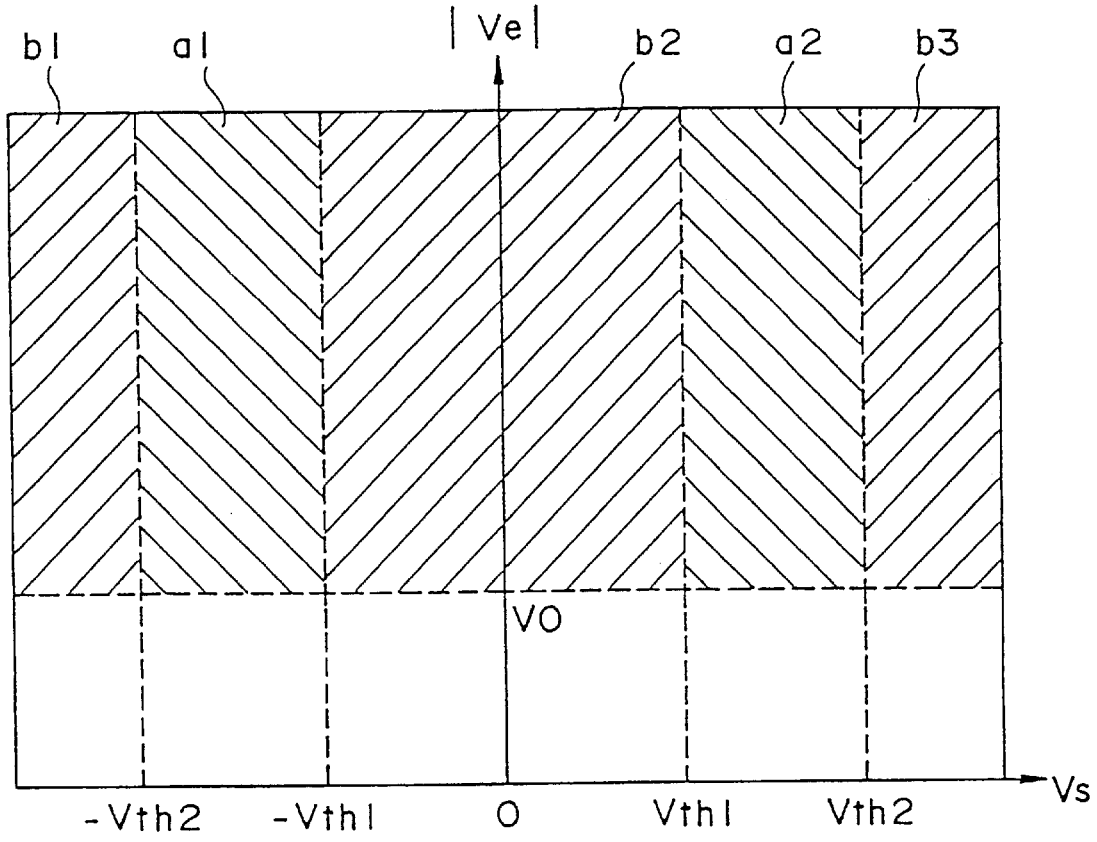
FIG. 28 shows the threshold value characteristics of to selection pulse voltage of a liquid crystal having two metastable states.

For example, if the pulse width of the selection pulse, the delay time, and the temperature are all kept constant, the critical value is the heights of the selection pulses, which are shown by Vth1 and Vth2 in FIG. 28. In FIG. 28, in the orthogonal plane of the absolute value of voltage Ve of the reset pulse (along the Y-axis) against the voltage Vs of the selection pulse (along the X-axis), a1 and a2 represent regions in which one of the metastable states (e.g., the state in which the angle of twist is zero) occurs (_Ve_>V0 and _Vth1_<_Vs_<_Vth2_). Similarly, b1, b2, and b3 represent regions in which the other of the metastable states (e.g., the state in which the angle of twist is 360_) occurs (_Ve_>V0 and _Vs_<_Vth1_, or _Ve_>V0 and _Vs_>_Vth2_). It should be noted at this point that Vth1 and Vth2 are threshold values with respect to the selection pulse voltage, and in actual practice there can be three or more of these threshold values. In these embodiments, Vth1 acts as threshold value for driving the liquid crystal.

Figure 29:
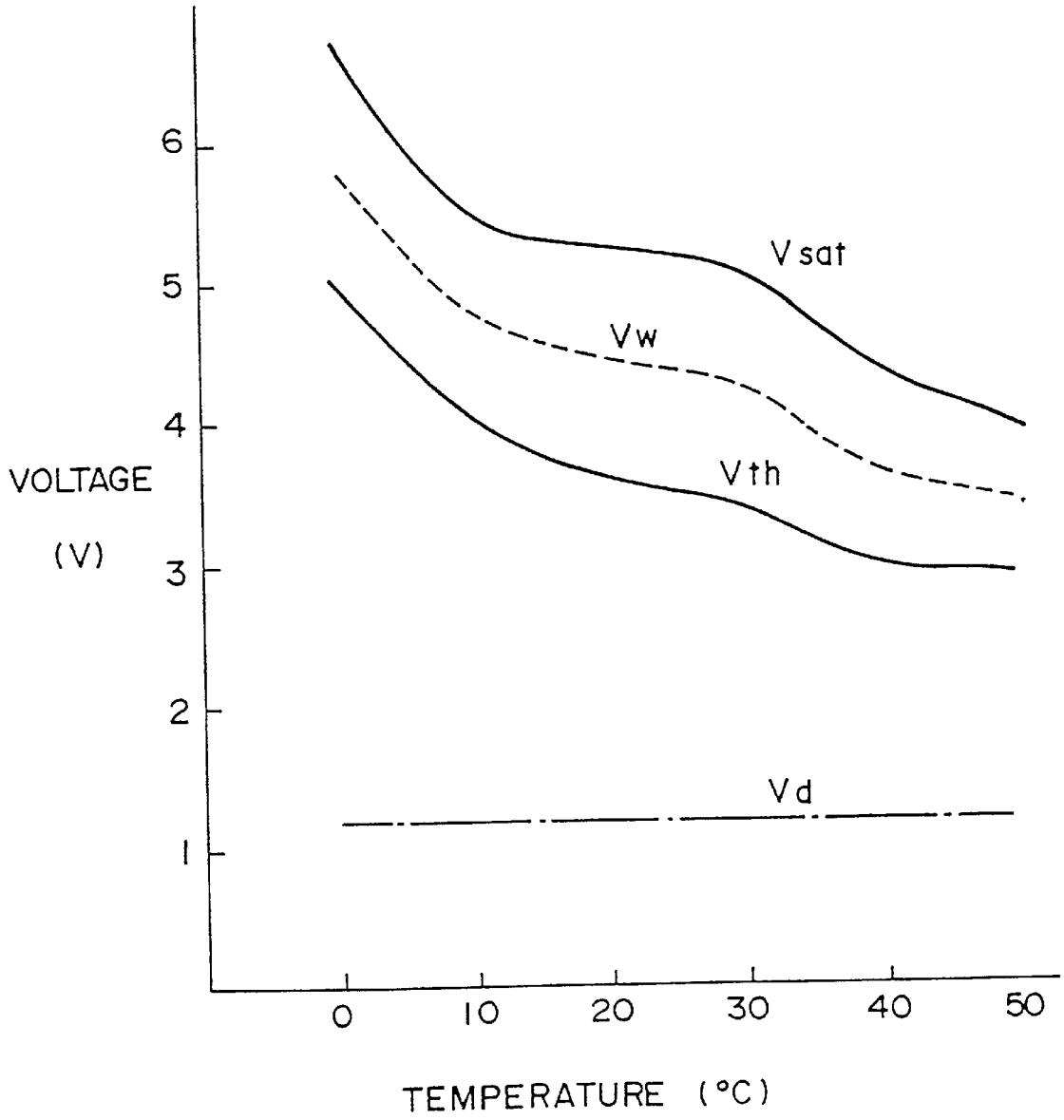
FIG. 29 is a characteristics graph illustrating the correlation of temperature variation with a threshold value of the voltage of a selection pulse, showing the principle of the drive of a thirteenth embodiment of the present invention.
Figure 30:
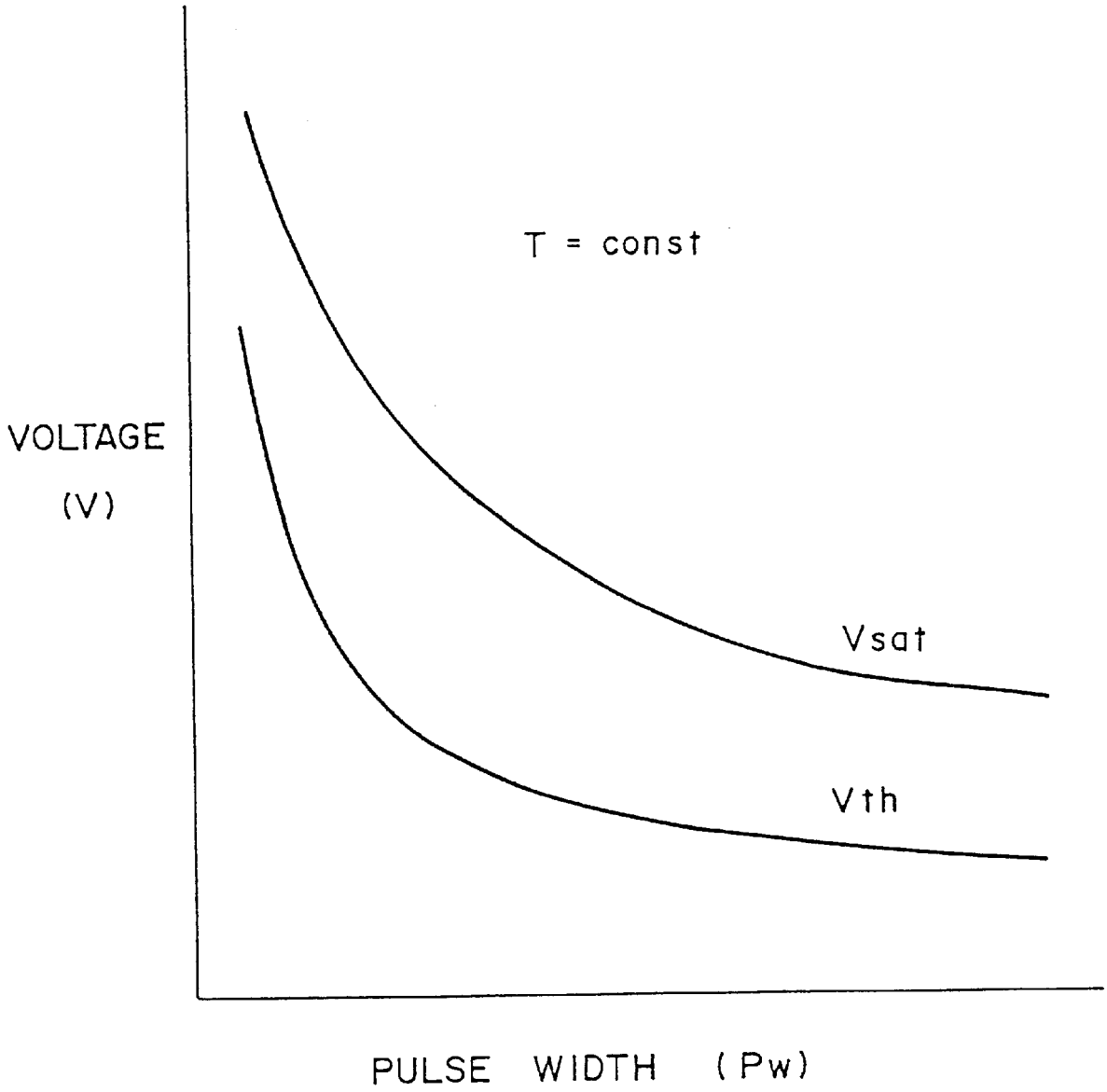
FIG. 30 is a characteristics graph illustrating the correlation of the pulse width of a selection pulse with a threshold value of the voltage of the selection pulse, showing the principle of the drive of a fourteenth embodiment of the present invention.
Figure 31:
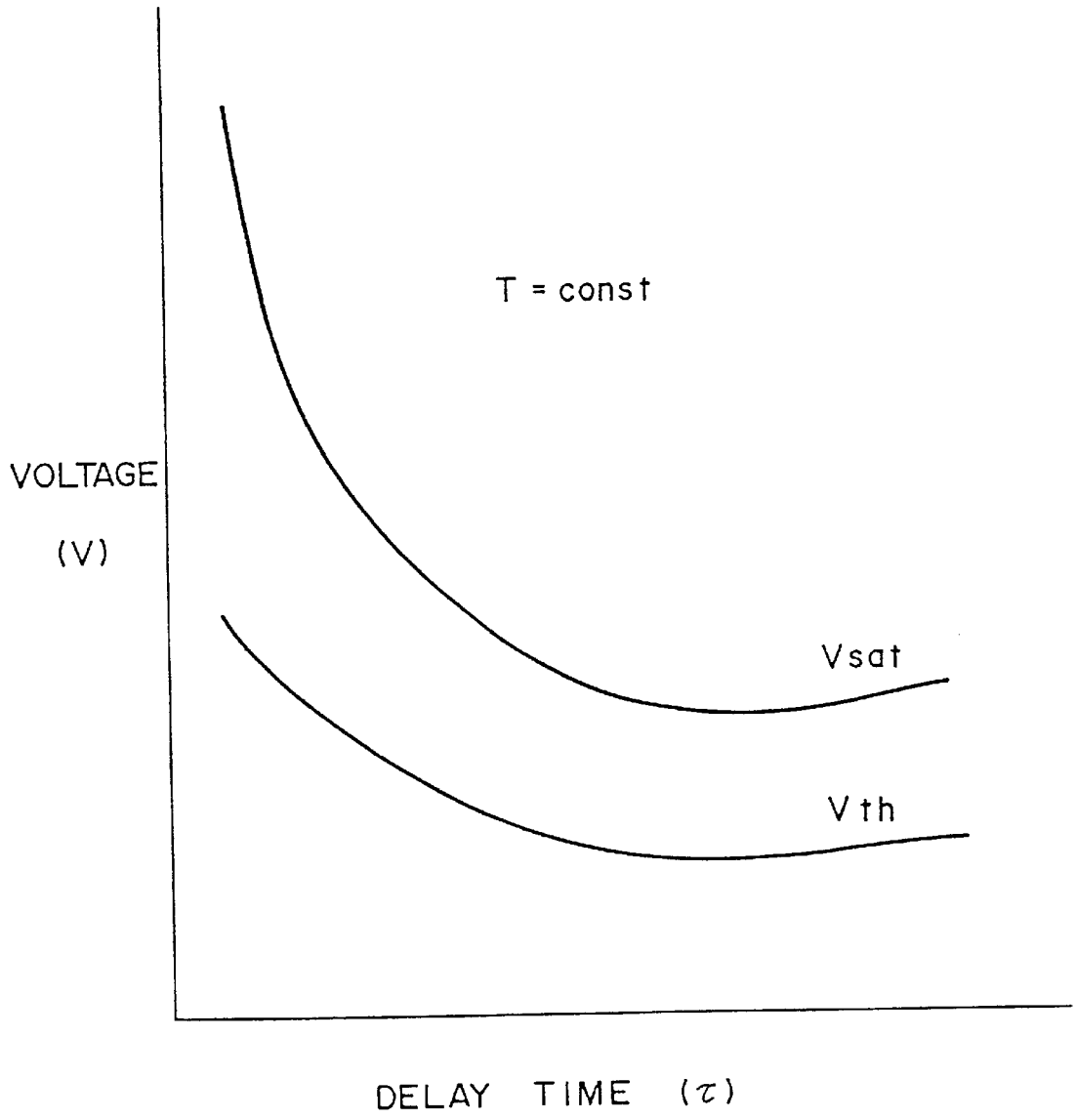
FIG. 31 is a characteristics graph illustrating the correlation of delay time of a selection pulse with a threshold value of the voltage of the selection pulse, showing the principle of the drive of a fifteenth embodiment of the present invention.

A critical value could be obtained from a combination of the above three parameters. A negative correlation between temperature T and threshold values Vth and Vsat is shown in FIG. 29, a negative correlation between pulse width Pw and threshold values Vth and Vsat is shown in FIG. 30, and a correlation between delay time t and threshold values Vth and Vsat is shown in FIG. 31. The ON/OFF drive conditions for the liquid crystal indicated in each of the embodiments below are: Von=Vw+Vd_Vsat and Voff=Vw−Vd_Vth.

The thirteenth to fifteenth embodiments described below relate to temperature compensation implemented by changing one of the above described parameters, using temperature sensor 21 and temperature compensation circuit 22 of FIG. 5.

Temperature sensor 21 measures the ambient temperature of liquid crystal cell 11 and sends a corresponding measurement signal to temperature compensation circuit 22. Temperature compensation circuit 22 outputs a compensation control signal _x_ or _x_ to potential setting circuit 17 or line sequential scan circuit 18, to correspond to one of a plurality of temperature compensation methods described below. This is designed to modify the output potential of potential setting circuit 17 or change control frequency or control pattern of the line sequential scan circuit. A working temperature region could be divided into a plurality of temperature ranges, one of the above parameters could be preset to have a different value within each of these temperature ranges, and temperature compensation could be provided by selecting a setting for the parameter in the temperature range that the ambient temperature belongs to.

The drive waveform that drives the simple matrix type of liquid crystal display panel shown in FIG. 5 could be that shown in either FIG. 2A or FIG. 2B. Similarly, if a parameter that does not change the delay time is used, the drive waveform shown in FIG. 3 that applies the selection pulse immediately after the reset period has elapsed could be used.

Thirteenth Embodiment

A thirteenth embodiment of the present invention provides optimal liquid crystal drive that is tailored to the threshold value of the liquid crystal, by changing the pulse height of the selection pulse. To demonstrate this thirteenth embodiment, the duty ratio of selection period T3 with respect to one frame period T was set to 1/240, the pulse width (length of the selection period T2) to 40 μs, delay period T2 to 200 μs, and the signal potential Vd to ±1.2 V. Changes with respect to temperature of threshold values Vth and Vsat when an ON state (corresponding to a uniform orientation state where the angle of twist is zero) and an OFF state (corresponding to a twist orientation state where the angle of twist is 360°) were obtained were investigated in a normal temperature region within the range of 0° C. to 50° C. These changes in threshold value were as shown in Table 3 and FIG. 29. It is clear that, if the scan potential Vw of the selection period is adjusted in such a manner that the above described liquid crystal ON/OFF drive conditions were satisfied as shown in Table 3 and FIG. 29, stable drive is enabled in the above normal temperature region.

TABLE 3

| Temperature (_C.) | Vth (V) | Vsat (V) | Vw (V) |
|---|---|---|---|
| 0 | 4.91 | 6.74 | 5.83 |
| 10 | 4.08 | 5.56 | 4.82 |
| 20 | 3.63 | 5.29 | 4.46 |
| 30 | 3.41 | 5.11 | 4.26 |
| 40 | 3.01 | 4.40 | 3.71 |
| 50 | 3.00 | 4.02 | 3.51 |

This adjustment of the scan potential Vw adjusted the setting potential of potential setting circuit 17 by an output signal from temperature compensation circuit 22, in other words, the drive voltage. As can be seen from Table 3 and FIG. 29, the absolute value of the selection voltage could be set to be large if the threshold value of the liquid crystal is high, or small if the threshold value of the liquid crystal is low.

Fourteenth Embodiment

A fourth embodiment of the present invention implements temperature compensation by using the output signal from temperature compensation circuit 22 to adjust the control frequency of line sequential scan circuit 18 (i.e., the drive frequency of the liquid crystal display panel) in a stepwise fashion. In this case, the duty ratio of selection period T3 with respect to one frame period T was set to 1/240, the signal potential Vd to ±1.2 V, and the potential Vw of the scan signal in the selection period to ±4.2 V. In consideration of the negative correlation between pulse width Pw and threshold values Vth and Vsat, shown in FIG. 30, the adjustment method was such that, in the temperature region 15 to 35° C., pulse width Pw was and the delay time t was 200 μs. In contrast, in a temperature region of 0 to 15° C., the frequency was halved for a pulse width Pw of 80 μs, and in a high temperature region of 35 to 50° C., the frequency was doubled for a pulse width Pw of 20 μs. In this case, variations in threshold values Vth and Vsat with respect to temperature were as shown in Table 4, indicating that drive conditions were satisfied over the entire temperature region. This embodiment also varied the delay time within the range of 50 to 400 μs by adjusting the frequency, but it is also possible to fulfill the drive conditions simply by adjusting the pulse width.

TABLE 4

| Temperature (° C.) | Pulse Width (μs) | Vth (V) | Vsat (V) |
|---|---|---|---|
| 0 | 80 | 3.10 | 5.26 |
| 10 | 80 | 3.05 | 4.28 |
| 20 | 40 | 3.63 | 5.29 |
| 30 | 40 | 3.41 | 5.11 |
| 40 | 20 | 3.32 | 4.95 |
| 50 | 20 | 3.20 | 4.78 |

As can clearly be seen from Table 4 and FIG. 30, the drive frequency could be set to be low or selection period T3 long when the threshold value of the liquid crystal is high; or the drive frequency could be set to be low or selection period T3 short when the threshold value of the liquid crystal is low.

Fifteenth Embodiment

A fifteenth embodiment of the present invention implements temperature compensation by using the output signal from temperature compensation circuit 22 to adjust the control pattern of line sequential scan circuit 18 in a stepwise fashion, to adjust the length of delay period T2. In this case, the duty ratio of selection period T3 with respect to one frame period T was set to 1/240, signal potential Vd to ±1.2 V, potential Vw of the scan signal in selection period T3 to ±4.2 V, and pulse width Pw of the selection pulse to 40 μs. The adjustment method is based on the correlation between delay time t and threshold values Vth and Vsat shown in FIG. 31, making use of the negative-correlation portion of the delay time t such that, in the temperature region 15 to 35° C., the delay time t was 40 μs×5=200 μs. In contrast, in the temperature region of 0 to 15° C. the delay period was doubled for a delay time ti of 40 μs×10=400 μs, and in the high temperature region of 35 to 50° C., the delay period was reduced to ⅖ with a delay time t of 40 μs×2=80 μs. In this case, variations in threshold values Vth and Vsat with respect to temperature were as shown in Table 5, indicating that drive conditions were satisfied over the entire temperature region

TABLE 5

| Temperature (° C.) | Pulse Width (μs) | Vth (V) | Vsat (V) |
|---|---|---|---|
| 0 | 40 μs × 10 cycles | 3.19 | 5.38 |
| 10 | 40 μs × 10 cycles | 3.10 | 4.35 |
| 20 | 40 μs × 5 cycles | 3.63 | 5.29 |
| 30 | 40 μs × 5 cycles | 3.41 | 5.11 |
| 40 | 40 μs × 2 cycles | 3.19 | 4.79 |
| 50 | 40 μs × 2 cycles | 3.10 | 4.52 |

As can be seen from Table 5 and FIG. 31, delay period T2 can be set to be long when the threshold value of the liquid crystal is high; or short when the threshold value of the liquid crystal is low.

Experiments were performed using the same liquid crystal display panel as that of the above described embodiments, to determine what effects changes in duty ratio, pulse width, and delay time would have on the enabling of ON/OFF drive. Results of these experiments are shown in Table 6. It is clear from this table that, if the pulse width is reduced to shorten the write time, the threshold value rises and the ON/OFF drive is disabled. However, if a delay time is inserted, ON/OFF drive becomes enabled, even with narrow pulse widths.

TABLE 6

| T P | Duty Ratio | Pulse Width (μs) | Delay Time (μs) | V on (V) | V off (V) | Drive Possibility |
|---|---|---|---|---|---|---|
| 1 | 1/60 | 200 | 0 | 2 | 0 | — |
| | 1/120 | 100 | 0 | 2 | 0 | — |
| | 1/240 | 50 | 0 | 3 | 0 | x |
| 2 | 1/240 | 100 | 0 | 3 | 0 | x |
| | 1/240 | 100 | 100 | 3 | 0 | — |
| | 1/240 | 100 | 200 | 3 | 0 | — |
| 3 | 1/240 | 50 | 0 | 3 | 0 | x |
| | 1/240 | 50 | 50 | 3 | 0 | — |
| | 1/240 | 50 | 100 | 3 | 0 | — |
| | 1/240 | 50 | 200 | 3 | 0 | — |
| 4 | 1/480 | 50 | 0 | 3 | 0 | x |
| | 1/480 | 50 | 50 | 3 | 0 | x |
| | 1/480 | 50 | 100 | 3 | 0 | x |
| | 1/480 | 50 | 200 | 3 | 0 | x |
| | 1/480 | 50 | 0 | 5 | 0 | x |
| | 1/480 | 50 | 50 | 5 | 0 | — |
| | 1/480 | 50 | 100 | 5 | 0 | — |
| | 1/480 | 50 | 150 | 5 | 0 | — |
| 5 | 1/480 | 25 | 0 | 5 | 0 | x |
| | 1/480 | 25 | 50 | 5 | 0 | — |
| | 1/480 | 25 | 100 | 5 | 0 | — |
| | 1/480 | 25 | 250 | 5 | 0 | — |

In Table 6, TP indicates the type of drive waveform, where type 1 is the drive waveform shown in FIG. 3, both type 2 and type 4 are the drive waveform shown in FIG. 2A, and both type 3 and type 5 are the drive waveform shown in FIG. 2B.

Adjustment of the delay time t corresponding to delay period T2 enables a shortening of the pulse width Pw while controlling the ON voltage, and can thus shorten the write time, so that the number of scan lines can be increased. This shows that a chiral nematic liquid crystal having characteristics superior to those of STN liquid crystal, such as a memory capability (of 1 second, roughly) in metastable states, a high contrast ratio (of at least 100), wide viewing angle (of 60 to 80°), and rapid response (of 8 ms or less), will be extremely effective in producing the kinds of 640×400 and 640×480 pixel matrix display panel that are in such demand, without seeking the help of active elements.

Data in Table 6 concerns critical values for ON/OFF states or two states and directly shows that there is a strong correlation between the pulse width of the selection pulse and the delay time. It can also be understood from this table that the ON/OFF threshold values can be modified simply by changing the pulse width of the selection pulse.

In embodiments thirteen to fifteen, critical values used as reference when either of two metastable states are selected were determined from the three parameters of voltage value, pulse width, and delay time that indicate the imposed state of the selection pulse, and stable liquid crystal display can be implemented by adjusting them so that changes in the critical value due to temperature variations can be compensated for. In particular, since it has been clarified that temperature compensation within the working temperature region can be controlled by controlling any one of the above described three parameters, these embodiments are extremely significant in that they ensure a large degree of freedom over drive conditions.

For practicable temperature compensation, the present invention enables the stable drive of a display panel with a simple circuit configuration by adjusting the drive voltage or drive frequency. In particular, if a temperature sensor is provided in the circuit to provide automatic temperature compensation, voltage or frequency could be adjusted in an analog fashion in accordance with a detection signal from the temperature sensor, but the resultant circuit configuration would be complicated. To avoid this problem, a simple form of temperature compensation could be enabled by having a selection circuit select and switch the drive voltage in a digital fashion, or by having a switching circuit switch the drive clock in a digital fashion.

This type of temperature compensation is not limited to being based automatically on the output of a temperature sensor; a manual operation by a manual switch could also be performed instead. Similarly, the present invention is not necessarily limited to the above described temperature compensation based on the variation of aforementioned parameters; it can also be used to compensate for the irregularities in the threshold value of the liquid crystal shown in FIG. 49.

Notes on the Voltage Levels of the Scan and Data Signals

FIG. 8 shows a drive waveform using seven voltage levels that are voltage levels of the scan and data signals. In other words, there are two voltage levels for the data signal Xm: ±Vb, and a total of five levels for scan signal Yn: ±Vr, ±2 Vb, and zero. In this case, the voltage level Vr of scan signal Yn in reset period T1 must exceed 20 V. On the other hand, a voltage in the vicinity of 1 V is sufficient as the voltage level Vb of the data signal Yn. Therefore, with the drive waveform shown in FIG. 8, a large potential difference is created between scan signal Yn and the data signal Xm. Further, even within the same scan signal Yn waveform, a voltage difference in the vicinity of 20 V is created between the voltage Vr and the voltage 2 Vb.

Thus, in a display drive method using a liquid crystal having two metastable states, the ratio of the voltage of the scan signal to that of the data signal during the matrix drive is large and unbalanced, so there are serious problems involved in designing a drive circuit configuration in practice. This imbalance causes particularly large problems when it comes to turning this drive circuitry into an IC.

In the prior art, a six-level drive method has been proposed as a voltage-averaging drive method for a matrix liquid crystal display device (refer to p. 401 of the Liquid Crystal Device Handbook, published by Nikkan Kogyo Shimbun, Ltd.). This six-level drive method is effective in balancing the drive voltages of the waveforms of the scan and data signals, and making the ratio of the ON voltage to the bias voltage large. However, a reset voltage of a comparatively large value is necessary to drive the liquid crystal that is the target of the present invention, so this six-level drive method is unable to solve the above described problem. Methods of driving a liquid crystal by at least eight drive levels in accordance with the present invention are described below by way of various embodiments. In each of the embodiments below, delay period T2 is provided between reset period T1 and selection period T3 of the scan signal, but the eight-level drive method can also be applied to drive methods in which this delay period T2 is not provided, such as that shown in FIG. 3 or FIG. 13.

Sixteenth Embodiment

Figures 32A, 32B, 32C, 32D:
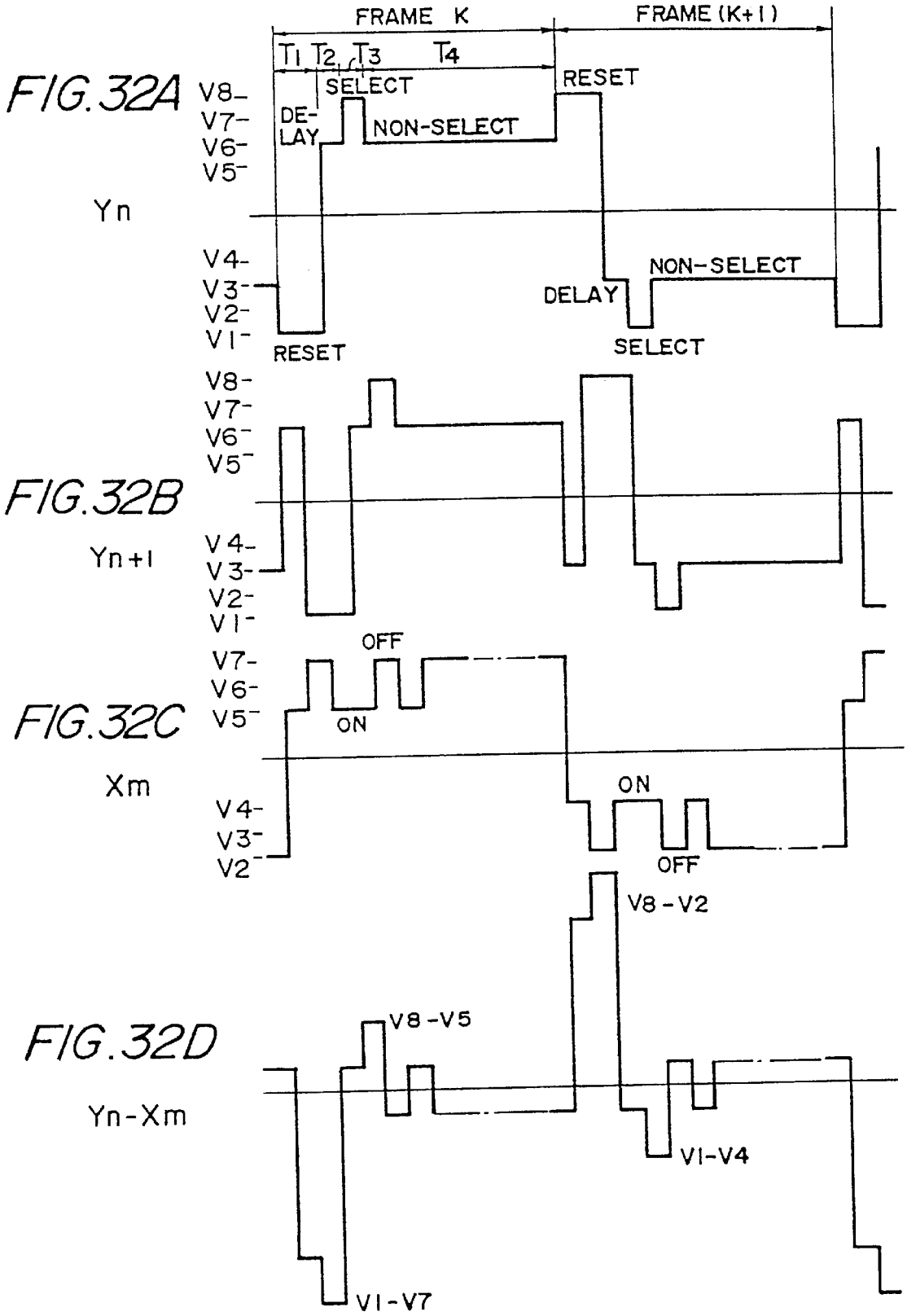
FIGS. 32A–32D show drive waveforms in accordance with the eight-level drive method relating to a sixteenth embodiment of the present invention.
Figure 33A:
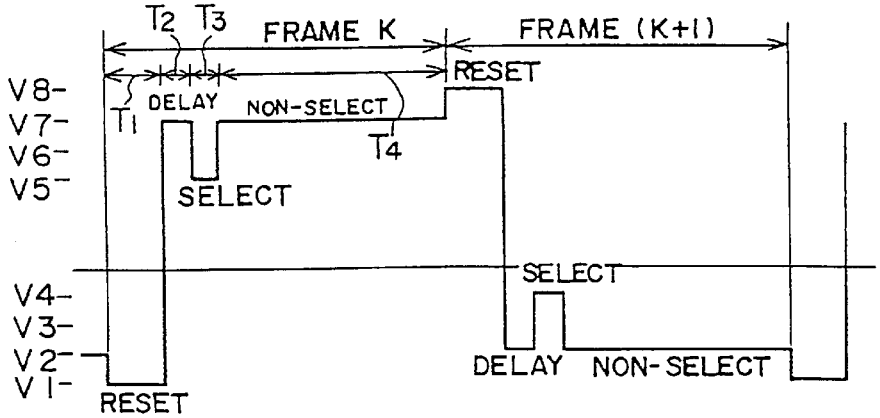
FIGS. 33A–33D show drive waveforms in accordance with the eight-level drive method relating to a seventeenth embodiment of the present invention.
Figure 33B:
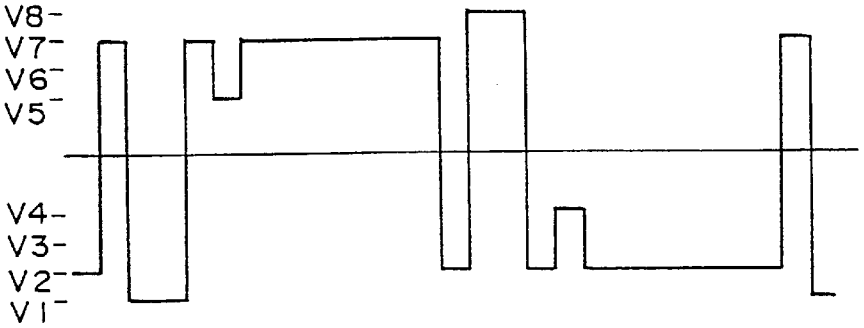
Figure 33C:
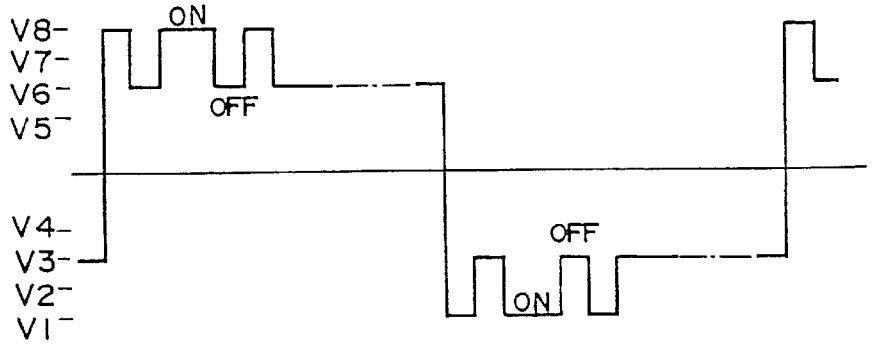
Figure 33D:
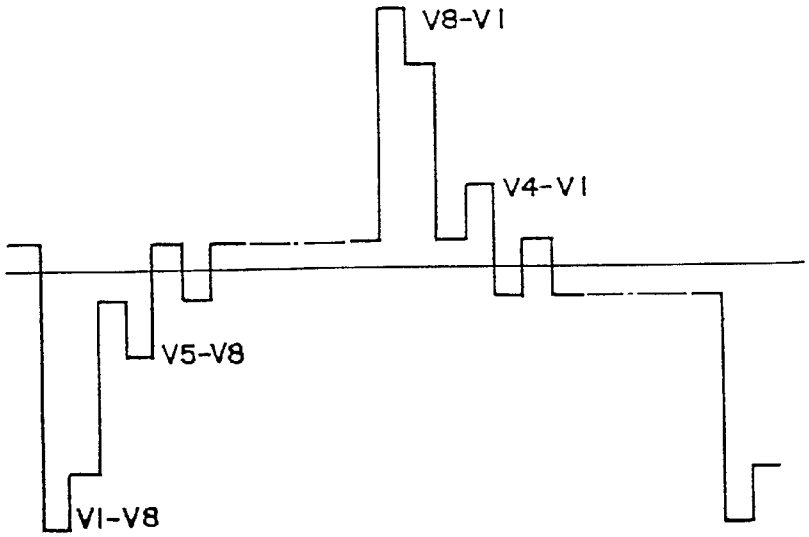
Figure 34A:
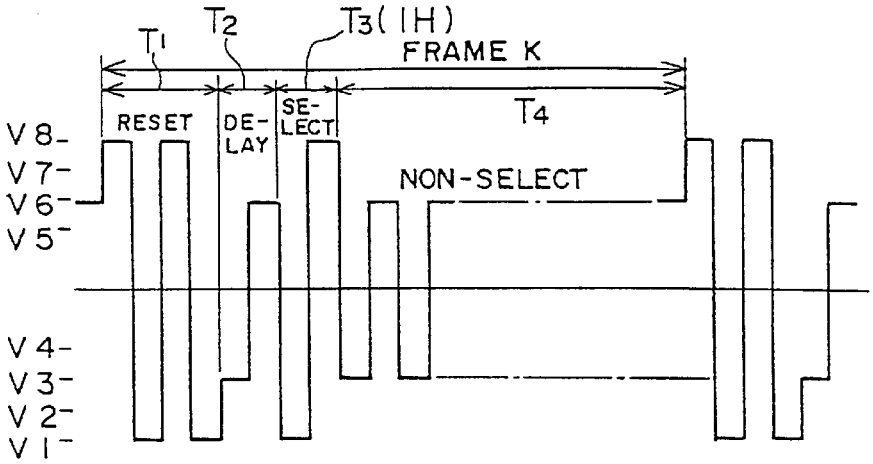
FIGS. 34A–34D show drive waveforms in accordance with the eight-level drive method relating to an eighteenth embodiment of the present invention.
Figure 34B:
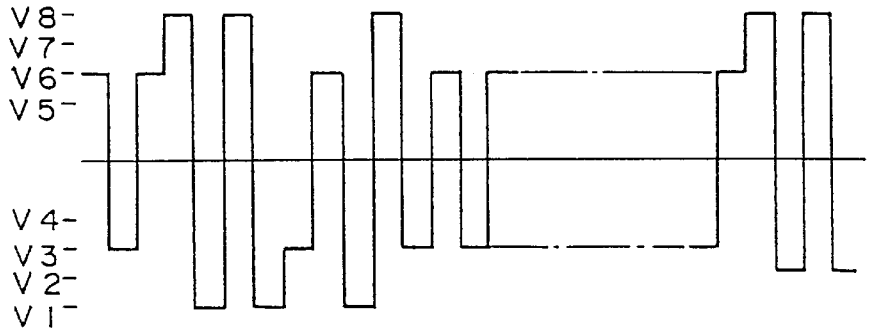
Figure 34C:
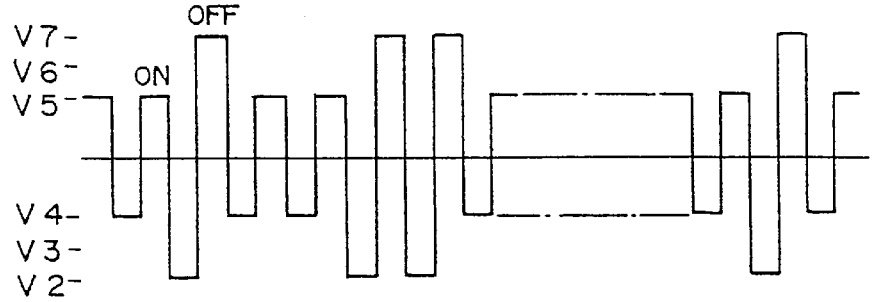
Figure 34D:
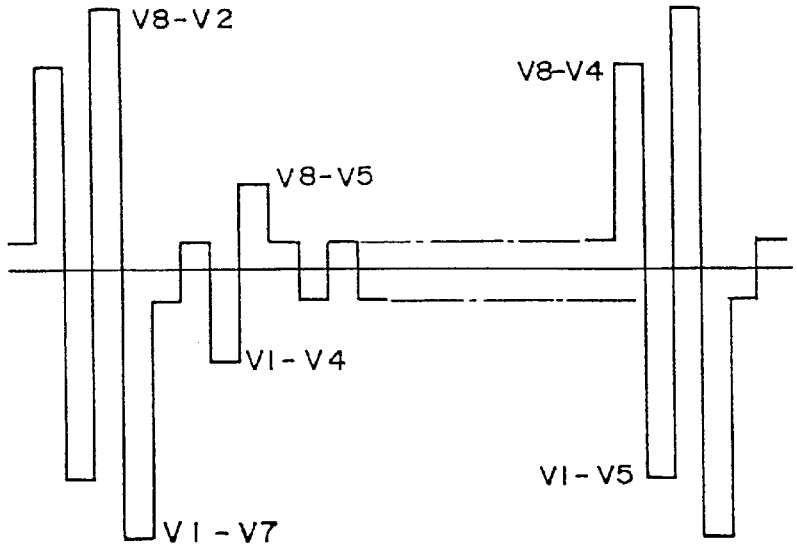
Figure 35A:
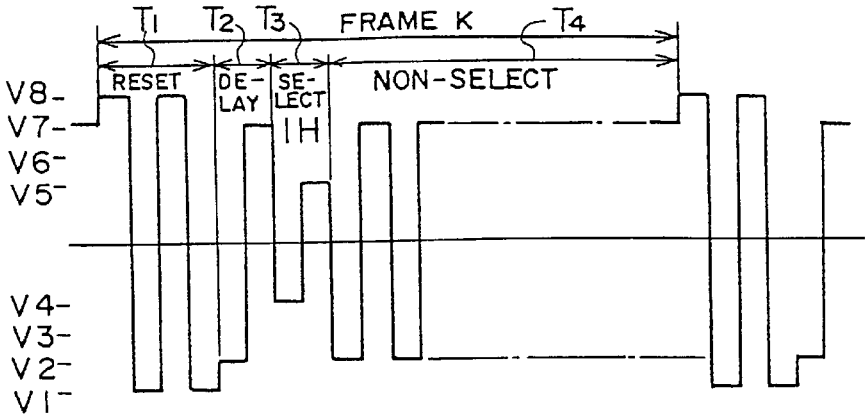
FIGS. 35A–35D show drive waveforms in accordance with the eight-level drive method relating to a nineteenth embodiment of the present invention.
Figure 35B:
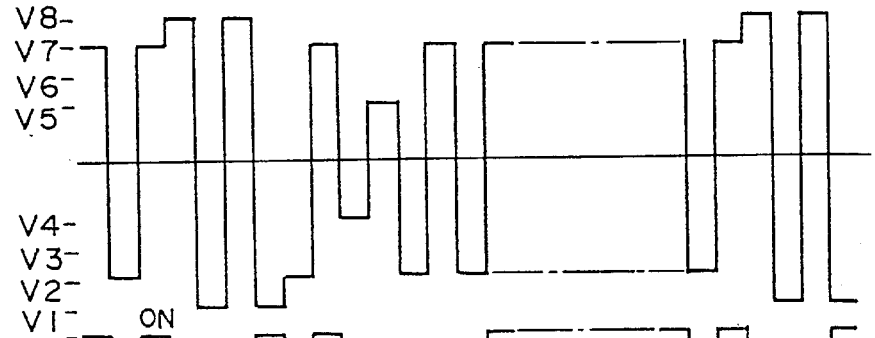
Figure 35C:
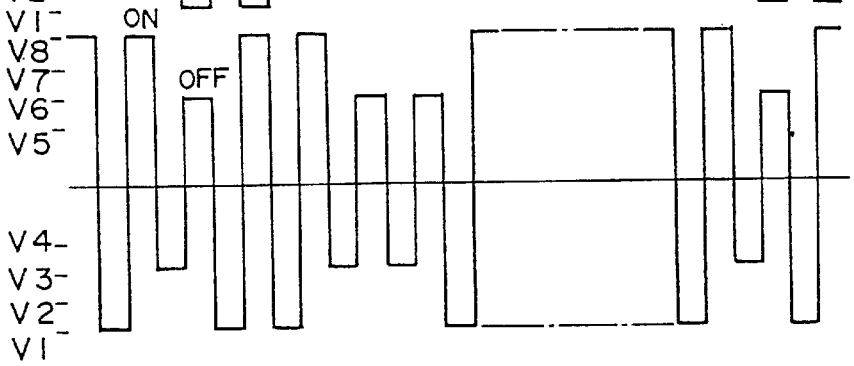
Figure 35D:
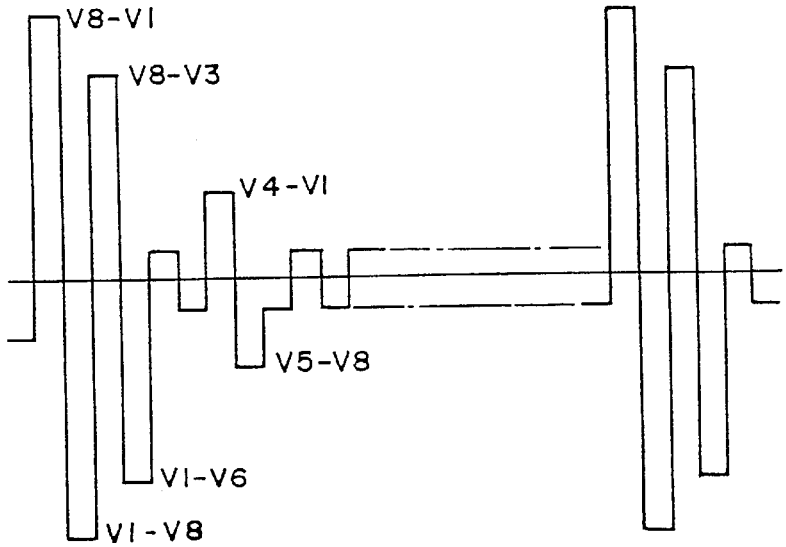
Figure 36A:
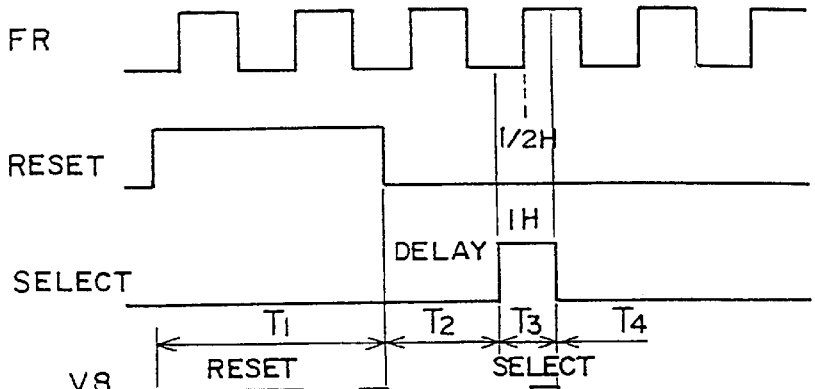
FIGS. 36A–36D show drive waveforms in accordance with the eight-level drive method relating to a twentieth embodiment of the present invention.
Figure 36B:
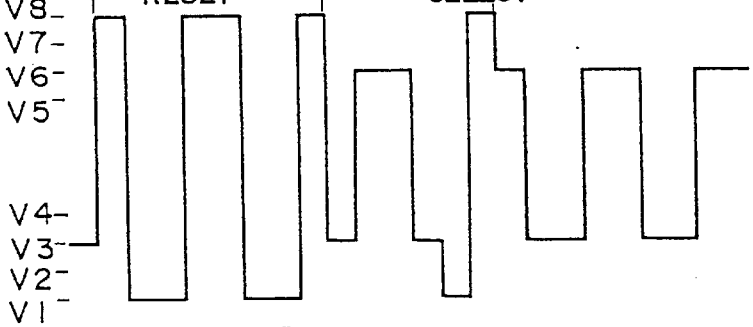
Figure 36C:
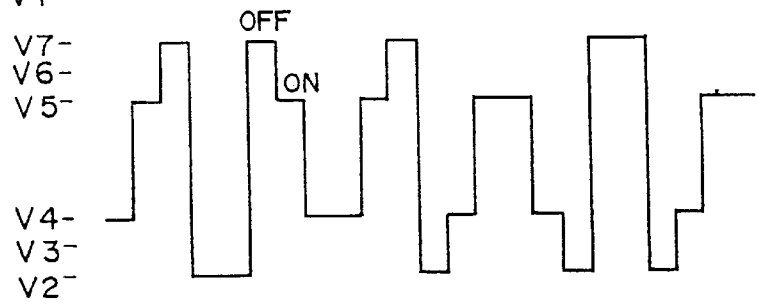
Figure 36D:
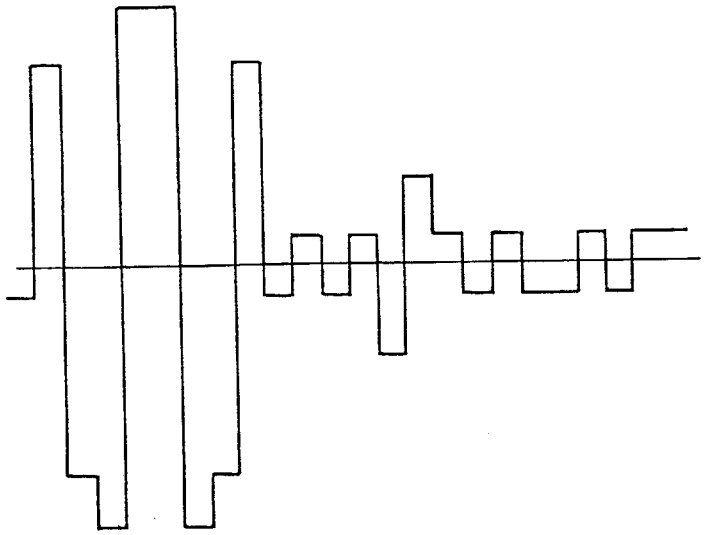

A drive waveform in accordance with a sixteenth embodiment of the present invention is shown in FIG. 32. Scan signals Yn and Yn+1 indicate the scan signals supplied to the nth and the (n+1)th row electrodes, respectively. Eight levels of potential that set these scan and data signals are provided: four levels in a first, low-voltage group (V1, V2, V3, and V4, where V1<V2<V3<V4) and four levels in a second, high-voltage group (V5, V6, V7, and V8, where V4<V5<V6<V7<V8). As shown in FIG. 32, the data signal Yn for the kth frame (where k is an integer) is set to voltage V1 during reset period T1, voltage V6 during delay period T2, voltage V8 during selection period T3, and voltage V6 during non-selection period T4. In the subsequent (k+1)th frame, the equivalent levels are symmetrical with those of the kth frame about a voltage midway between V4 and V5. In other words, scan signal Yn for the (k+1)th frame is set to voltage V8 during reset period T1, voltage V3 during delay period T2, voltage V1 during selection period T3, and voltage V3 during non-selection period T4. Although not shown in the figure, the subsequent (k+2)th frame has the same waveform as that of the kth frame, and the waveform repeats the same relationship thereafter.

Scan signal Yn+1 is the waveform of the next row's scan signal. It differs from scan signal Yn in that each of reset period T1, delay period T2, and selection period T3 are shifted by the time (1 H) required for one line. The beginning and end of the first frame are at the same point as in scan signal Yn, but the waveform of the scan signal is shifted by 1 H otherwise.

The ON voltage on the display of the data signal Xm is set to either V4 or V5, and the OFF voltage to either V2 or V7. In the kth frame, V5 on the high-potential side is ON and V7 is OFF, to ensure that the largest potential difference with the reset voltage V1 is achieved. In other words, the phases of the waveforms of the scan and data signals are in a 180° shifted relationship. In the (k+1)th frame, in order to invert the polarity of the voltage applied to the liquid crystal, V4 on the low-potential side is ON and V2 is OFF, which ensures that the maximum potential difference with the reset voltage V8 is generated.

Consider a pixel PXL (m, n) driven by this difference signal Yn-Xm between scan signal Yn and the data signal Xm. Even if a large reset voltage (V1−V7) or (V8−V2) is applied thereto, the same ON voltage, OFF voltage, and bias voltage as those of the voltage-averaging method shown in FIG. 8 are obtained. In other words, if the relationships are set to be V4−V3=V3−V2=V7−V6=V6−V5, the bias voltages of the non-selection periods T4 can be set to be applied equally. In this case, if it is desired to make the ON voltage large, the voltage differences between V1 and V2 and between V7 and V8 could be made large.

Similarly, if it is desired to make the reset voltage large, the potential difference between V4 and V5 can be made even wider. And if it is desired to make the delay period longer or shorter, the period can be shifted by unit 1 H.

As a first example to illustrate this principle, the first group of voltages were set such that V1=0 V, V2=1 V, V3=2 V, and V4=3 V, and the second group were set such that V5=23 V, V6=24 V, V7=25 V, and V8=26 V. As a second example, the first group of voltages were set to be negative at V1=−13 V, V2=−12 V, V3=−11 V, and V4=−10, and the second group were set to be positive at V5=10 V, V6=11 V, V7=12 V, and V8=13 V. In both of the first and second examples, a reset voltage of ±25 V, an ON voltage of ±3 V, an OFF voltage of ±1 V, and a bias voltage of ±1 V were obtained. Note the way in which the voltage settings of the second example enable the simultaneous implementation of a large voltage of over 20 V and a small bias voltage in the region of 1 V, while keeping the voltage values close with each other and having axis of symmetry of the zero-potential, which is ideal from the point of view of turning the drive circuitry into an IC. In other words, this enables a circuit design that uses the symmetry of ±10 V, ±11 V, ±12 V, and ±13 V to facilitate the role of the power supply. If an even larger reset voltage is required of this embodiment, the voltages can be set further apart in the positive and negative directions, so as to make the potential difference between the voltage V4 of the first group and the voltage V5 of the second group even wider, so that a reset voltage of 30 V or 40 V with a bias voltage of 1 V can be implemented.

Seventeenth Embodiment

The drive waveform of a seventeenth embodiment of the present invention that inverts the polarity of the voltage applied to the pixels in every frame, in the same manner as in the sixteenth embodiment, is shown in FIG. 33. The relationships between the voltages V1 to V8 in FIG. 33 are the same as those of the sixteenth embodiment. Scan signal Yn in FIG. 33 is at voltage V1 (frame k) or voltage V8 (frame k+1) during reset period T1, voltage V7 (frame k) or voltage V2 (frame k+1) during delay period T2, voltage V5 (frame k) or voltage V4 (frame k+1) during selection period T3, and the voltage V7 (frame k) or voltage V2 (frame k+1) during non-selection period T4. This scan signal Yn is symmetrical about an axis at an intermediate point between the voltages V4 and V5, and inverts every frame. In frame k, the ON voltage of the data signal Xm is V8 and the OFF voltage is V6; in frame k+1, the ON voltage is V1 and the OFF voltage is V3. If each of the voltages V1 to V8 is set to be the same as in the previously described first example or second example of the sixteenth embodiment, the reset voltage becomes ±26 V and the other voltage amplitudes can be expanded by ±1 V over those of the sixteenth embodiment. The ON voltage, OFF voltage, and bias voltage are the same as those of the sixteenth embodiment. To make this embodiment compatible with the voltage-averaging method of FIG. 8, the voltages could be set such that V2−V1=V3−V2=V7−V6=V8−V7.

Eighteenth Embodiment

The drive waveform of an eighteenth embodiment of the present invention that inverts the polarity of the voltage applied to the liquid crystal at each pulse is shown in FIG. 34. As can be seen from this figure, scan signal Yn is set to repeatedly alternate between two types of potential, voltages V1 and V8, every 1 H/2 (where 1 H is the length of selection period T3) during reset period T1. In a similar way, scan signal Yn is set to repeatedly alternate between two types of potential, voltages V3 and V6, every 1 H/2 during delay period T2. However, note that from delay period T2 onward, the pulses are 180° out of phase in comparison, with the reset pulses. Scan signal Yn is again set to repeatedly alternate between two types of potential, voltages V1 and V8, every 1 H/2 during selection period T3. Finally, it is set to alternate repeatedly between two types of potential, voltages V3 and V6, every 1 H/2 during non-selection period T4. Similarly, data signal Xm is set to repeatedly alternate between two types of potential, voltages V4 and V5, every 1 H/2 as the ON voltage, and between two types of potential, voltages V2 and V7, every 1 H/2 as the OFF voltage.

In the resultant difference signal Yn-Xm between scan signal Yn and data signal Xm, shown in FIG. 34, the polarities of the reset voltage, selection voltage, and non-selection voltage are inverted every 1 H/2. As a result, the polarity of the voltage applied to the liquid crystal can be inverted once every line. With this eighteenth embodiment, the same ON voltage, OFF voltage, and bias voltage as those of the voltage-averaging method shown in FIG. 8 are obtained. In other words, if the relationships are set to be V4−V3=V3−V2=V7−V6=V6−V5, the bias voltages of the non-selection periods T4 can be set to be applied equally.

Nineteenth Embodiment

The drive waveform of a nineteenth embodiment that inverts the polarity of the voltage applied to the liquid crystal at each pulse, in the same manner as in the eighteenth embodiment, is shown in FIG. 35. Scan signal Yn in this figure differs from that of FIG. 34 in the potentials set during delay period T2, selection period T3, and non-selection period T4. Scan signal Yn shown in FIG. 35 is set to repeatedly alternate between two types of potential, voltages V2 and V7, every 1 H/2 during delay period T2 and non-selection period T4. In a similar way, scan signal Yn is set to repeatedly alternate between two types of potential, voltages V4 and V5, every 1 H/2 during selection period T3.

However, this data signal Xm is completely different from that of the eighteenth embodiment in that the ON voltage thereof has two types of potential, voltages V1 and V8, and the OFF voltage thereof also has two types of potential, voltages V3 and V6. The resultant difference signal Yn-Xm between scan signal Yn and data signal Xm is designed to apply voltages of the same absolute value as those of the difference signal of the eighteenth embodiment during delay period T2, selection period T3, and non-selection period T4. However, although the maximum amplitude of the difference signal Yn-Xm of the nineteenth embodiment is either V1−V8 or V8−V1 during reset period T1, in the same manner as in the seventeenth embodiment, the amplitude of the reset voltage can be made even larger than that of the eighteenth embodiment. Thus this drive method is superior to the drive method of the eighteenth embodiment. To make this embodiment compatible with the voltage-averaging method of FIG. 8, the voltages could be set such that V2−V1=V3−V2=V7−V6=V8−V7.

Twentieth Embodiment

A twentieth embodiment of the present invention provides a method that controls the pulse drive frequency to reduce the number of inversions within one frame to approximately half that of the eighteenth embodiment. As shown in FIG. 36, a signal FR that determines the timing of the pulse inversions of the scan and data signals turns on and off in every 1 H. The phase of this FR signal is shifted by 1 H/2 from the rise of selection period T3. In this way, since the pulse inversion of the waveforms of scan signal Yn and the data signal Xm are in synchronization with signal FR, the number of pulse inversions within one frame is half that of the waveform shown in FIG. 34. However, the waveform of this difference signal Yn-Xm undergoes a pulse inversion every 1 H/2, in the same manner as the eighteenth embodiment, and this can ensure a long lifetime for the liquid crystal. With this twentieth embodiment, the drive frequency for each driver for the scan and data signals can be halved, making it easier to shape the waveform and reducing power consumption. This is particularly advantageous for the circuitry that causes the power supply voltage required for the alternation to swing between positive and negative. In the twentieth embodiment, the voltage settings in each of the periods T1 to T4 of the scan and data signals were made the same as in the eighteenth embodiment, but they can equally well be the same as in the nineteenth embodiment.

Twenty-First Embodiment

A drive method in which the pulse inversion is performed every 1 H is shown, in FIG. 37. As can be seen from this figure, the FR signal is similar to that of the twentieth embodiment shown in FIG. 36 in that it turns on and off every 1 H, but differs from the twentieth embodiment in that this FR signal is in synchronism with selection period T3. As shown in FIG. 37, during each selection period T3, scan signal Yn is set to voltage V1 in frame k and voltage V8 in frame (k+1), and thus, the voltages V1 and V8 alternate every frame. When the voltage of scan signal Yn in selection period T3 is V1, the waveform of the data signal Xm has voltage V4 as the ON voltage and voltage V2 as the OFF voltage. Similarly, when the voltage of scan signal Yn in selection period T3 is V8, the waveform of the data signal Xm has voltage V5 as the ON voltage and voltage V7 as the OFF voltage. If the resultant difference signal Yn-Xm between the scan and data signals is observed in frame k, it is clear that a voltage of negative polarity is applied to the liquid crystal a large number of times, and thus the polarity of the voltages applied to each pixel within any one frame cannot be balanced. However, in the next frame (k+1), the number of times a voltage of a positive polarity is applied to the liquid crystal is increased, so that the polarity of the voltages applied to the liquid crystal can be balanced over a sequence of two frames. This means that the twenty-first embodiment combines the frame inversion of the sixteenth and seventeenth embodiments with the pulse inversion of the eighteenth and nineteenth embodiments. The advantage of this twenty-first embodiment lies in the way in which selection period T3 (1 H) can be lengthened even when driving a liquid crystal display apparatus with high duty ratio, so that the length of time that the direct-current portion of the voltage is applied to the liquid crystal can be set to be shorter than in embodiments that employ frame inversion alone. The voltage of each of the periods T1 to T4 of the scan and data signals of this twenty-first embodiment are set to be the same as those in the seventeenth embodiment, but they can be set to be the same as those in the eighteenth embodiment instead.

Twenty-Second Embodiment

Figure 38:
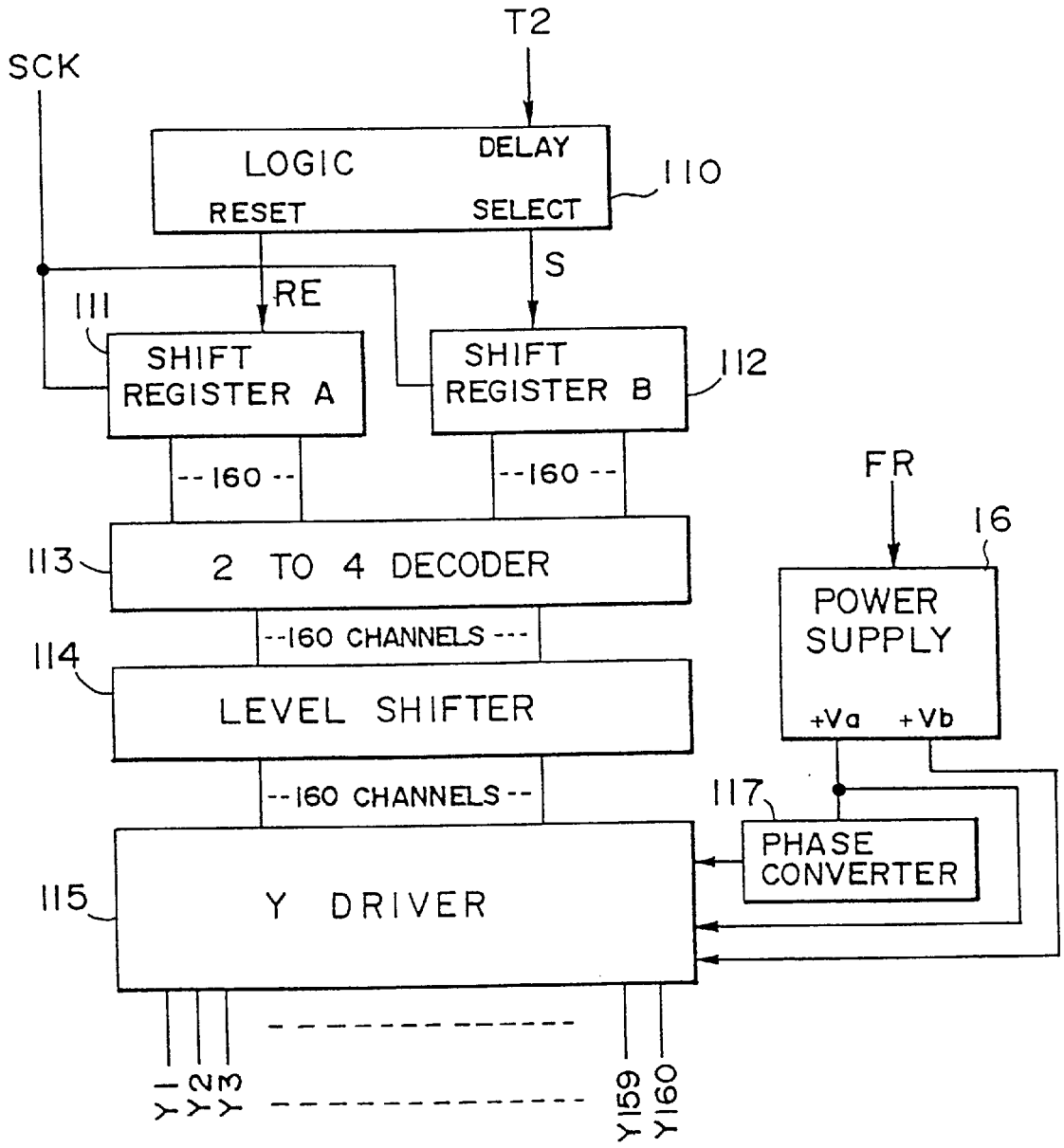
FIG. 38 is a block diagram of the Y driver circuit of the twenty-second embodiment of the present invention, used for creating the scan signal waveform shown with reference to the sixteenth to twenty-second embodiments.

A block diagram of a drive circuit for scan signal electrodes (row electrodes), for implementing the drive methods of the sixteenth to the twenty-first embodiments, is shown in FIG. 38. The description below concerns the circuit that generates the drive waveform of the twenty-first embodiment. In FIG. 38, a logic; circuit 110 generates a reset signal RE that specifies reset period T1 and a select signal S that specifies selection period T3 after delay period T2 has elapsed after-reset period T1, based on information on delay period T2. Signals RE and S are input to shift registers 111 and 112, respectively. Each of these registers 111 and 112 transfer signals RE and S in accordance with a shift clock SCK, and at the same time the internal states of the registers are simultaneously output in parallel to 160 channels. A 2-to-4 decoder 113 identifies three register output states of signals RE and S as (RE, S)=(1, 0), (0, 1), or (0, 0), and outputs them through a level shifter 114 to a Y driver 115. Y driver 115 receives three voltages from a power supply circuit 116 and a phase converter 117. If the power supply voltage of power supply circuit 116 acts as the alternation signal FR, each of the voltages can be made to swing ±Va or ±Vb. In this case, if (RE, S) is (1, 0), the voltages are ±Va; if it is (0, 1), the voltages are the inversion of ±Va after being passed through the phase converter 117; and if it is (0, 0), the voltages ±Vb are selected. For example, settings of Va=V8, −Va=V1, Vb=V6, and −Vb=V3 enable the provision of scan signal Yn waveform of the drive waveforms of the twenty-first embodiment shown in FIG. 37.

Figure 39:
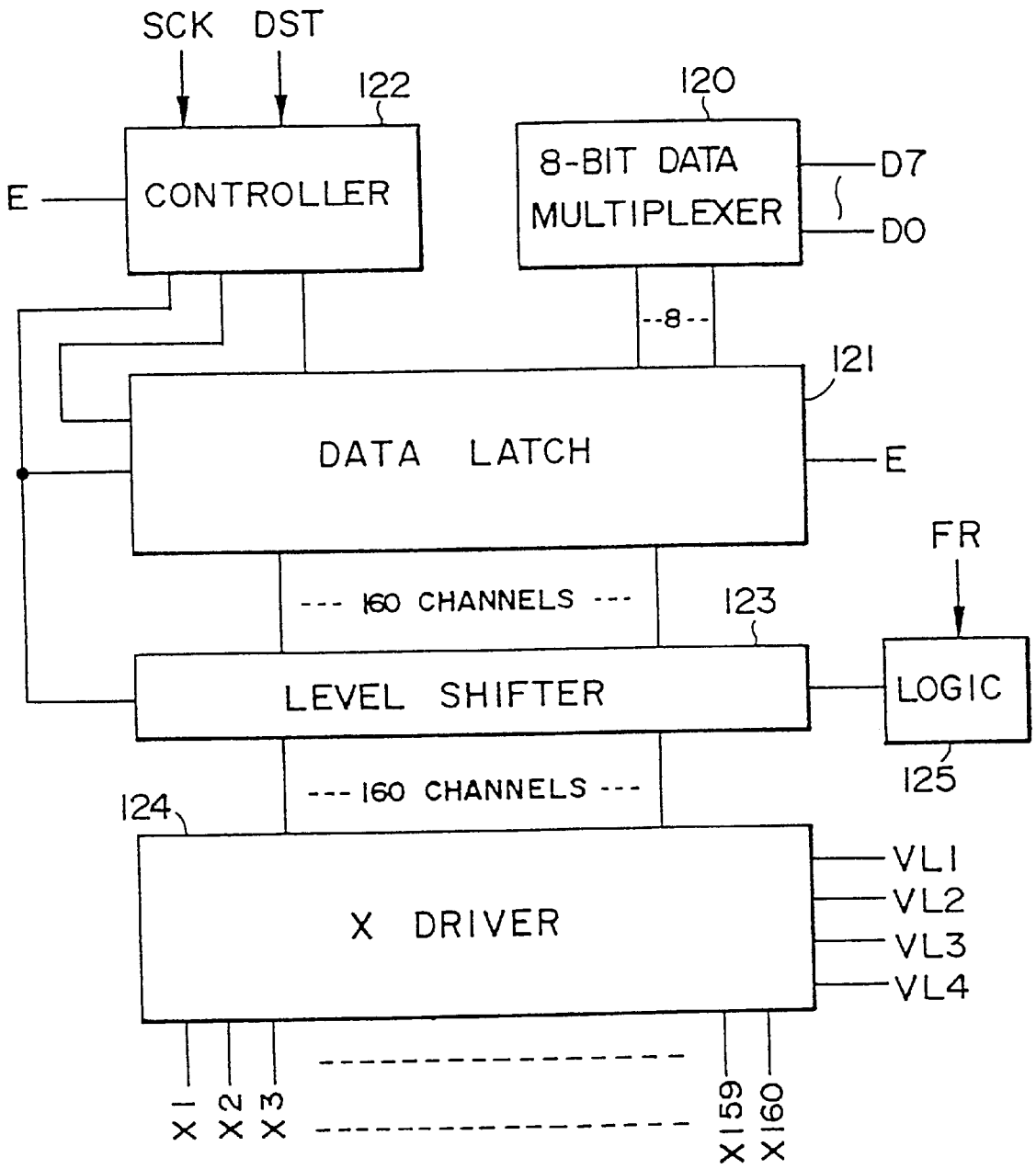
FIG. 39 is a block diagram of the X driver circuit of the twenty-second embodiment of the present invention, used for creating the data signal waveform shown with reference to the sixteenth to twenty-second embodiments.

A block diagram of the drive circuit for the data signal electrodes (column electrodes) is shown in FIG. 39. In this figure, 8-bit image data D0 to D7 is input to a data latch circuit 121 through a multiplexer 120, and it is converted into 160 channels of parallel data in the data latch circuit 121. The latch timing of the data latch circuit 121 is determined by latch pulses output by a control circuit 122 to which the clock SCK is input. The 160 channels of image data are sent from data latch circuit 121 to a level shifter 123, and at the same time an inversion operation is added by a signal from a logic circuit 125, based on the alternation signal FR. Therefore, two positive and negative states caused by the alternation are superimposed on the two ON/OFF states of the data signal, to generate a total of four states. An X driver 124 to which these four states for each of the channels are input selects one level from power supply voltages VL1 to VL4 in accordance with the state of each channel, and outputs it. In this case, if VL1=V7, VL2=V2, VL3=V5, and VL=V4, a waveform that is the same as data signal Xm of FIG. 37, which shows the drive waveform of the twenty-first embodiment, can be generated.

The above description has dealt with the generation of scan signal Yn and the data signal Xm of the twenty-first embodiment as the scan and data signal waveforms generated by the drive circuits shown in FIGS. 38–39, but it is equally possible to generate any of the drive waveforms of the sixteenth to twentieth embodiments, by changing the period of the FR signal and the setting voltages corresponding to ±Va, ±Vb, and VL1 to VL4.

Twenty-Third Embodiment

Drive circuitry that uses logic means to switch the voltage within each of the periods T1 to T4 of the scan signal and also the voltage of each selection period of the data signal will now be described with reference to FIGS. 40–45.

Figure 40:
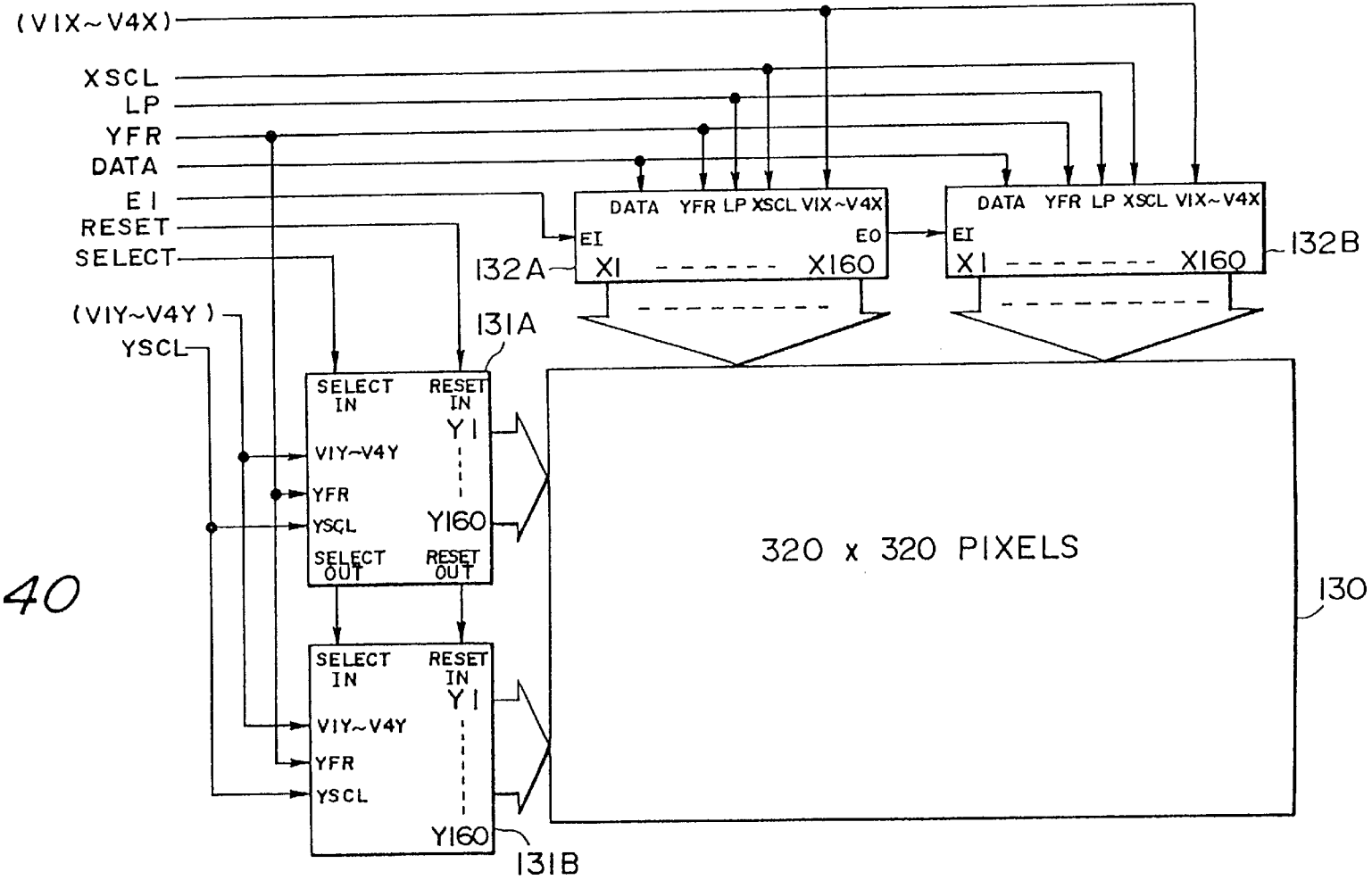
FIG. 40 shows the entire configuration of a matrix liquid crystal drive circuit according to a twenty-third embodiment of the present invention.
Figure 41:
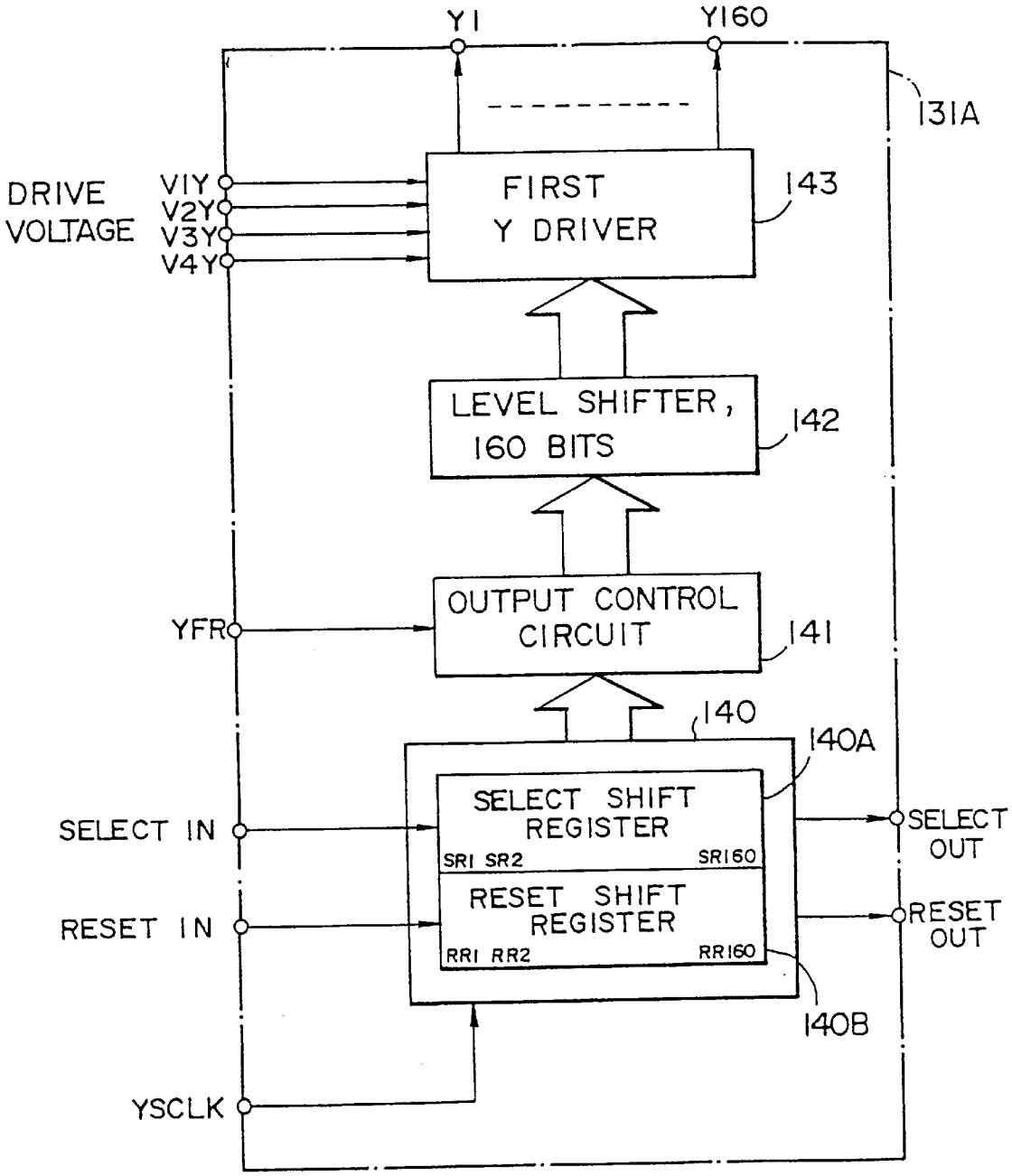
FIG. 41 is a block diagram of the Y driver circuit of FIG. 40.
Figure 42:
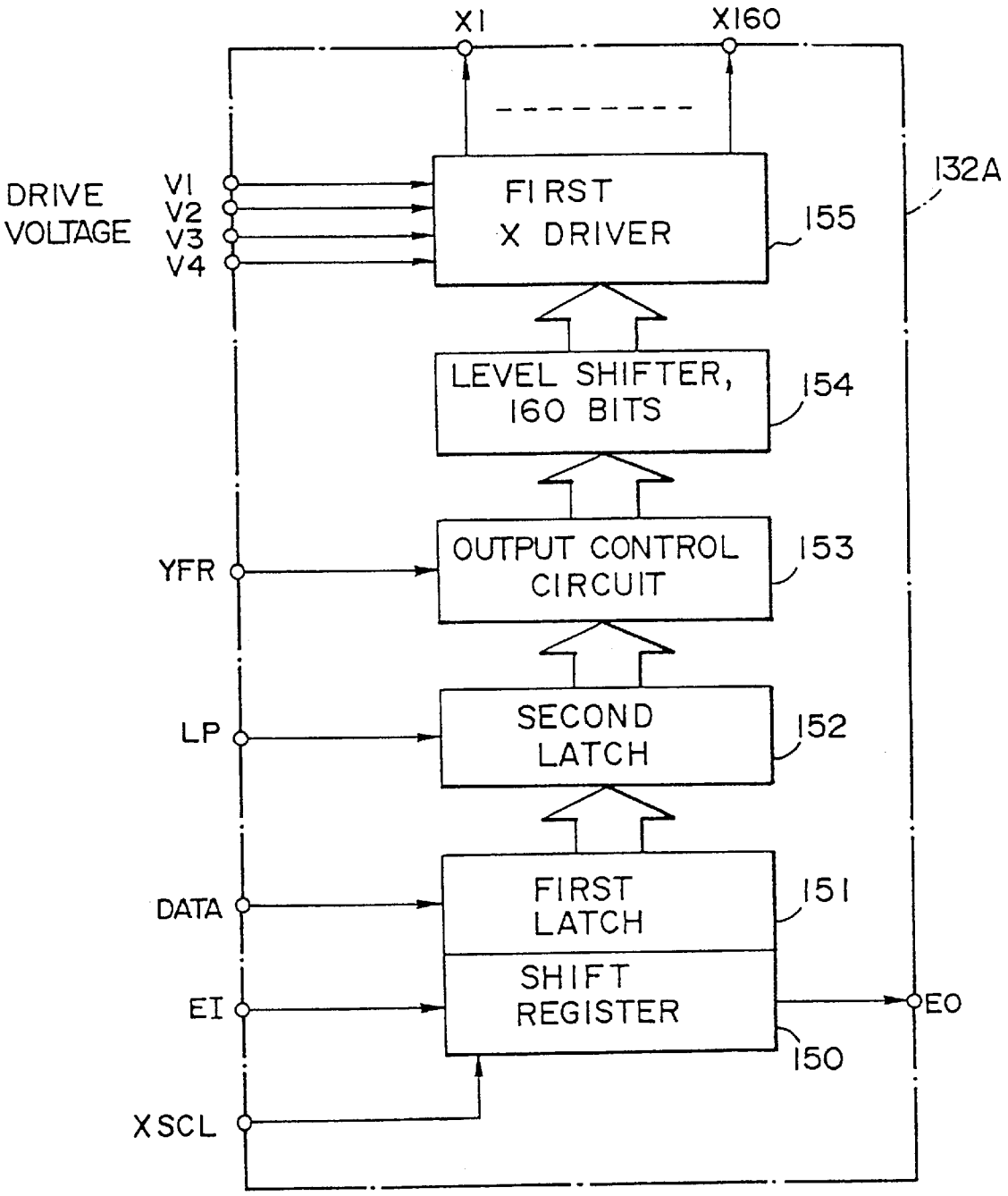
FIG. 42 is a block diagram of the X driver circuit of FIG. 40.

A block diagram of the entire configuration, including the liquid crystal panel and its drive circuitry, is shown in FIG. 40. A liquid crystal panel 130 has a 320×320-pixel structure, and first and second Y driver circuits 131A and 131B and first and second X drivers 132A and 132B are provided in order to drive this liquid crystal panel 130. First and second Y driver circuits 131A and 131B each have the same configuration, which is shown in FIG. 41. Similarly, X driver circuits 132A and 132B have the same configuration, which is shown in FIG. 42.

Referring to FIG. 41, Y driver circuit 131A has a shift register 140 that comprises a select shift register 140A and a reset shift register 140B. Select shift register 140A has registers SR1 to SR160 and reset shift register 140B has registers RR1 to RR160. Select signal S, that specifies selection period T3, is input to select shift register 140A and is sequentially shifted by shift clock YSCL in the next-stage register. The contents of register SR160 are output from a select out pin, enabling a cascade connection with second Y driver circuit 131B. Reset signal RE, which specifies reset period T1, is input to reset shift register 140B and is sequentially shifted by shift clock YSCL in the next-stage shift register. The contents of register RR160 are output through the reset out pin, enabling a cascade connection with second Y driver circuit 131B.

All 160 channels of the contents of each of shift registers 140A and 140B are input to output control circuit 141. Output control circuit 141 identifies six states based on the input states of the reset signal RE, select signal S, and alternation signal FR as (RE, S, FR)=(0, 0, 0), (0, 0, 1), (0, 1, 0), (0, 1, 1), (1, 0, 0), or (1, 0, 1), and outputs corresponding signals, and these signals are input to a Y driver 143 through a level shifter 142. Four types of drive voltage (V1Y, V2Y, V3Y, and V4Y) are input to Y driver 143, and one drive voltage is output to each of the channels in accordance with the logical chart of Table 7, based on the six states identified and output by output control circuit 141.

TABLE 7

| Logical Values for Y Driver Output | | | |
|---|---|---|---|
| Reset | Select | Y FR | Y OUT |
| L | L | L | V4Y |
| L | L | H | V3Y |
| L | H | L | V2Y |
| L | H | H | V1Y |
| H | L | L | V1Y |
| H | L | H | V2Y |
| H | H | * | * |

(L: Low; H: High; *: Don't care)

Figure 43:
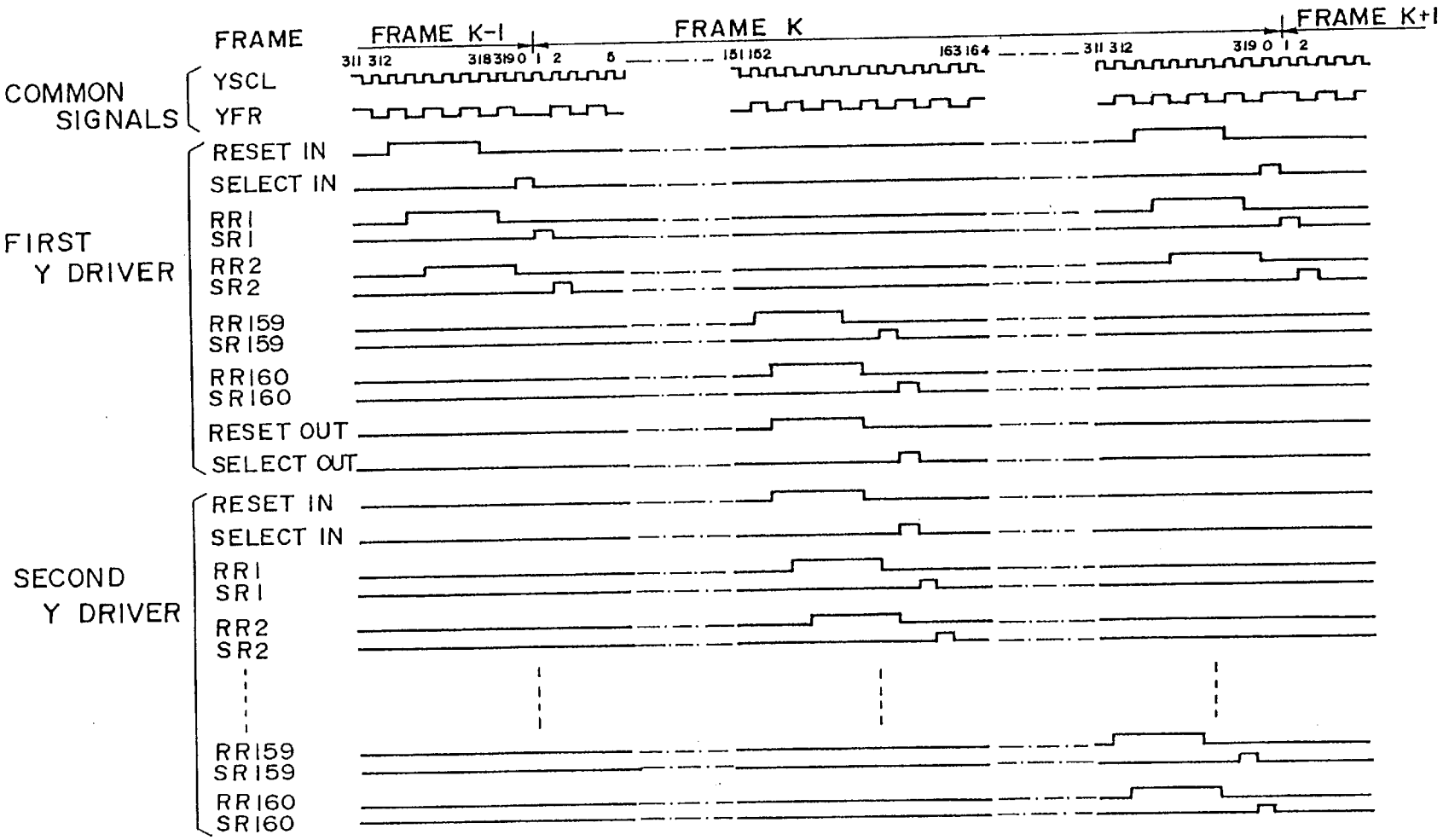
FIG. 43 is a timing chart used to illustrate the operation of the various components of the Y driver circuit of FIG. 41.
Figure 45:
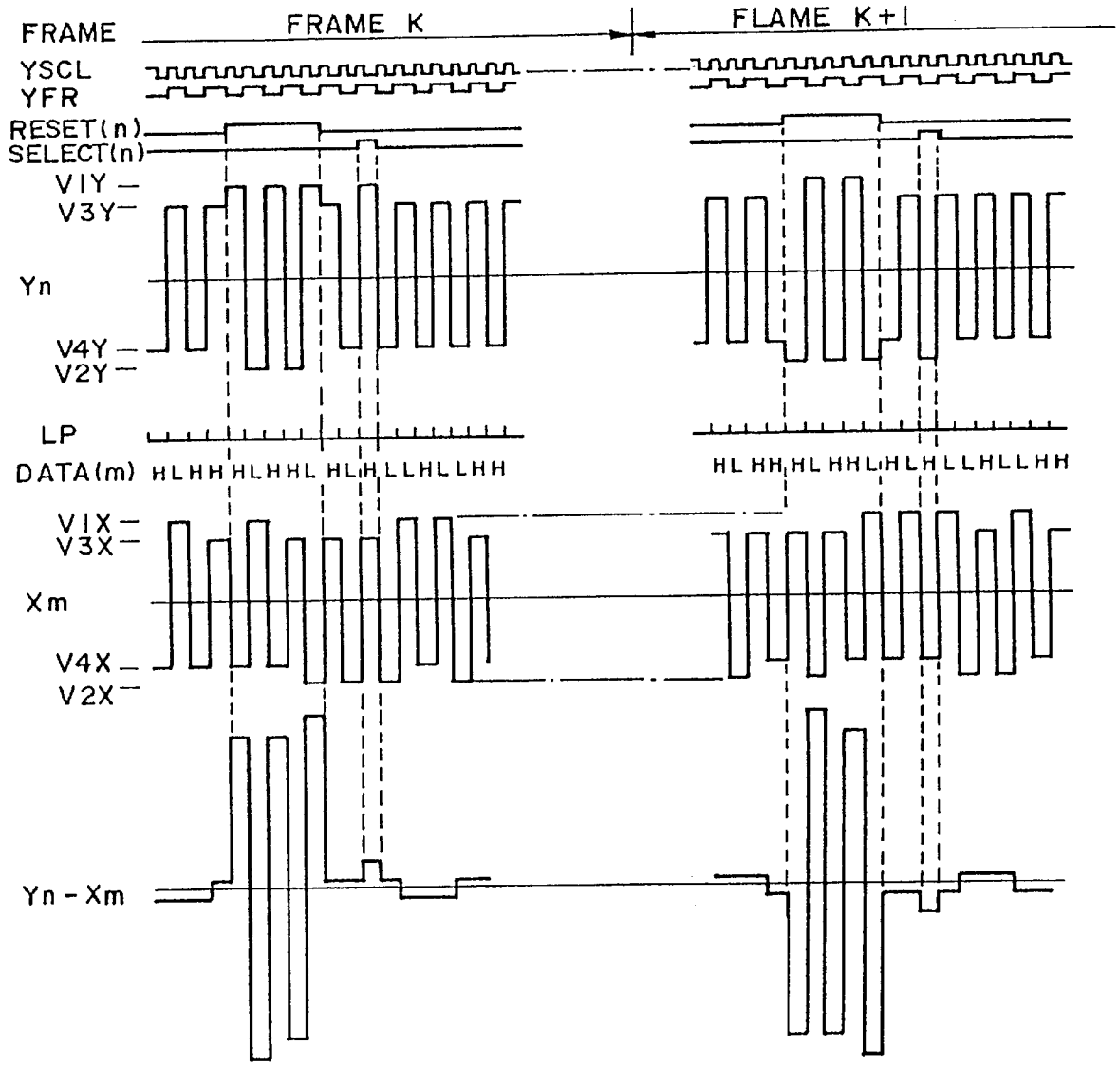
FIG. 45 shows the drive waveforms generated in the drive circuits of FIG. 40.

The states of the input and output signals to and from the various components of first and second Y driver circuits 131A and 131B are shown in FIG. 43. As can be seen in FIG. 43, if the length of selection period T3 is taken to be 1 H, a signal YFR is repeatedly turned on and off every 1 H and the polarity of the voltage applied to the liquid crystal inverts every 1 H. Since each row has 320 pixels, the duty ratio is 1/320, and reset period T1 is set to 5 H and delay period T2 to 2 H. The signal waveform of the nth scan signal Yn output by the operation of this drive circuit is shown in FIG. 45.

First X driver circuit 132A is described with reference to FIG. 42. First X driver circuit 132A has a shift register 150 that has 160 registers, and data is sequentially shifted in a next-stage register in accordance with an input signal EI and a shift clock XSCL. The contents of the 160th register are output to the outside through an EO pin, enabling a cascade connection with second X driver circuit 132B.

Figure 44:
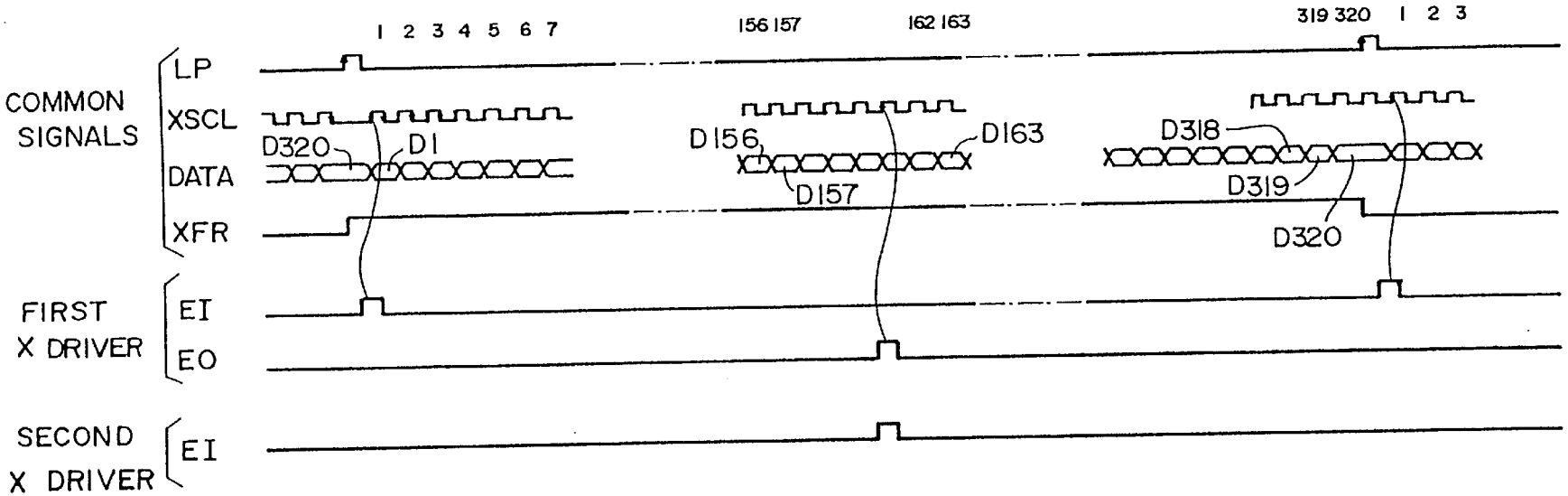
FIG. 44 is a timing chart used to illustrate the operation of the data latch of the X driver circuit of FIG. 42.

Signal EI input to shift register 150 is at a logical one once every period 1 H, as shown in FIG. 44. Therefore, a logical one is output in sequence from each register of shift register 150, and this causes a first latch circuit 151 to latch image data at addresses corresponding to its registers. The 160 channels of data of first latch circuit 151 is latched in a second latch circuit 152 at the timing at which a latch pulse LP is input. An output control circuit 153 that receives alternation signal YFR and data D from second latch circuit 152 identifies four states as (D, YFR)=(0, 0), (0, 1), (1, 0), or (1, 1) according to data D and the input state of alternation signal YFR, and corresponding signals are input channel-by-channel through a level shifter 154 to an X driver 155. X driver 155 receives four types of drive voltage V1X, V2X, V3X, and V4X, and outputs one of the four types of drive voltage to each channel in accordance with the logical chart of Table 8, based on information from output control circuit 153.

TABLE 8

| Logical Values for Y Driver Output | | |
|---|---|---|
| Data | Y FR | X OUT |
| L | L | V2X |
| L | H | V1X |
| H | L | V4X |
| H | H | V3X |

(L: Low; H: High)

Data signal Xm for the mth column, in the data signal output channel-by-channel by X driver 155, is shown in FIG. 45 along with difference signal Yn-Xm between scan signal Yn and data signal Xm. This difference signal inverts the voltage applied to the liquid crystal every 1 H, in the same manner as in the difference signal of FIG. 37 which shows the drive waveforms of the twenty-first embodiment. Since the voltage applied to the liquid crystal within one frame cannot be balanced between positive and negative, a balance between positive and, negative in the voltage applied to the liquid crystal is achieved in the (k+1)th frame subsequent to the kth frame. This means that the difference signal shown in FIG. 45 combines a polarity inversion every 1 H and a polarity inversion every frame, as in the twenty-first embodiment.

Thus the twenty-third embodiment is more advantageous than the twenty-second embodiment from a circuit configuration viewpoint, in that switching of the voltages of each of the scan and data signals is performed by logic means.

Twenty-Fourth Embodiment

Figure 46:
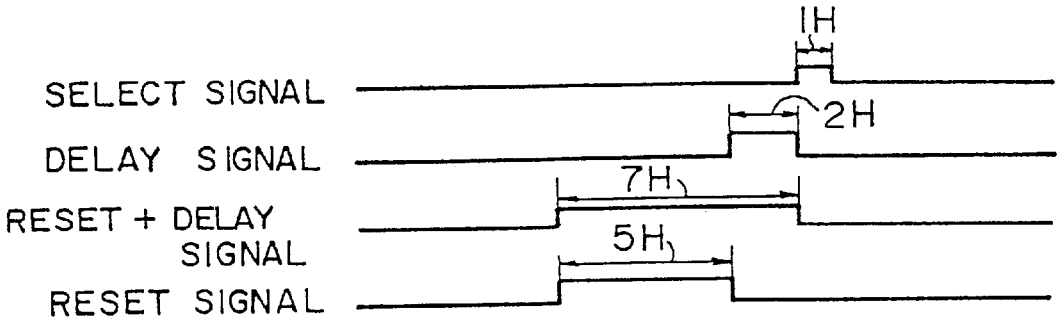
FIG. 46 shows signal waveforms that change the length of the delay period, in accordance with a twenty-fourth embodiment of the present invention.
Figure 47:
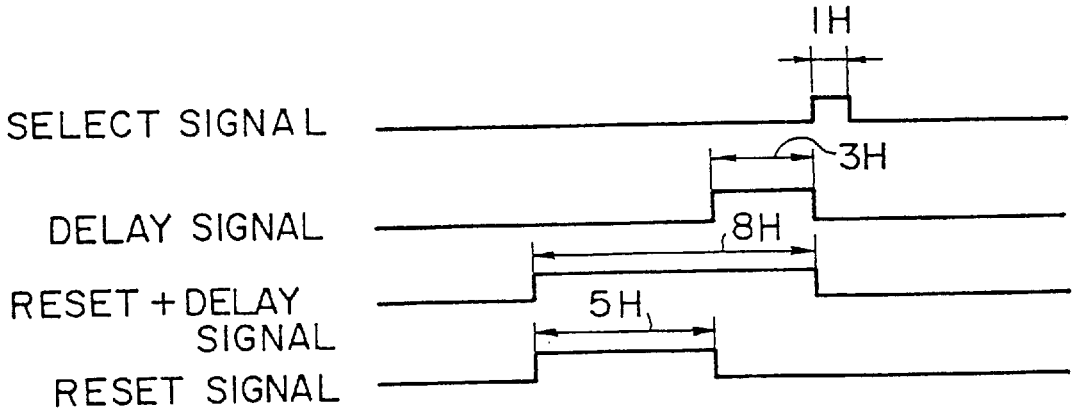
FIG. 47 shows signal waveforms where the delay period of FIG. 46 is changed from 2 H to 3 H.

A drive method that enables modification of delay period T2 within this signal, using the drive circuit shown for the twenty-third embodiment, is described with reference to FIGS. 46–47. The means of changing delay period T2 must not only change the delay period without affecting the specified position of selection period T3 within one frame T, it must also change reset period T1 before delay period T2. As shown in FIG. 46, if reset period T1 is set to 5 H and delay period T2 to 2 H, a combination reset plus delay signal having a pulse width that is the sum of the pulse widths of reset period T1 and delay period T2 (7 H) is generated before selection period T3. The reset signal input to reset shift register 140B of Y driver circuits 131A and 131B can be shaped by an exclusive OR of this reset plus delay signal and the delay signal that specifies the delay period.

Figure 48:
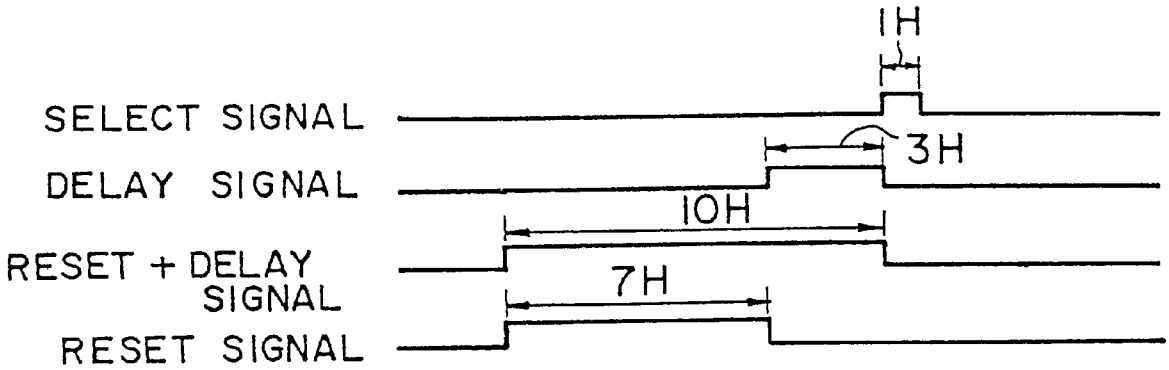
FIG. 48 shows signal waveforms where the delay period of FIG. 46 is changed from 2 H to 3 H and the reset period is changed from 5 H to 7 H.

In this case, if it becomes necessary to change delay period T2 to compensate for irregularities of the threshold value of the liquid crystal at individual pixels making up the liquid crystal panel, or for variations in the threshold value of the liquid crystal caused by ambient temperature, the specifications of delay period T2 and reset period T1 before it can be changed by the above means. In other words, if it is required to change the length of delay period T2, which is 2 H in FIG. 46, to 3 H as shown in FIG. 47, delay period T2 could be changed and simultaneously the pulse width of the reset plus delay signal could be changed to 5 H+3 H=8 H. A reset signal having the same 5 H reset period T1 of FIG. 46 could be shaped by an exclusive OR of the thus modified delay signal and the reset plus delay signal. Similarly, if it is required to change delay period T2 to 3 H and reset period T1 to 7 H, the reset plus delay signal could be changed to a signal having a pulse width of 7 H+3 H=10 H, as shown in FIG. 48.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the subjoined claims.

What is claimed is:

1. A method of driving a liquid crystal display device that uses a chiral nematic liquid crystal medium wherein liquid crystal molecules interposed between two substrates have a predetermined angle of twist in an initial state and said chiral nematic liquid crystal medium has two metastable states differing from said initial state as relaxation states achieved after a voltage that brings about a Freédericksz transition has been applied in said initial state, said liquid crystal display device comprising a plurality of row electrodes formed on a first one of said two substrates, each of said row electrodes being supplied with a row electrode signal, and a plurality of column electrodes formed on a second one of said two substrates, each of said column electrodes being supplied with a column electrode signal, wherein intersections between said row electrodes and said column electrodes form pixels and the voltage of a difference signal between said row electrode signal and said column electrode signal is applied to said liquid crystal corresponding to each of said pixels, said method comprising the steps of:

a) during a reset period, applying to said liquid crystal a reset voltage greater than or equal to a threshold value that brings about said Freédericksz transition;

b) during a first selection period after said reset period, applying to said liquid crystal a selection voltage that is selected on the basis of a critical value that brings about one of said two metastable states;

c) during a non-selection period following said selection period, applying to said liquid crystal a non-selection voltage that is less than or equal to a threshold value that maintains said two metastable states;

d) during a delay period between said reset period and said selection period, applying to said liquid crystal a delay voltage that is less than or equal to said critical value that brings about one of said two metastable states;

e) in said column electrode signal, setting four types of potential for applying positive and negative ON selection voltages and positive and negative OFF selection voltages to said liquid crystal as said data potential;

f) in said row electrode signal, setting two types of potential for applying a positive or negative reset voltage to said liquid crystal during said reset period as said reset potential, two types of potential for applying a positive or negative selection voltage to said liquid crystal during said selection period as said selection potential, and two types of potential for imposing a bias potential on said four data potentials during said non-selection period and said delay period; and g) setting either two types of said selection potential or two potentials among said four types of said data potential to be the same as said two types of said reset potential;

wherein said difference signal includes within one frame said first selection period that is set to be shifted for each of said row electrodes, said non-selection period following thereafter, said reset period set before said selection period, and said delay period inserted between said reset period and said first selection period;

wherein said row electrode signal is at a reset potential during said reset period, a selection potential during said first selection period, and a non-selection potential during said delay period and said non-selection period;

wherein said column electrode signal is set to a data potential which includes either an ON selection potential or OFF selection potential in synchronism with said first selection period; and whereby at least eight potential levels are used for driving said liquid, crystal.

2. The method of claim 1, including the steps of:

dividing said eight potential levels into two groups such that four levels are in a first, low-voltage group (V1, V2, V3, and V4, where: V1<V2<V3<V4) and four levels are in a second, high-voltage group (V5, V6, V7, and V8, where: V4<V5<V6<V7<V8);

selecting said reset potential from the group consisting of said second group, when said data potential of said column electrode signal lies within said first group, and selecting said reset potential from the group consisting of said first group when said data potential of said column electrode signal lies within said second group; and in said periods other than said reset period, selecting one potential each from said first group when said data potential of said column electrode signal is within said first group, and selecting one potential each from said second group when said data potential of said column electrode signal is within said second group.

3. The method of claim 2, including the steps of:

driving said liquid crystal in an alternating manner such that within the period of one frame, an ON selection potential of said column electrode signal is set by alternating pulses of V4 and V5 and an OFF selection potential of said column electrode signal is set by alternating pulses of V2 and V7; and, in a sequence corresponding thereto, said reset potential of said row electrode signal is set by alternating pulses of V8 and V1, said selection potential is set by alternating pulses of V1 and V8, and said non-selection potential is set by alternating pulses of V3 and V6, whereby the polarity of each voltage applied to said liquid crystal is inverted at each pulse.

4. The method of claim 3, wherein said voltages are set to be in the relationship: V4−V3=V3−V2=V7−V6=V6−V5.

5. A method of driving a liquid crystal display device wherein said liquid crystal display device comprises:

a chiral nematic liquid crystal medium wherein liquid crystal molecules interposed between two substrates have a predetermined angle of twist in an initial state and said chiral nematic liquid crystal medium has two metastable states differing from said initial state as relaxation states achieved after a voltage that brings about a Freédericksz transition has been applied in said initial state;

a plurality of row electrodes formed on one of said substrates, each being supplied with a row electrode signal; and a plurality of column electrodes formed on the other of said substrates, each, being supplied with a column electrode signal;

wherein intersections between said row electrodes and said column electrodes form pixels and the voltage of a difference signal between said rout electrode signal and said column electrode signal is applied to said liquid crystal corresponding to each of said pixels to drive said pixels;

said method being characterized in using at least eight potential levels to drive said liquid crystal and comprising the steps of:

a) including within one frame of said difference signal a selection period that is set to be shifted for each of said row electrodes, a non-selection period following thereafter, and a reset period set before said selection period;

b) setting said column electrode signal to data potentials that include a potential that is either an ON potential or an OFF potential for each occurrence of said selection period corresponding to each of said pixels on the same column electrode, and setting four types of potential for applying positive and negative ON selection voltages and positive and negative OFF selection voltages to said liquid crystal, as said data potentials of said column electrode signal;

c) setting said row electrode signal to a reset potential during said reset period, a selection potential during said selection period, and a non-selection potential during a non-selection period, said reset potential being two types of potential for applying positive and negative reset voltages to said liquid crystal during said reset period, said selection potential being two types of potential for applying positive and negative selection voltages to said liquid crystal during said selection period, and said non-selection potential being two types of potential for imposing a bias potential on said four types of data potential during said non-selection period; and d) setting either two types of said selection potential or two potentials among said four types of said data potential to be the same as said two types of said reset potential.

6. The method of claim 5, including the steps of:

dividing said eight potential levels into two groups such that four levels are in a first, low-voltage group (V1, V2, V3, and V4, where: V1<V2<V3<V4) and four levels are in a second, high-voltage group (V5, V6, V7, and V8, where: V4<V5<V6<V7<V8);

selecting said reset potential from amongst said second group when said data potential of said column electrode signal lies within said first group, or from amongst said first group when said data potential of said column electrode signal lies within said second group; and in said periods other than said reset period, selecting one potential each from the same first group when said data potential of said column electrode signal is within said first group, or selecting one potential each from the same second group when said data potential of said column electrode signal is within said second group.

7. The method of claim 6, further comprising the steps of:

setting, within the period of one frame, an ON selection potential of said column electrode signal by alternating pulses of V4 and V5;

setting, within the period of one frame, an OFF selection potential of said column electrode signal by alternating pulses of V2 and V7; and in a sequence corresponding thereto, said reset potential of said row electrode signal is set by alternating pulses of V8 and V1, said selection potential is set by alternating pulses of V1 and V8, and said non-selection potential is set by alternating pulses of V3 and V6, whereby the polarity of each voltage applied to said liquid crystal is inverted at each pulse.

8. The method of claim 7, wherein:

said voltages are set to be in the relationship: V4−V3=V3−V2=V7−V6=V6−V5.

* * * * *

UNITED STATES PATENT AND TRADEMARK OFFICE

CERTIFICATE OF CORRECTION

PATENT NO. : 6,236,385 B1
DATED : May 22, 2001
INVENTOR(S) : Hiroaki Nomura et al.

It is certified that error appears in the above-identified patent and that said Letters Patent is hereby corrected as shown below:

Column 35,
Line 60, delete "," after liquid.

Column 36,
Line 44, delete "," after each.
Line 48, correct "rout" to -- row --.

Signed and Sealed this

Fifth Day of March, 2002

*Attest:*

*Attesting Officer*

JAMES E. ROGAN
*Director of the United States Patent and Trademark Office*